US008273411B2

(12) United States Patent
Madani et al.

(10) Patent No.: US 8,273,411 B2
(45) Date of Patent: Sep. 25, 2012

(54) SURFACE PRE-TREATMENT COATING FILM AND PROCESS FOR METALLIC SUBSTRATES

(76) Inventors: Sayed Morteza Madani, Kerman (IR); Maryam Ehteshamzadeh, Kerman (IR); Hassan Hashemipour Rafsanjani, Kerman (IR)

( * ) Notice: Subject to any disclaimer, the term of this patent is extended or adjusted under 35 U.S.C. 154(b) by 26 days.

(21) Appl. No.: 12/830,289

(22) Filed: Jul. 3, 2010

(65) Prior Publication Data

US 2010/0304158 A1 Dec. 2, 2010

(51) Int. Cl.
*B05D 3/02* (2006.01)

(52) U.S. Cl. ..... 427/343; 427/379; 427/380; 427/388.1; 427/409

(58) Field of Classification Search ..... None
See application file for complete search history.

(56) References Cited

U.S. PATENT DOCUMENTS 5,840,364 A * 11/1998 Takeda et al. ..... 427/160

* cited by examiner

*Primary Examiner* — Erma Cameron
(74) *Attorney, Agent, or Firm* — Barry Choobin; Choobin & Choobin Consultancy

(57) ABSTRACT

The various embodiments herein provide a method and composition to produce an anti-corrosive layer. According to one embodiment herein, a titanium based sol is synthesized and deposited on a substrate, dried for 120° C. for 1 hour, calcinated upto 400° C. for 1 hour, doped with a corrosion inhibitor, dried and deposited a layer of hybrid silica sol and cured to obtain the anticorrosive layer. According to another embodiment, a surface pre-treatment coating has a composition comprising a titanium dioxide layer, a corrosion inhibitor doped on the titanium dioxide layer, a hybrid silicate layer deposited on the doped titanium layer to form a coating to provide an improved corrosion resistance and self-healing effect.

16 Claims, 47 Drawing Sheets

SURFACE PRE-TREATMENT COATING FILM AND PROCESS FOR METALLIC SUBSTRATES

INTERNATIONAL FILING SPONSORSHIP STATEMENT

Iranian Nanotechnology Initiative Council sponsors the Present invention.

BACKGROUND

1. Technical Field

The embodiments herein generally relate to a surface pre-treatment process and particularly to metallic substrates. The embodiments herein more particularly relates to a surface pre-treatment film for anti corrosion of metallic substrates and a method of manufacturing the same.

2. Description of the Related Art

Metallic engineering materials are usually alloys that are designed to meet high demands with respect to mechanical strength and physical properties such as high strength to weight ratios and stiffness but they are highly susceptible to corrosion in corrosive environments.

Steels and stainless steels are widely used in different industrial fields because of their mechanical properties. However, they tend to corrode in different media especially in the presence of halide ions. In order to provide additional long term corrosion protection and improve adhesion of the polymer to the metal, the metallic substrates are pre-treated before applying of an organic paint. The metallic coatings are one of the most widely used methods not only to change the surface properties of the construction elements such as hardness, wearability, solderability, brightness, etc., but also to provide improved protection against corrosion.

A complete coating system consists of three individual layers. The first layer is the conversion coating which is a surface pre-treatment step. These layers protect the underlying metal from corrosion and also give improved adhesion to the substrate. The second layer is the primer and the final layer is the top coat. The primary focus of the embodiments herein is the first layer of the coating system, i.e. the surface pre-treatment step.

One of the traditional methods of protecting the metal substrates from corrosion is a surface passivation treatment, wherein a hard non-reactive surface film is formed spontaneously to inhibit further corrosion. This layer is usually an oxide or nitride that is a few molecules thick. The method is effective for steel and aluminum metals, but has the disadvantages of poor reproducibility and susceptibility to chemical contamination.

Another method of protecting the metal substrates from corrosion is the use of chromate-based conversion coatings, which have been successfully used as a surface pre-treatment process for different alloys for many decades. But, these hexavalent chromium containing compounds are known to be carcinogenic and generally regarded as very hazardous soil and ground water pollutant.

Moreover the chromium compounds have been used as effective pretreatments for 100 years but strong toxic and carcinogenic properties of Cr (VI) lead to consideration of these pretreatments as a potential lung carcinogen responsible for the DNA damage and make them environmentally hostile so that their application is limited.

The use of inorganic oxide coatings provide a good protection to metallic substrates by changing the immediate surface layer of metal into a film of metallic oxide or compound, having better corrosion resistance. But they have some drawbacks which are as follows. They are brittle. The thicker coatings (□ 1 μm) are difficult to achieve without cracking and the relatively high temperatures (400-800° C.) are often required to achieve good properties.

To overcome this limitation, much work has been done to introduce organic component into the inorganic sol-gel to form the inorganic-organic hybrid sol-gel coatings.

The hybrid materials are formed through the hydrolysis and condensation of organically modified silicates with traditional alkoxide precursors. Introduction of covalently bonded Si—R groups allows chemical modification of the resulting material properties. But, the pure inorganic coatings from TEOS (tetra-ethyl-orthosilane) had apparent cracks on the surface. The hybrid sol-gel films perfectly fit with the requirements of a pre-treatment. However, they cannot provide any active corrosion protection and cannot stop the development of corrosion processes when the defect appear, as they contain micro-pores, cracks and areas of low cross-link density that provides pathways for diffusion of corrosive species to the coating/metal interface.

Hence there is a need for an anti-corrosion pre-treatment process that is more workable in overcoming the drawbacks.

The above mentioned shortcomings, disadvantages and problems are addressed herein and which will be understood by reading and studying the following specification.

OBJECTIVES OF THE EMBODIMENTS

The primary object of the embodiments herein is to provide a process of pre-treatment for the metallic substrates.

Another object of the embodiments herein is to provide a nanostructured titanium coating loaded with a corrosive inhibitor and deposited by a silica hybrid coating.

Another object of the embodiments herein is to provide a nanostructured calcinated titanium coating for the loading of corrosive inhibitor with a deposited layer of silica hybrid.

Another object of the embodiments herein is to provide a reservoir for the corrosion inhibitor that is released to protect the metal surface against corrosion.

Another object of the embodiments herein is to provide a long term protection against corrosion.

Another object of the embodiments herein is to provide a process for self-healing activity against corrosion.

Another object of the embodiments herein is to provide environmental friendly pretreatments for metallic substrate.

These and other objects and advantages of the present invention will become readily apparent from the following detailed description taken in conjunction with the accompanying drawings.

SUMMARY

The various embodiments herein provide a surface pre-treatment process for the metallic substrates for protecting the substrates from corrosion, wherein the process comprising manufacturing calcinated nanostructured titanium-silicate hybrid coatings containing nano and micro reservoirs for loading the corrosion inhibitor to provide corrosion protection.

According to one embodiment of the embodiments herein, a surface pre-treatment process wherein a titanium based sol is synthesized and deposited on a substrate, dried for 120° C. for 1 hour, calcinated upto 400° C. for 1 hour, doped with a corrosion inhibitor, dried and deposited a layer of hybrid silica sol, and cured to obtain the anticorrosive layer.

According to one embodiment herein, a surface pre-treatment composition, wherein the composition comprises a titanium dioxide layer, a corrosion inhibitor to be loaded in the titanium dioxide layer, a hybrid silicate layer deposited on the doped titanium layer, wherein the coatings provide an improved corrosion resistance and self-healing effect.

According to one embodiment herein, a surface pre-treatment layer comprises a titanium oxide layer, a silica-hybrid layer, a corrosion inhibitor doped in the titanium oxide layer to provide enhance corrosion and self healing property.

According to one embodiment herein, the layers are deposited by sol gel dip coating technique by dipping the substrate in the sol at a dipping speed of 18 cm/min and exposing for a duration of 100 seconds.

These and other aspects of the embodiments herein will be better appreciated and understood when considered in conjunction with the following description and the accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof, and the embodiments herein include all such modifications.

BRIEF DESCRIPTION OF THE DRAWINGS

The other objects, features and advantages will occur to those skilled in the art from the following description of the preferred embodiment and the accompanying drawings in which.

Figure 1:
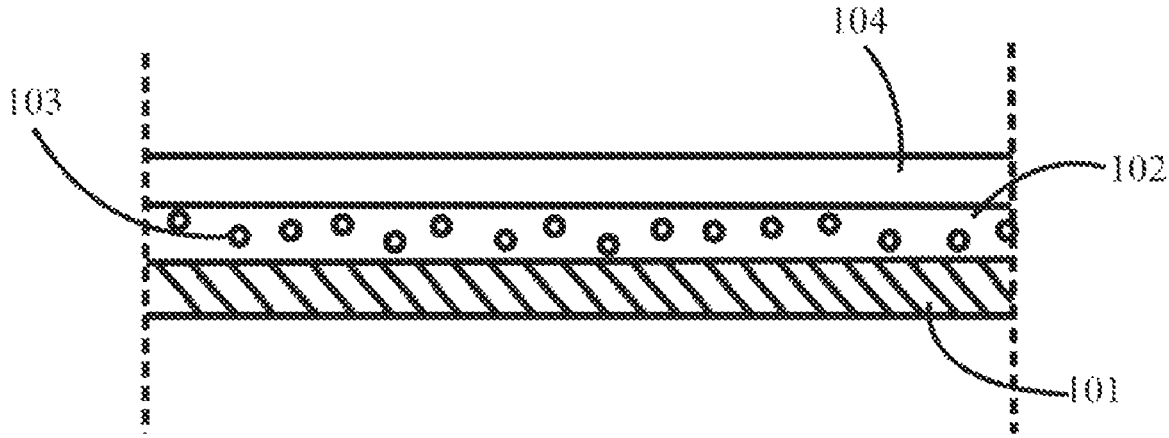
FIG. 1 shows a side view of a surface pre-treatment layer according to one embodiment herein.

Although the specific features of the embodiments herein are shown in some drawings and not in others. This is done for convenience only as each feature may be combined with any or all of the other features in accordance with the disclosure herein.

DETAILED DESCRIPTION OF THE EMBODIMENTS

In the following detailed description, a reference is made to the accompanying drawings that form a part hereof and in which the specific embodiments that may be practiced is shown by way of illustration. The embodiments are described in sufficient detail to enable those skilled in the art to practice the embodiments and it is to be understood that the logical, mechanical and other changes may be made without departing from the scope of the embodiments. The following detailed description is therefore not to be taken in a limiting sense.

The various embodiments herein provide a surface pre-treatment process for metallic substrates for protection from corrosion, wherein the process comprises manufacturing calcinated nano structured titanium-silicate hybrid coatings containing nano and micro reservoirs for loading the corrosion inhibitor to provide corrosion protection.

A complete coating system consists of three layers: the first layer is the conversion coating; the second layer is the primer; and the final layer is the top coat. The first layer, i.e., the conversion coating layer, which is also a surface pre-treatment step. The second layer, i.e., the primer, is a preparatory coating put on materials before painting. It ensures better adhesion of paint to the surface, increases paint durability, and provides additional protection for the material being painted. The final layer or the top coat is the final coat of paint.

In a surface pre-treatment process, the surface of a metal is chemically converted to a surface that will more easily accept applied coatings and resist corrosion. The primary focus of the various embodiments herein is the first layer of the coating system, i.e. the conversion coating in which the surface pre-treatment step takes place.

The introduction of an anticorrosion component in the pre-treatment, incorporated in the sol-gel coating in order to improve the protection of metallic substrates against corrosion, can be a possible way to assure active corrosion protection. Different approaches have been suggested to introduce the inhibitor in the pre-treatment: formation of lanthanide containing conversion film, direct introduction of inhibiting ions or molecules in the thin pre-treatment layers, impregnation of hybrid sol-gel films with cerium-containing oxide nanoparticles or with polyelectrolyte nano-containers filled with benzotriazole.

The nanostructure oxide layer doped with corrosion inhibitor seems to be a promising substitute for the environmentally-unfriendly pre-treatments. The use of oxide layer with high surface area opens the possibility of high loading of corrosion inhibitor, impart durability, scratch resistance, and improved adhesion to the metal substrates. The hybrid silica contributes to increased flexibility, density and functional compatibility with organic polymer paint. This assures a good adhesion of the organic paint system to the metal, provides additional dense barrier for corrosive species, and confers a self-healing mechanism for induced defects.

The embodiments herein are directed to anticorrosion nanostructured hybrid surface pre-treatment for metallic substrates. The calcination heat treatment is used to improve the corrosion performance and self-healing property. Benzotriazole as an organic inhibitor is doped in titanium oxide coatings to improve corrosion protection of the coatings as well as self-healing properties. For the enhancement of the corrosion resistance of surface pre-treatment, the silicate hybrid film is deposited onto titanium interlayer to form a more cross-linked and denser film that provide strong physical barrier against electrolyte uptake. The calcinated and doped with benzotriazole coatings possess higher corrosion resistance than non calcinated although doped with inhibitor. $TiO_2$ nanostructure calcinated/inhibitor/hybrid silicate system showed enhanced corrosion performance and self-repairing ability which is confirmed by EIS and PDS measurements.

FIG. 1 shows the side view of the surface pre-treatment layer, according to one embodiment herein. With respect to FIG. 1, a surface pre-treatment film 100 is deposited on the substrate 101. The titanium layer 102 formed over the substrate 101 is doped with benzotriazole 103 as corrosion inhibitor. The silica hybrid layer 104 is deposited on the titanium layer 102 doped with benzotriazole 103.

Figure 2:
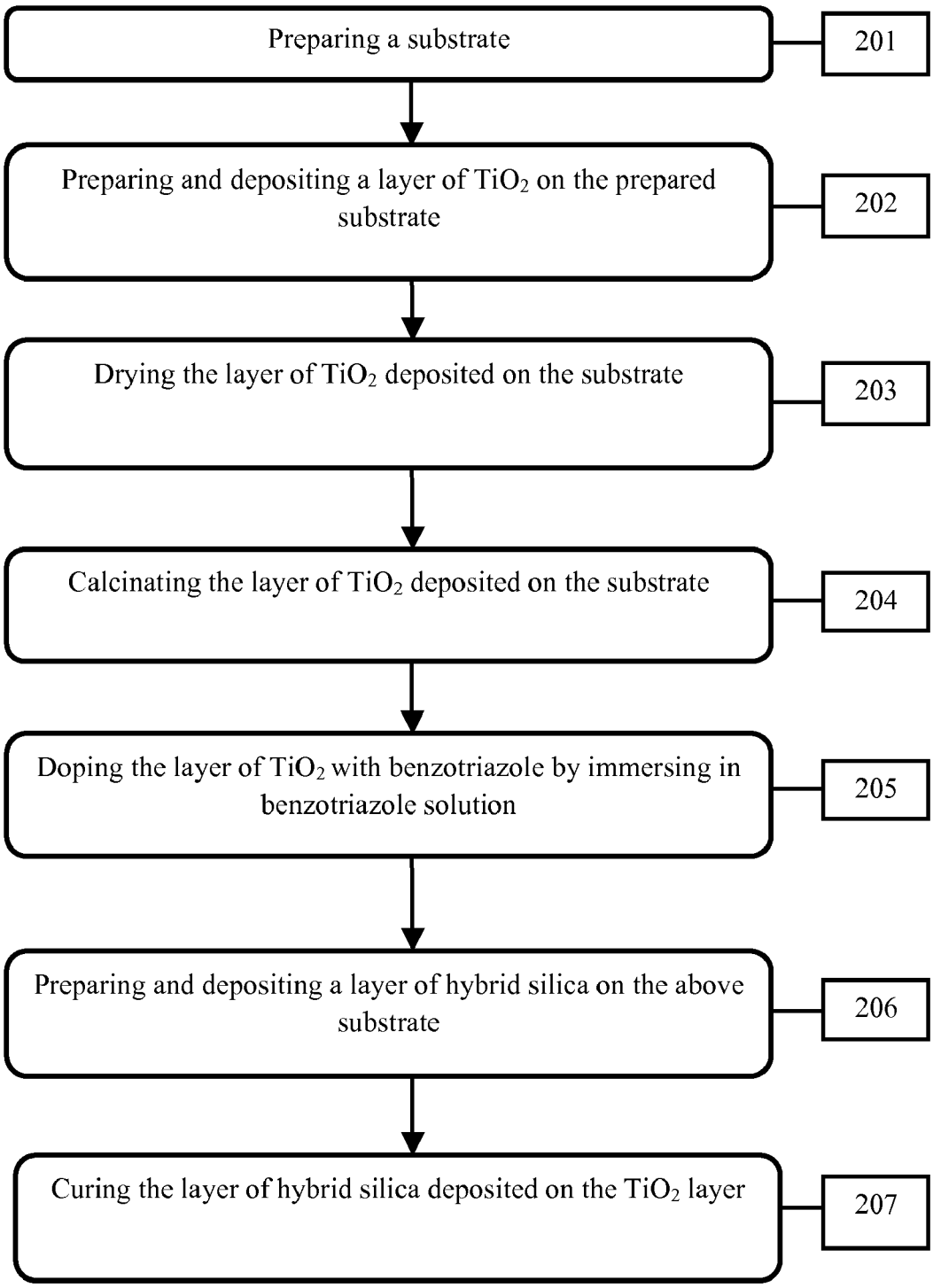
FIG. 2 shows a flow chart explaining the processes in the preparation of a surface pre-treatment layer according to one embodiment herein.

FIG. 2 shows a flow chart explaining the processes in the preparation of a surface pre-treatment layer according to one embodiment herein. With respect to FIG. 2, a substrate is prepared for coating a surface pre treatment film (201). For the preparation of substrate, Mild steel CK45 is used. Steel coupons of size 0.5 cm×1 cm×1 cm are grounded with emery papers, number 200 to 2500. After grinding, they are ultrasonically cleaned in a mixture of acetone, ethanol and distilled water for 10 minutes.

A titanium based sol is prepared and deposited on the substrate to form a thin $TiO_2$ film (202). The layer of a titanium dioxide ($TiO_2$) is deposited on the substrate using a sol-gel method. The layer of a titanium dioxide ($TiO_2$) is deposited on the substrate using a controllable hydrolysis of titanium alkoxide, wherein the titanium alkoxide is 0.029 moles of tetra-n-butyl-orthotitanate.

The sol is prepared by using tetra-n-butylorthotitanate as precursor, ethanol as solvent and nitric acid 70% as catalyst. 0.029 moles of tetra-n-butyl orthotitanate is dissolved in 0.685 moles of ethanol and stirred by using magnetic stirrer for 1 hour to obtain a solution. The obtained solution is hydrolyzed by adding drop-wise a mixture of 0.277 moles of de-ionized water, 0.0441 moles of nitric acid and 0.171 moles of ethanol under stirring for another one hour at room temperature to obtain a resultant solution. The resultant solution is kept at room temperature for 24 hours to finally obtain a transparent yellow solution of titanium oxide.

The substrate is dipped in the titanium oxide sol for approximately 100 seconds. A thin film of the titanium dioxide is formed on the substrate by a sol-gel dip coating process at a withdrawal speed of 18 cm/min.

The substrate formed with thin $TiO_2$ film is dried at 120° C. for 1 hour in an oven (203). The dried substrate is calcinated up to 400° C. for 1 hour at a rate of 1° C./min in a furnace (204).

The $TiO_2$ layer is doped with a corrosion inhibitor. The corrosion inhibitor is benzotriazole. The calcinated substrate is doped with benzotriazole (BTA) by immersing the calcinated substrate in 10% weight benzotriazole solution for 1 hr and drying the calcinated substrate for 30 minutes at 80° C. after the immersion process (205).

A silica-based hybrid sol layer is prepared and deposited on the $TiO_2$ film doped with BTA (206). An organosiloxane sol is prepared by hydrolyzing a 3-glycidoxypropyltrimethoxysilane (GPTMS), a tetraethylorthosilicate (TEOS) and a 2-propanol in preset volume ratios. The 3-glycidoxypropyltrimethoxysilane (GPTMS), the tetraethylorthosilicate (TEOS) and the 2-propanol are mixed in the preset volume ratios of 6:5:12.

The organosiloxane sol is hydrolyzed by adding 5 ml of de-ionized water that is dissolved in 0.5 ml acetic acid in drop-wise to the organosiloxane sol, after 1 hour since preparation. The hydrolyzed organosiloxane sol is stirred under ultrasonic agitation for 1 hour. The stirred hydrolyzed organosiloxane sol is kept for ageing for 24 hrs for condensation.

The prepared hybrid silica-based sol is applied on the doped $TiO_2$ layer to form a hybrid silica layer by using a sol-gel dip technique by dipping the substrate formed with the doped $TiO_2$ layer at a dipping speed of 18 cm/min and exposing the substrate for a duration of 100 seconds.

The substrate coated with the hybrid silica layer on the doped $TiO_2$ film is dried at 120° C. for 1 hour. Then the above substrate is cured in air to allow a cross-linking and gelation of sol-gel, and evaporation of solvent to obtain the required anti-corrosion pre-treatment layer (207).

Titanium oxide has excellent chemical stability, heat resistance and low electron conductivity thereby making it an excellent anti-corrosion material. Crystalline titanium oxide film exists in three phases: anatase (tetragonal), rutile (tetragonal), and brookite (orthorhombic). Rutile is the most stable of three. Its formation depends on starting material, deposition method and calcination temperature. In particular, titanium oxide thin film can transform from amorphous phase into crystalline anatase and from anatase into rutile by calcination.

The hybrid silica-based sol-gel coatings which have good flexibility and compatibility with the paint system have been deposited on the $TiO_2$ coatings. Silanes fall into two groups in terms of their hydrophobicity, i.e., alcohol-based and water-based. A large amount of organic solvents such as ethanol or methanol is required in the preparation of hydrophobic silane solutions. This need of a high concentration of alcohol in the silane solution has posed a major obstacle in the introduction of alcohol-based silanes into existing industrial systems because reduction of volatile organic compounds (VOCs) is requested by both legislators and end-users, for the sake of flammability and human safety. Therefore, high demands are made for water-based silanes to make this technology become more acceptable to industries.

Mixtures of GPTMS and TEOS have emerged as an outstanding example among water-based silanes, especially in light of their universal applicability to a broad range of metals and paints. The major advantages of these silane mixtures are as follows. They are alcohol-free, i.e., only de-ionized (DI) water is needed to dilute the neat silane mixtures. They hydrolyze instantaneously and completely. They require less time for preparation than the alcohol-based systems. In addition, their hydrolysis is complete as compared to alcohol-based silanes where it is equilibrium. Their corrosion protection performance, especially with topcoats, is comparable to that of alcohol-based silanes and chromates. They exhibit a broader compatibility to more paints than the individual silanes, as the mixtures contain more organo-functional groups. It is also reported that the TEOS-MAPTS (tetraethylorthosilicate-γ-Methacryloxypropyl trimethoxysilane) hybrid coatings are uniform and crack-free.

Benzotriazole is used as organic inhibitor in industries to reduce the corrosion of alloys under both atmospheric and immersed conditions. The $TiO_2$ nanoparticle coatings doped with benzotriazole confers the best corrosion protective properties from the point of view of long term protection against corrosion as intermediate layer in coating system. It is generally believed that the inhibition efficiency of benzotriazole is due to the formation of such a protective Ti-BTA film with $TiO_2$ layer. As titanium alkoxide are Lewis acids and can interact with compounds having a lone pair of electron (Lewis bases). The formation of surface complex film through the lone pair electrons on a nitrogen atom in the triazol ring of benzotriazole with Ti provides more compact barrier layer leading to a higher inhibition effect.

EXPERIMENTAL DATA

To investigate the effects of calcination heat treatment and doping with inhibitor on corrosion performance of the $TiO_2$ nanostructured interlayer coatings, the following cases are considered:

Case 1: Specimens are dipped merely in the titanium sol and after drying in the room temperature they are dried in an oven at 120° C. for thirty minutes.

Case 2: To dope the inhibitor after coating based on Case 1, the specimens are dipped in %10, %15 and %20 benzotriazole (BTA) solutions for one hour and dried for thirty minutes at 80° C.

Case 3: After drying at 120° C. for 30 minutes in the oven, the coated specimens are calcinated up to 400° C. at 1° C./min rate for one hour in a furnace.

Case 4: To dope the inhibitor in the calcinated coating, the specimens are dipped in %10, %15 and %20 BTA solutions for one hour and afterwards are dried for thirty minutes at 80° C.

To investigate the effects of loading of benzotriazole on the titanium oxide interlayer and the hybrid silane film on the protective properties of hybrid sol-gel, the samples are prepared according to five different states and named as L, K, N, M, and E, wherein:

(L) Metallic samples immersed for 100 seconds in titanium sol, dried for 1 hour at 120° C. and immersed in hybrid silicate sol for 100 seconds and then dried for 1 hour at 120° C.

(K) Metallic samples treated with $TiO_2$ sol, dried at 120° C. for 1 hour, and then immersed for 1 hour in 10 wt % benzotriazole solutions, dried for 30 minutes at 80° C. and coated with hybrid silicate sol according to case L.

(N) Metallic samples treated with $TiO_2$ sol and after drying at 120° C. for 1 hour in the oven, calcinated up to 400° C. at 1° C./min rate for 1 hour in a furnace and coated with hybrid silicate sol according to case L.

(M) Metallic samples with calcinated $TiO_2$ interlayer are immersed in 10 wt % benzotriazole solution for 1 hour and then dried for 30 minutes at 80° C. and the hybrid silicate layer deposited on the $TiO_2$ layer.

(E) Metallic samples immersed for 100 second in Titanium sol that containing 10 wt % of benzotriazole, dried for 1 hour at 120° C. and then coated with hybrid silicate sol.

The morphology and the structure of the obtained $TiO_2$ nanostructure and hybrid silicate coatings are studied by scanning electron microscopy (SEM, CAMSCAN 2600 MV) equipped with an EDAX (Energy Dispersive X-ray Spectroscopy) and the beam energy is 25.0 kV. Also, atomic force microscopy (AFM) Nanoscope Digital Instrument fitted with a NanoScope III 5.12r2 controller is used for trail of $TiO_2$ nanoparticles in the interlayer. XRD analyzer equipment is used to identify the phases in the titanium oxide coatings, (Philips X'pert, X-ray diffraction, Cu Kα, radiation) and X'pert HighScore 1.0d software is employed for analyzing the peaks. Electrochemical impedance spectroscopy (EIS) and potentiodynamic polarization (PDS) are employed to study the corrosion behavior of the coating in 3.5% NaCl solution. EIS measurements are carried out with A PARC EG&G Model 263A potentiostat coupled with a PC14 Controller at open circuit potential with applied 10 mV sinusoidal perturbation in the 100 KHz to 10 mV frequency range with 30 steps per decade. A three-electrode cell is used, consisting of a saturated calomel reference electrode (SCE), a platinum foil counter electrode and the coated metallic substrates as working electrodes with a surface area of 1 $cm^2$ for each one. A Luggin capillary having a porous tip is employed for minimizing the contamination and preventing potential variation of the reference electrode, as well as to position it in the desired point of the cell. Potentiodynamic polarization curves are recorded in the potential range of −100 to 700 mV versus open circuit potential and sweep rate of 2 mV/s. The results are analyzed using "Softcorr352" software. The spectra are analyzed in terms of an equivalent circuit using "ZView2" software. For reassuring of data reproducibility, each measurement is done for three specimens treated in the same condition and mean values are reported.

Figure 3A:
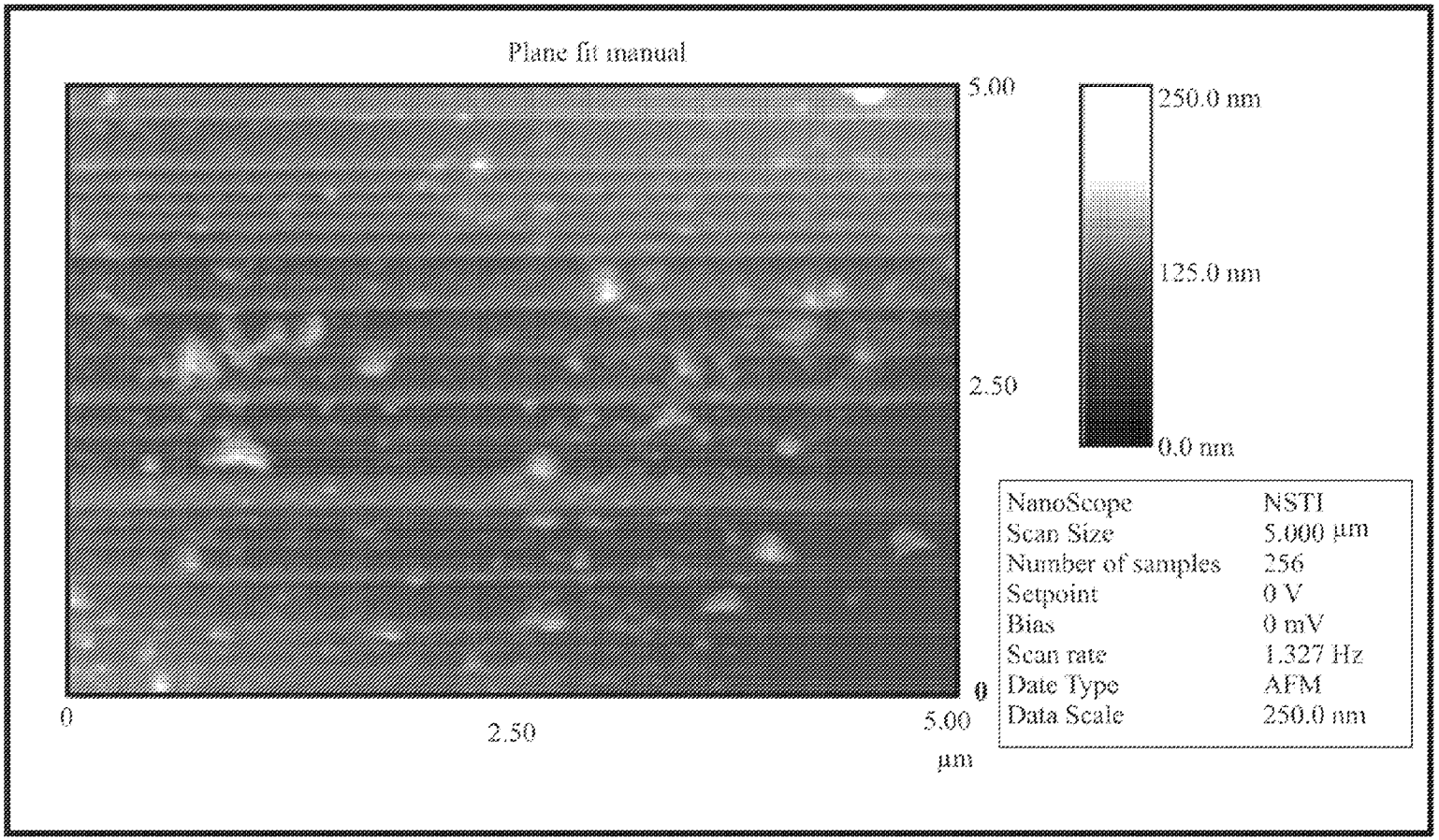
FIG. 3 shows atomic force microscopy (AFM) scan of the surface morphology of the $TiO_2$ interlayer of the coated specimen, in which a) indicates a 2-dimensional image and (b) indicates a 3-dimensional image of the $TiO_2$ interlayer of the coated specimen.
Figure 3B:
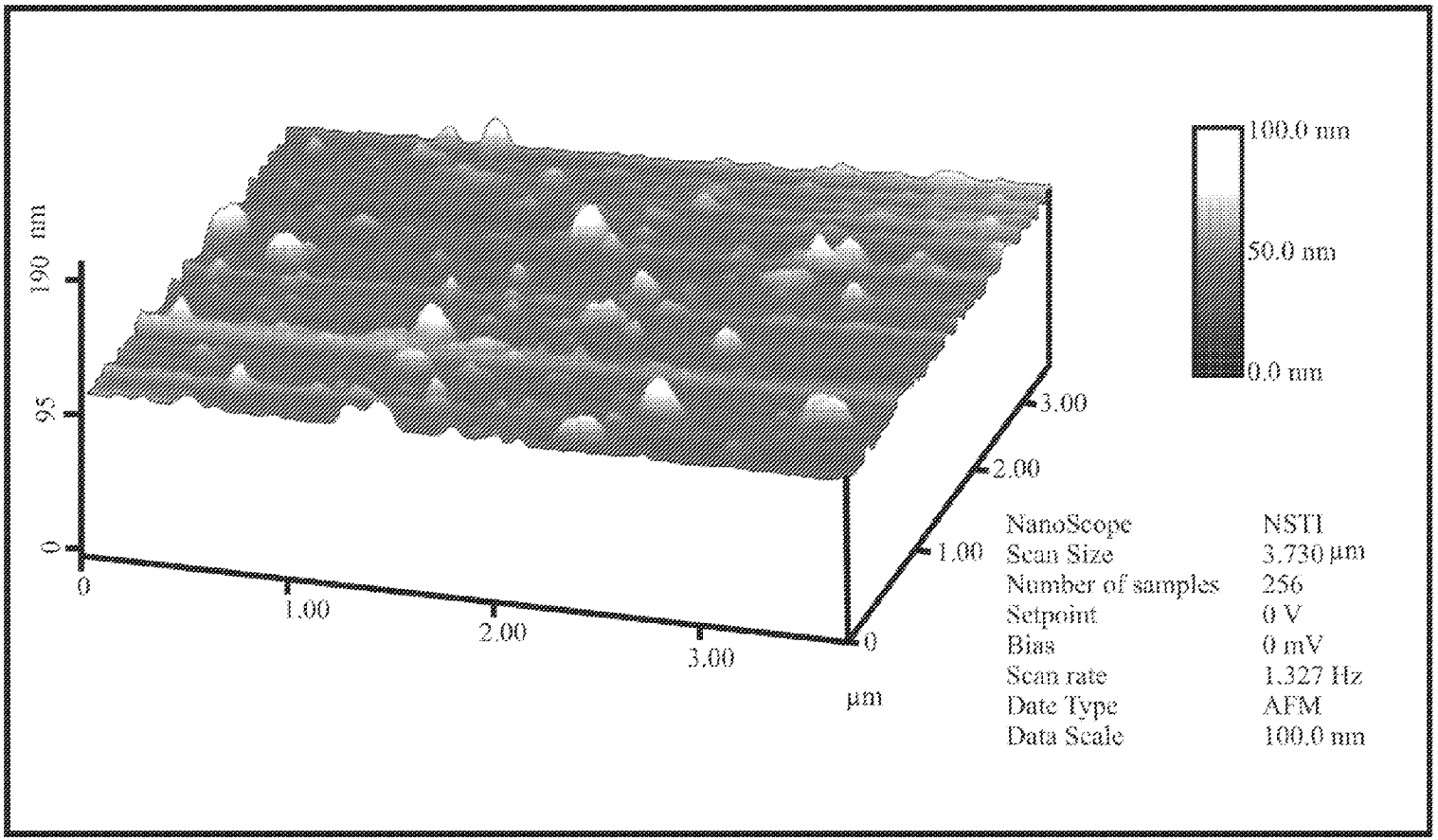

FIG. 3 shows atomic force microscopy (AFM) scan of the surface morphology of the $TiO_2$ interlayer of the coated specimen, in which a) indicates a 2-dimensional image and (b) indicates a 3-dimensional image of the $TiO_2$ interlayer of the coated specimen.

Presence of nanoparticles and their distribution in the $TiO_2$ film can be clearly seen in FIG. 3. The distribution of the nanoparticles are relatively uniform and the particles diameter range can be referred as around 50-120 nm. Particles having bigger diameter may result from agglomeration of smaller ones. It is also seen that anatase to rutile phase transformation takes place at temperatures of 600° C.-800° C. The crystalline size of $TiO_2$ thin film increases with increasing calcination temperature and therefore the surface of particle decreases.

Figure 4:
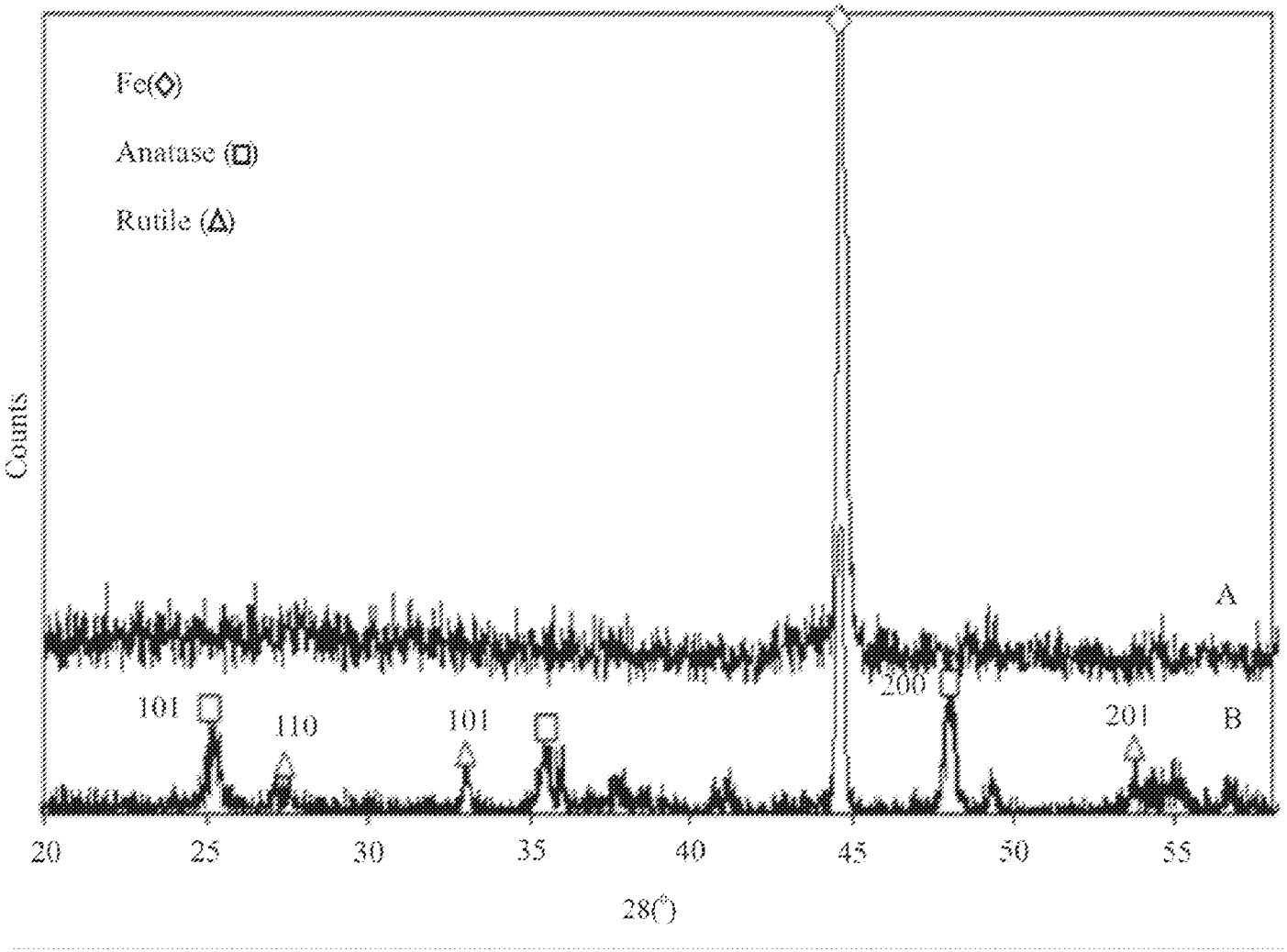
FIG. 4 shows the typical X-Ray diffraction (XRD) patterns of $TiO_2$ sol-gel coatings on steel CK45 after drying at 120° C. and calcinating at 400° C., in which a) indicates the XRD patterns before calcination and b) indicates the XRD patterns after calcination at 400° C.

FIG. 4 shows a typical XRD pattern of the coated specimens prepared according to the Case 1 and the Case 3. Crystalline phases of anatase and rutile are detected according to the angles of 2θ=25.34, 2θ=35.6, and 2θ=48.07 for anatase and 2θ=27.43, 2θ=33.11, and 2θ=54.31 for rutile. In this work, the anatase peaks appeared at 400° C. resulting from a phase transition from amorphous phase to the anatase phase. The percentage of anatase phase is calculated using peak intensities of anatase phase in (101) plane and rutile phase in (110) plane, and according to Eq. (1):

$$(X\%) = \frac{100}{1 + \frac{1.265Ir}{Ia}} \quad \text{Eq. (1)}$$

Where X is the percentage of anatase phase, Ir and Ia are the peak intensities of rutile and anatase phases, respectively.

According to the XRD patterns, the calcinated coating contains almost 70% anatase phase. As anatase phase has smaller size particles than rutile phase, so there is more surface area to absorb the inhibitor as compared to rutile phase.

Figure 5A:
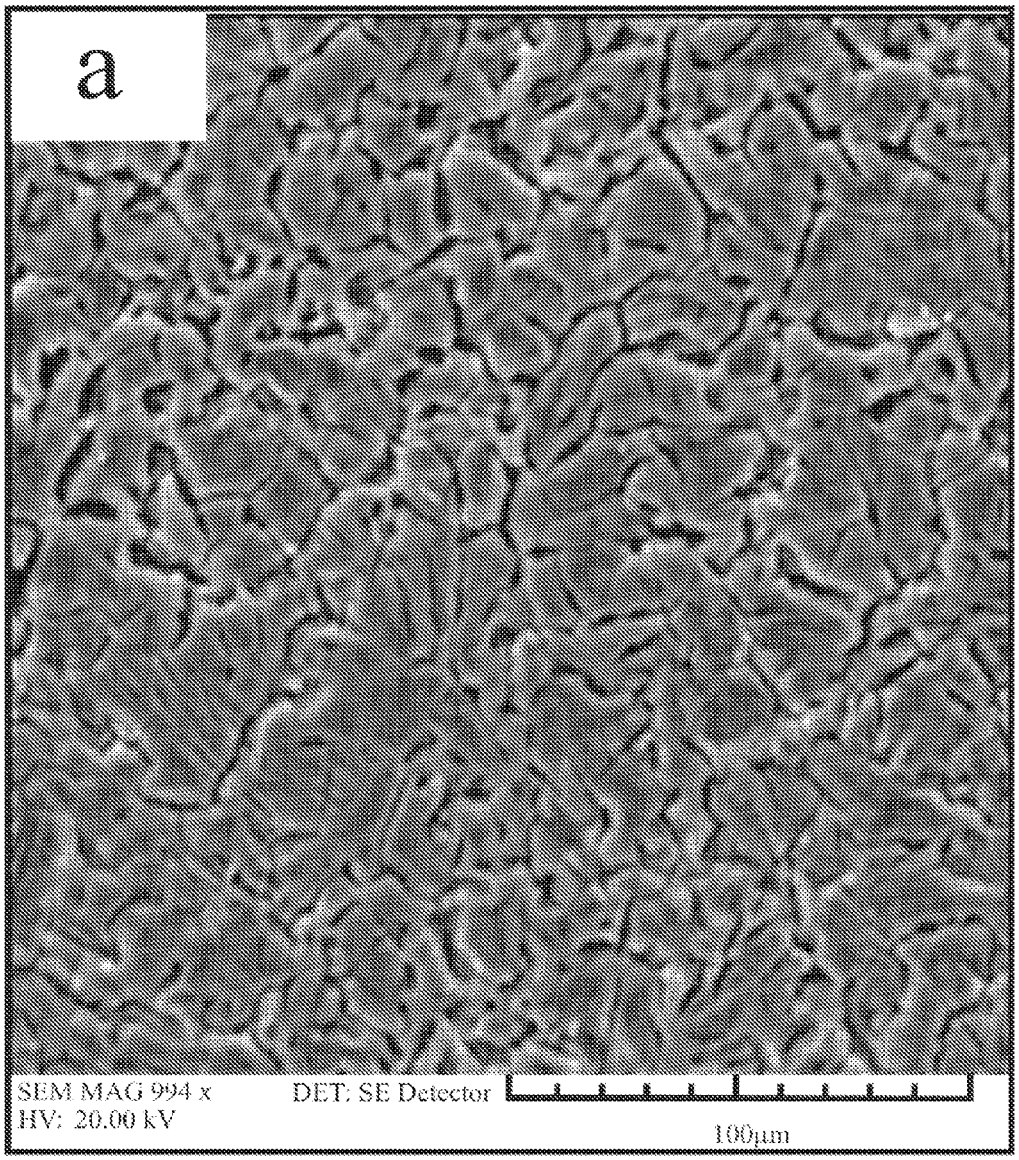
FIG. 5 shows scanning electron microscopy (SEM) micrographs of $TiO_2$ sol-gel coatings on steel CK45 after drying at 120° C., in which (a) indicates SEM micrographs of $TiO_2$ sol-gel coatings without calcination and (b) indicates SEM micrographs of $TiO_2$ sol-gel coatings with calcination at 400° C.
Figure 5B:
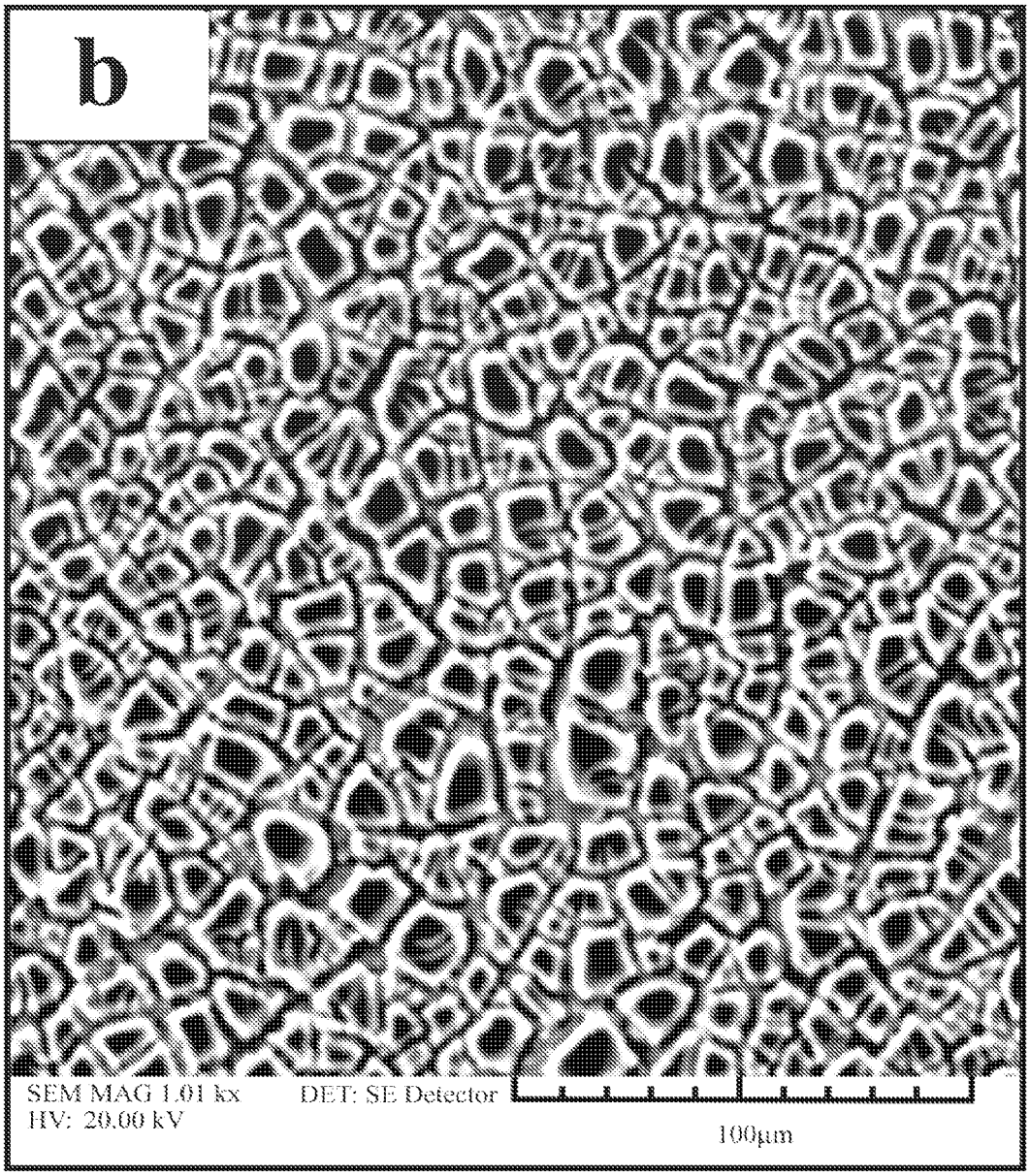

FIG. 5 shows SEM micrographs of $TiO_2$ sol-gel coatings on steel CK45 after drying at 120° C., (a) shows SEM micrographs of $TiO_2$ sol-gel coatings without calcination (Case 1) and (b) shows with calcination at 400° C. (Case 3). It can be seen that calcination heat treatment affected the cracked coating structure. It is seen the cracks are smaller for specimens dried at 120° C. and larger for specimens calcinated at 400° C. The cracks formed in the calcinated coating may be related to the fast evaporation of ethanol as well as difference between thermal expansion coefficients of the coated layer and its sub-layer. Although the cracks per surface should decrease the corrosion resistance of the coating, they also allow a significantly higher storage of BTA which may more than counterbalance this negative effect.

Figure 6A:
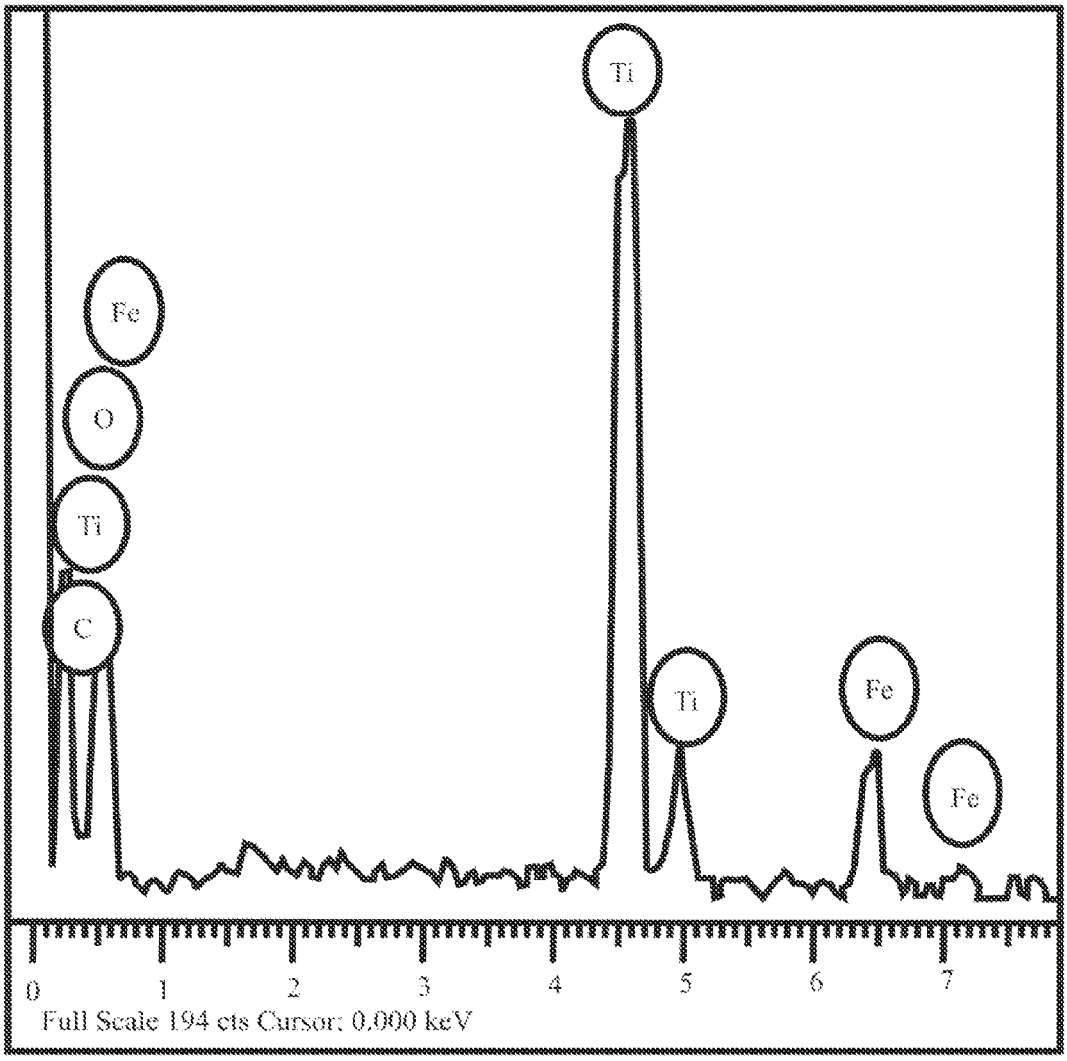
FIG. 6 shows a typical energy dispersive spectroscopy (EDS) analysis of $TiO_2$ sol-gel coated steel CK45 after drying at 120° C. and calcination at 400° C.
Figure 6B:
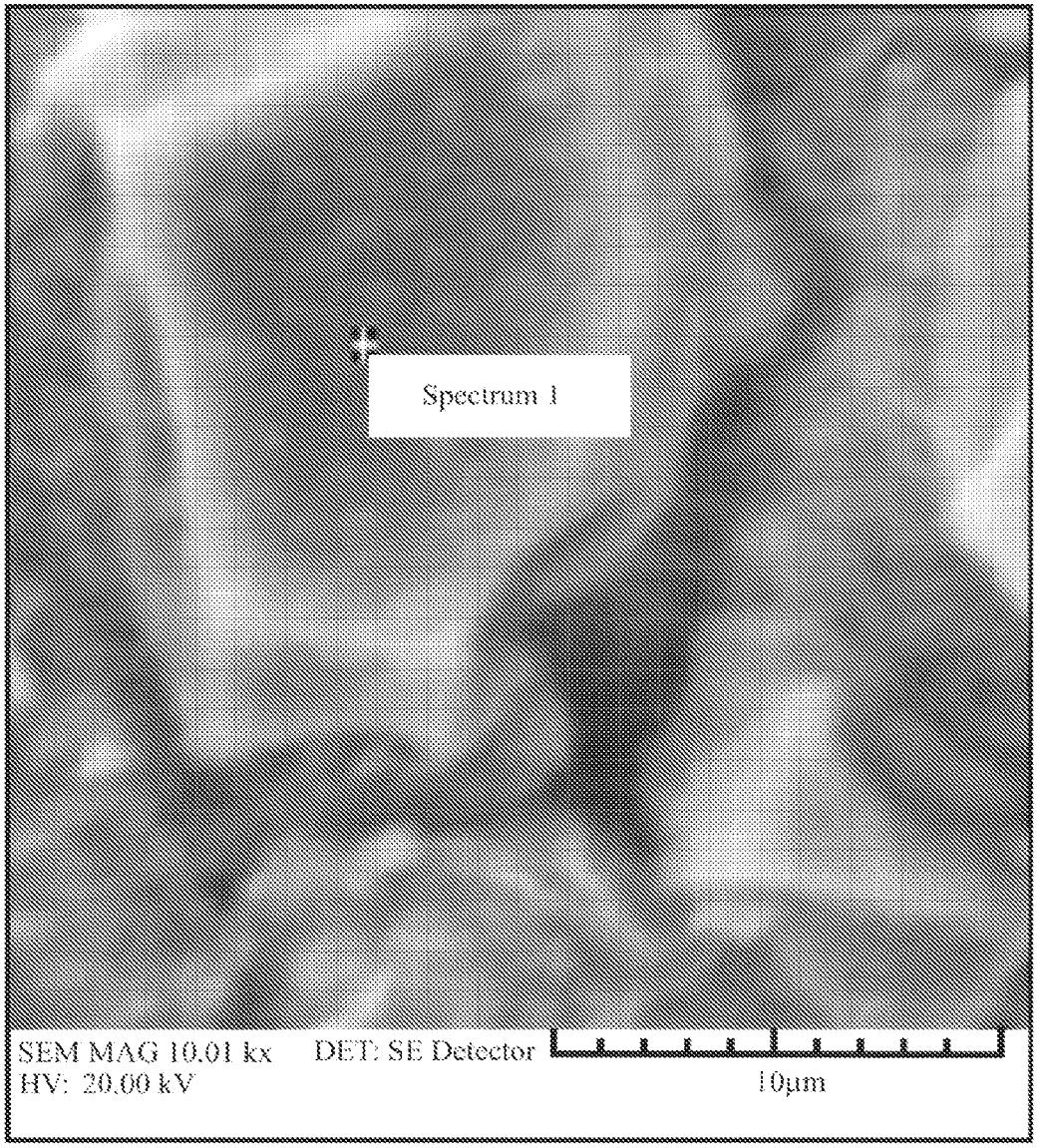

FIG. 6 shows EDS analysis of the $TiO_2$ sol-gel coated steel CK45 after drying at 120° C. and calcination at 400° C. In addition to the pointed cracks in the coating, the particles of $TiO_2$ in anatase phase, as shown vividly in FIG. 5, provide other suitable sites for adsorption of the inhibitor due to their small particle size.

Figure 7A:
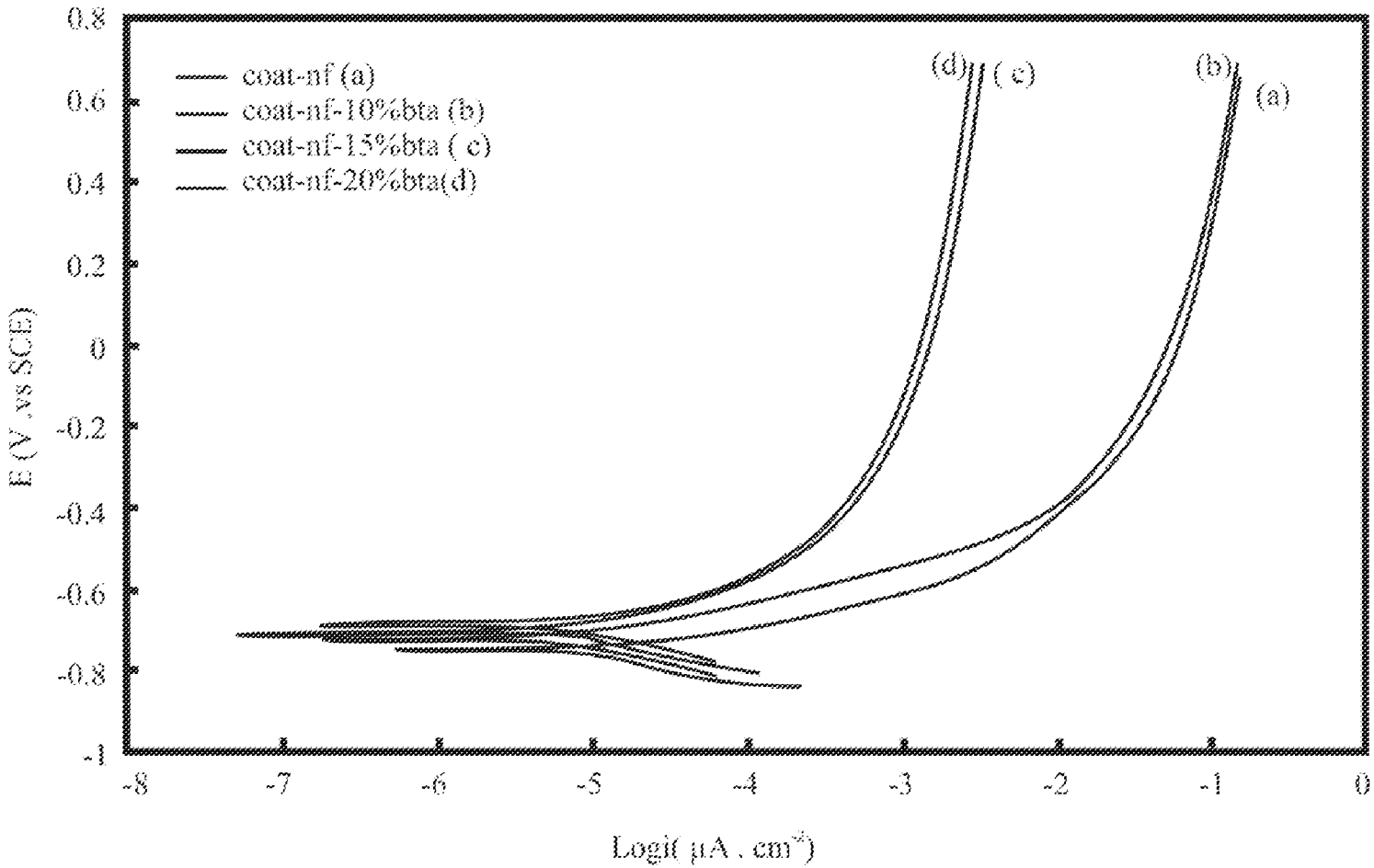
FIG. 7 shows potentio-dynamic polarization curves of $TiO_2$ sol-gel coatings on steel CK45 before and after doping with different concentrations of benzotriazole.
Figure 7B:
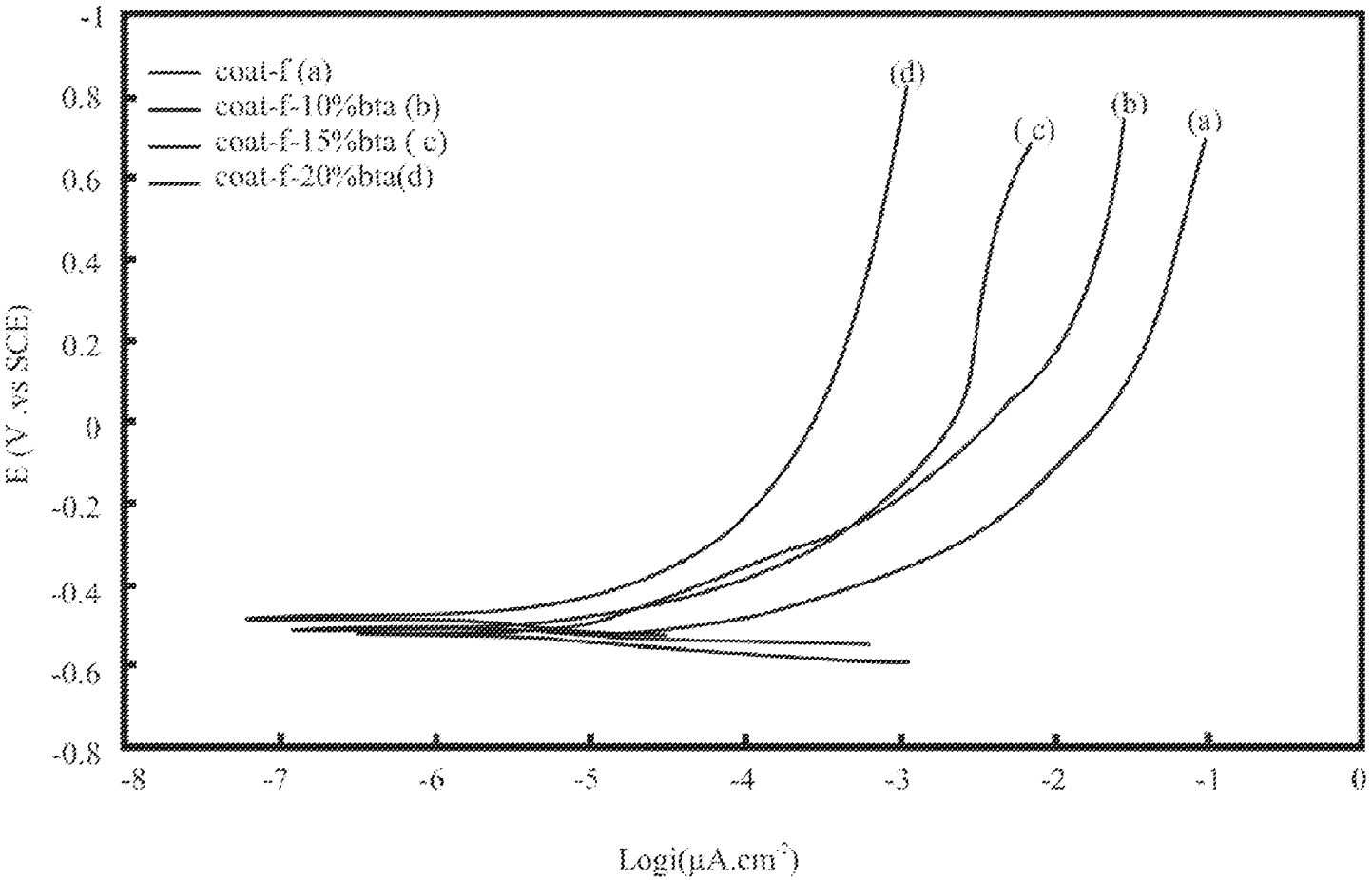
Figure 8A:
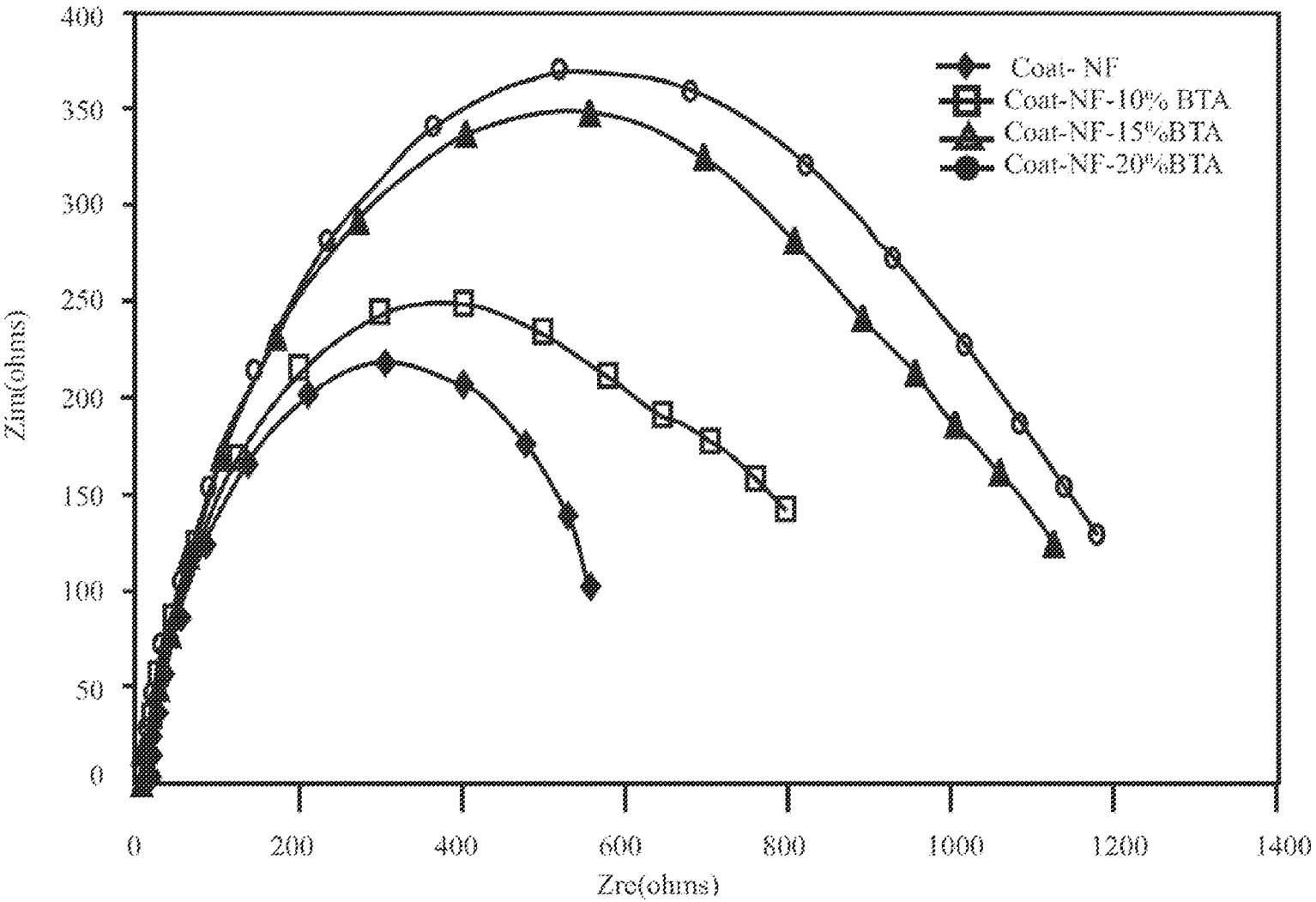
FIG. 8 shows Complex plane, bode-phase and bode plots of $TiO_2$ sol-gel coatings on steel CK45 before and after doping with different concentrations of benzotriazole.
Figure 8B:
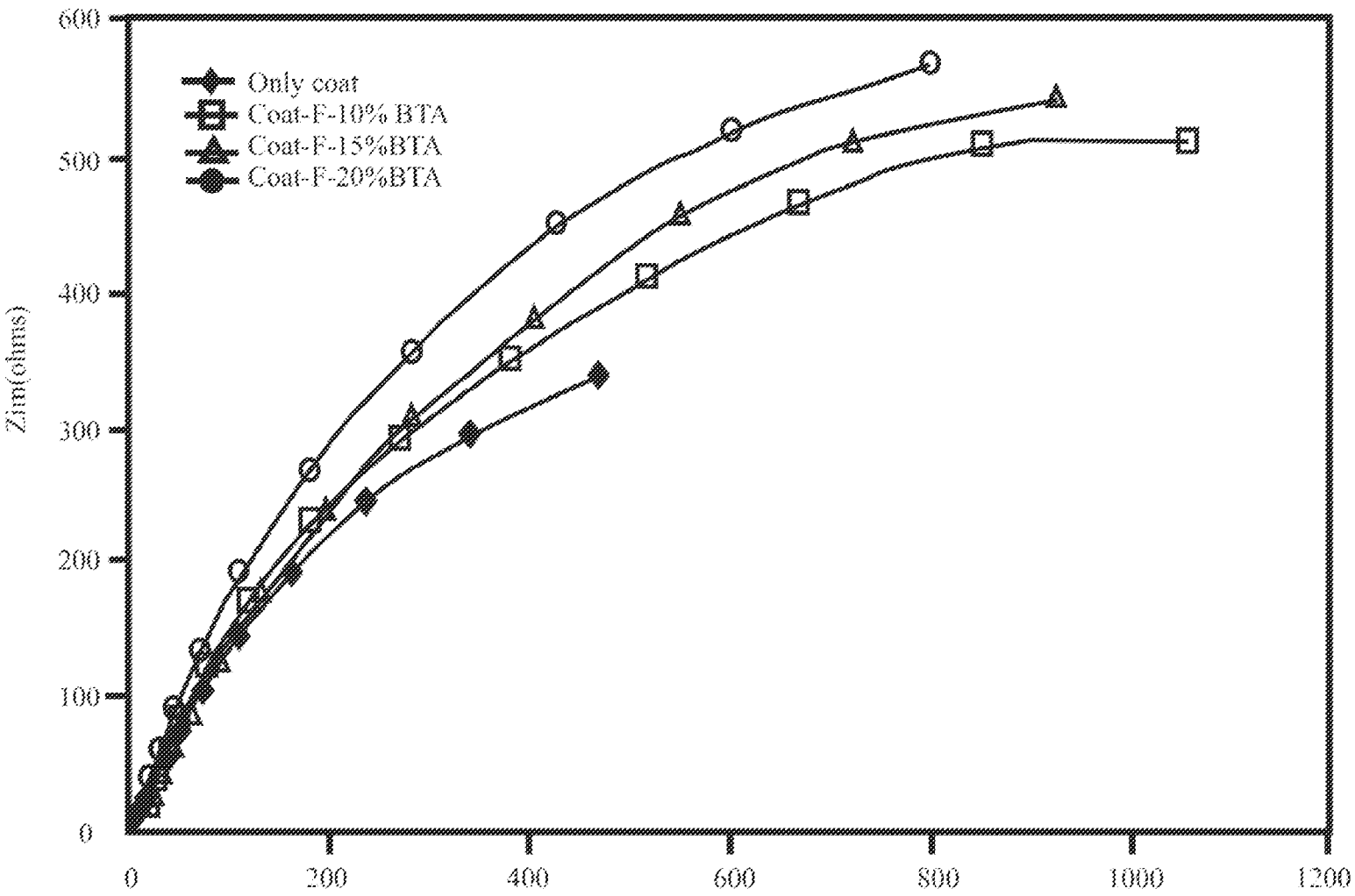
Figure 8C:
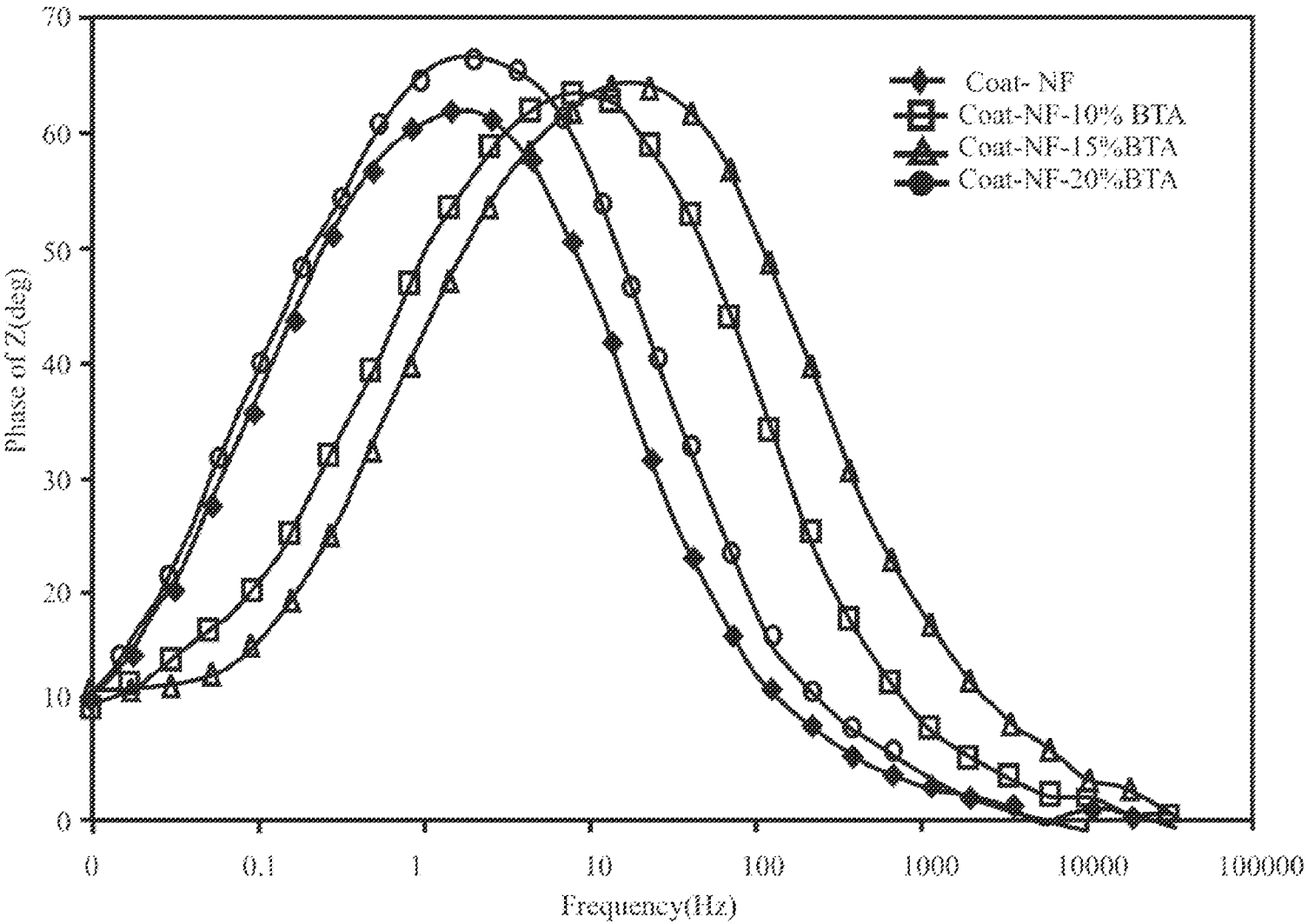
Figure 8D:
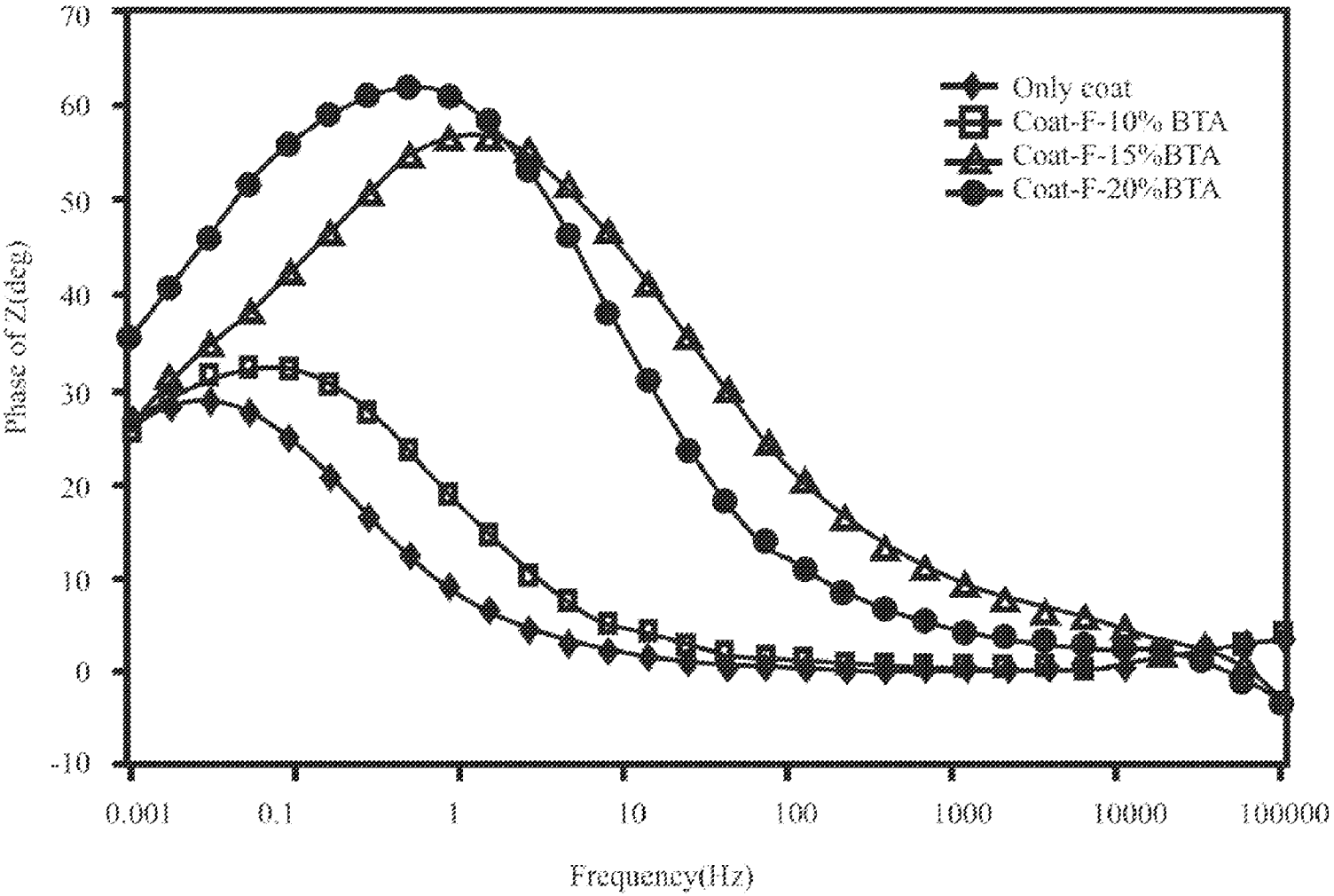
Figure 8E:
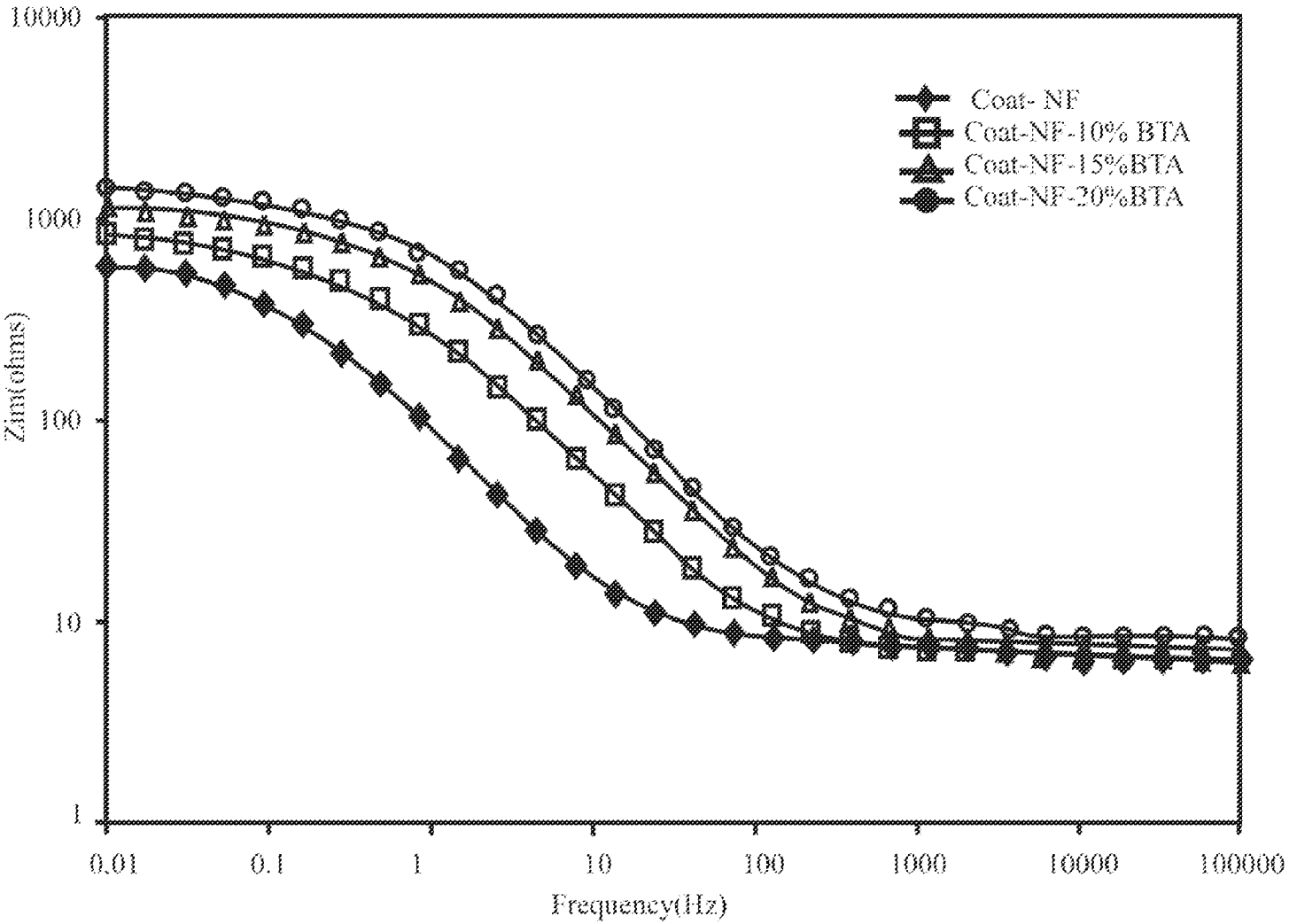
Figure 8F:
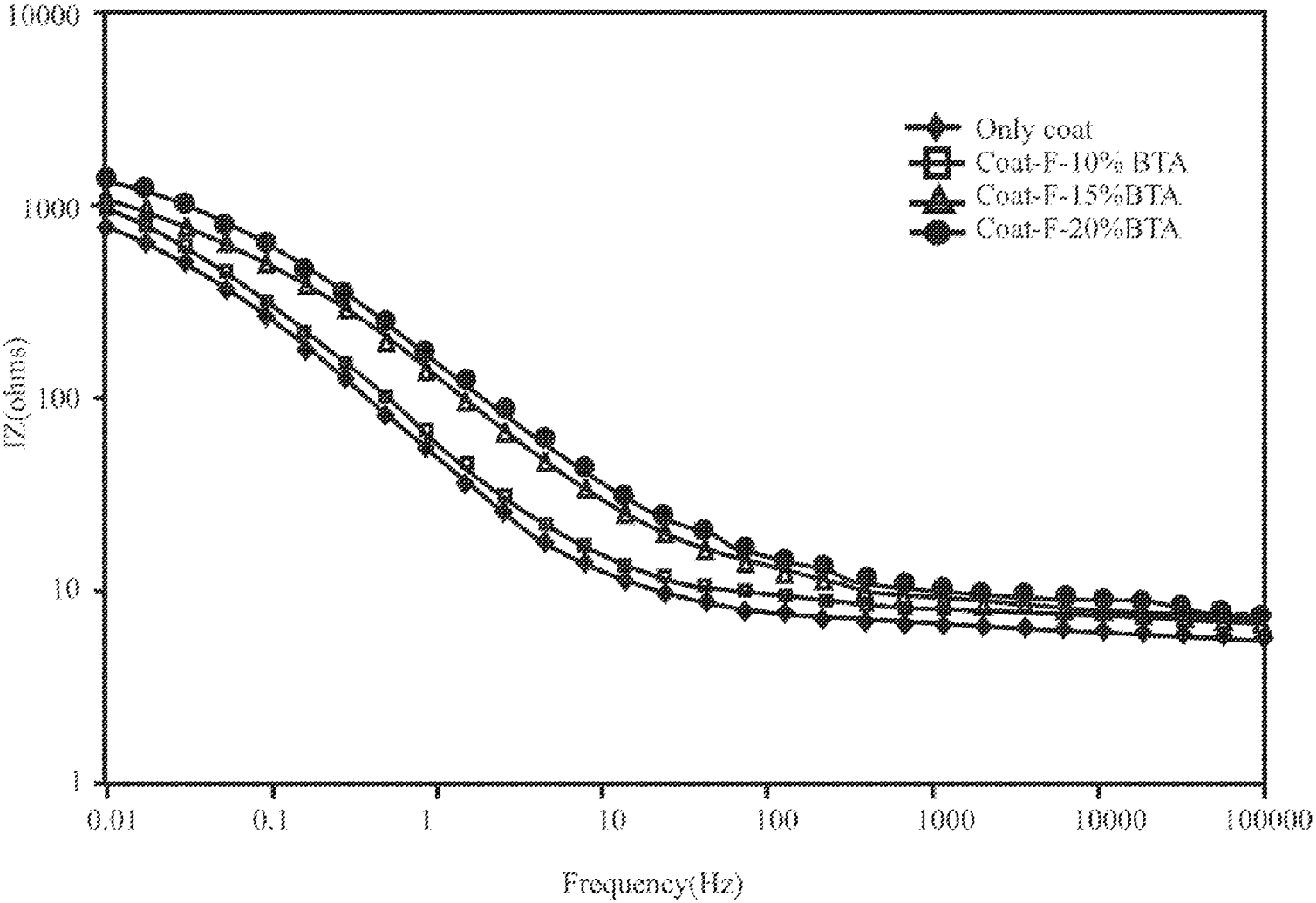

FIG. 7 shows Potentiodynamic polarization curves of $TiO_2$ sol-gel coatings on steel CK45 before and after doping with different concentrations of benzotriazole. Table 1 lists the parameters of the curves.

FIG. 7 shows Potentiodynamic polarization curves of $TiO_2$ sol-gel coatings on steel CK45 before and after doping with different concentrations of benzotriazole. Table 1 lists the parameters of the curves.

TABLE 1

Potentiodynamic polarization parameters values of $TiO_2$ sol-gel coatings on steel CK45 before and after doping with different concentrations of benzotriazole.

| $B_c$(mV/decade) | $B_a$(mV/decade) | $I_{corr}$)μA/cm$^2$( | $E_{corr}$(mV) | specimen |
|---|---|---|---|---|
| 91.6 | 64.2 | 11.5 | −742 | coat-nf |
| 87.1 | 82.5 | 10.8 | −716 | Coat-nf-10% BTA |
| 142.1 | 97.5 | 9.3 | −682 | Coat-nf-15% BTA |
| 157.4 | 104.2 | 7.35 | −708.2 | Coat-nf-20% BTA |
| 66.6 | 48.5 | 15.0 | −536 | coat-f |

TABLE 1-continued

Potentiodynamic polarization parameters values of $TiO_2$ sol-gel coatings on steel CK45 before and after doping with different concentrations of benzotriazole.

| $B_c$(mV/decade) | $B_a$(mV/decade) | $I_{corr}$)μA/cm$^2$( | $E_{corr}$(mV) | specimen |
|---|---|---|---|---|
| 65.6 | 76.4 | 9.2 | −523 | Coat-f-10% BTA |
| 66.3 | 96.8 | 7.3 | −515 | Coat-f-15% BTA |
| 55.9 | 120.8 | 3.8 | −491 | Coat-f-20% BTA |

The results show that calcination heat treatment increases corrosion current density. This may be related to the effect of the calcination heat treatment on the morphology of the coating which is characterized by more and larger cracks.

However, doping with BTA decreased corrosion current densities and made corrosion potentials nobler either before or after calcination. It was found that corrosion current densities are lower and corrosion potentials are nobler for calcinated coatings at 400° C. and doped with BTA than those dried at 120° C. and doped with BTA.

Moreover, with respect to the anodic and cathodic branch slopes with specimens doped with BTA in different concentration solutions, it can be inferred that with increasing inhibitor percentages, the anodic branch slope increases while there is not any appreciable change in the cathodic branch slope. This can be justified by more adsorption of inhibitor in calcinated specimens as compared to the non calcinated ones, due to more surface area provided by the cracks and the effect of available inhibitor molecules in the calcinated coatings on the anodic reactions at the contact surface of sample with the electrolyte, and consequently reduction of anodic reaction rates.

An organic inhibitor gets adsorbed on a metal surface by two ways; physical/electrostatic and chemisorption, owed to different relationships between concentration of inhibitor and fractional surface coverage. The fractional surface, S, covered by adsorption is related to the concentration, C, of the adsorbed species in solution by the equation (2):

$$S = \frac{ac}{1 + ac} \quad \text{Eq. (2)}$$

Where, α is a characteristic constant for the specific adsorbate. Therefore it was presented that the increase of BTA concentration resulted in improvement of corrosion performance due to better BTA adsorption. Another reason for improvement of the corrosion performance of the calcinated $TiO_2$ coatings loaded with BTA may be explained as follows: $TiO_2$ may act as a reservoir of the inhibitor that can release it to protect the metal surface against corrosion.

EIS Measurement

FIG. 8 shows Complex plane, bode-phase and bode plots of $TiO_2$ sol-gel coatings on steel CK45 before and after doping with different concentrations of benzotriazole. The effect of calcination heat treatment and doping the coatings with different concentrations of BTA by Nyquist, bode-phase and bode plots are shown in FIG. 8.

Figure 9A:
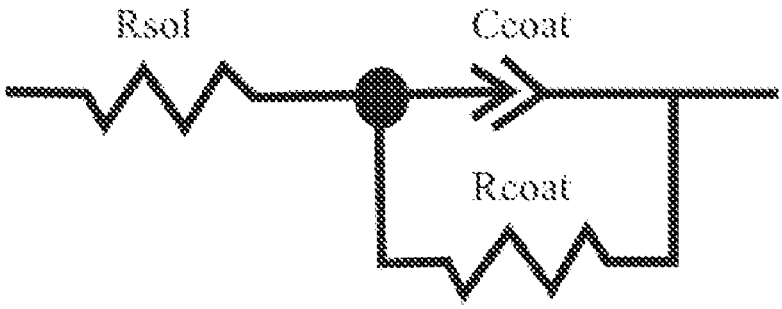
FIG. 9 shows the equivalent circuit to fit the impedance spectra of $TiO_2$-hybrid sol-gel coatings.
Figure 9B:
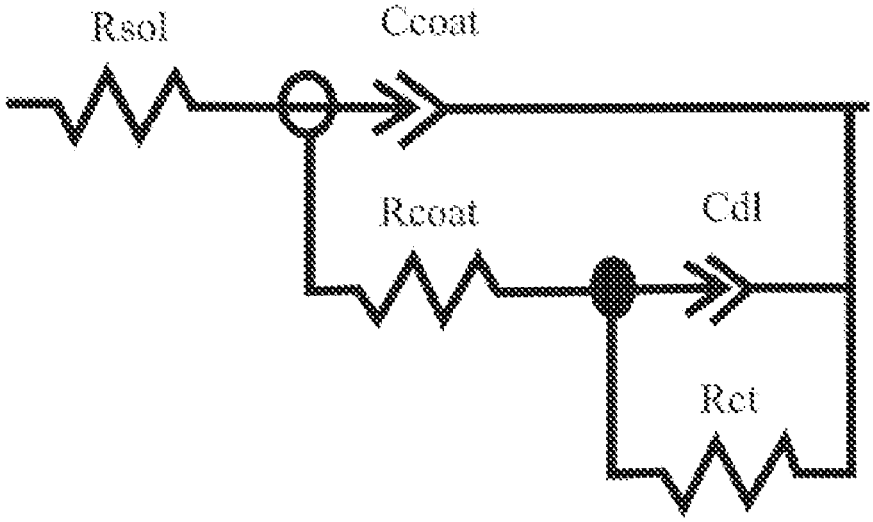

FIG. 9 shows the equivalent circuit to fit the impedance spectra of $TiO_2$-hybrid sol-gel coatings. With respect to FIG. 9, a shows the suitable equivalent circuit proposed for the $TiO_2$ sol-gel coatings at early times of immersion while the coating resistance is high and the coating is intact. In this circuit, $R_{sol}$, $R_{coat}$ and $C_{coat}$ are solution resistance and titanium oxide coating resistance and capacitance, respectively. As time passes and water diffuses into the coating, polarization resistance decreases and capacitance of the double layer increases and so the equivalent circuit of the coating may convert to the circuit shown in (b) in FIG. 9. The table –2 shows the Impedance parameters for $TiO_2$ sol-gel coatings on steel CK45 before and after doping with different concentrations of benzotriazole.

TABLE 2

Impedance parameters for $TiO_2$ sol-gel coatings on steel CK45 before and after doping with different concentrations of benzotriazole.

| specimen | $R_p$ ($\Omega \cdot cm^2$) | $R_{coat}$ ($\Omega \cdot cm^2$) | $R_{ct}$ ($\Omega \cdot cm^2$) | $C_{dl}$ (μF) | n |
|---|---|---|---|---|---|
| coat-Nf | 617 | 611 | 6.4 | 6.2 | 0.39 |
| Coat-Nf-10% BTA | 860 | 850 | 9.4 | 5.4 | 0.41 |
| Coat-Nf-15% BTA | 1176 | 1160 | 16.4 | 3.2 | 0.69 |
| Coat-Nf-20% BTA | 1380 | 1345 | 35.7 | 2.5 | 0.77 |
| coat-f | 1178 | 1168 | 10.45 | 2.6 | 0.21 |
| Coat-F-10% BTA | 1802 | 1765 | 37.3 | 1.7 | 0.58 |
| Coat-F-15% BTA | 1957 | 1916 | 41.5 | 1.5 | 0.66 |
| Coat-F-20% BTA | 2012 | 1965 | 46.8 | 1.4 | 0.84 |

According to the impedance parameters listed in Table 2, it can be seen that polarization and charge transfer resistances increased with increasing of the inhibitor solution concentration used for doping of BTA in the coatings. This is obeyed for calcinated and non calcinated coatings. This is indicative of elevation in coating corrosion resistance with inhibitor concentration. Moreover, bode-phase plots of doped coatings show that phase angle increases as BTA concentration increases and tends toward 90° which is agreed with increasing of n that is defined as roughness factor as below:

$$n = \frac{A}{A_0} \quad \text{Eq. (3)}$$

Where A and $A_0$ are the apparent and real surface areas, respectively. The closer the value of n to 1, the lower is the corrosion current.

The bode plots also show that the phase angles in either calcinated and non calcinated coatings are very close together, but the time constant for the calcinated coatings occurs at lower frequencies. This may be attributed to a delay in corrosion reactions occurring at metal/solution interface. The notable point concerning the impedance plots is that the calcinated coatings possessing higher polarization resistance and lower double layer capacitance than non calcinated ones, both demonstrates improvement of corrosion resistance with applying calcination heat treatment. The results are in good agreement with results derived from polarization curves. When water diffuses the coating, many paths for transfer of ions generate. So, corrosive ions in the solution diffuse into the coating easily and corrode the sub-layer. As mentioned before, the presence of crystalline nanoparticles of anatase phase in the calcinated coatings may root facilitate the adsorption of the inhibitor in the calcinated coatings. The other reason for increasing of the corrosion resistance of the coating is the presence of nano and micro cracks which lead to higher volume uptake of BTA. This can be seen vividly from SEM pictures corresponding to the same situations as already shown in FIG. 5.

Figure 10A:
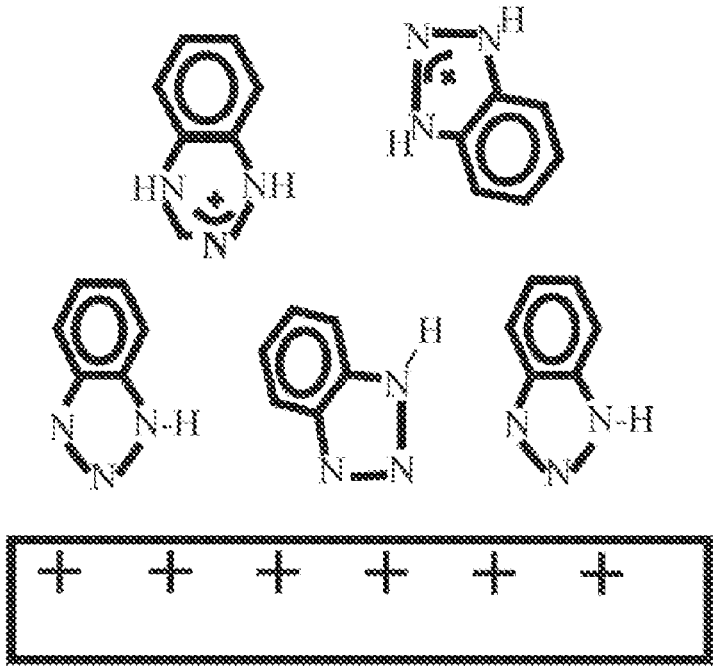
FIG. 10 shows the adsorption configuration of BTAH on an iron electrode with positive charge in the (a) acidic solution, (b) neutral solution.
Figure 10B:
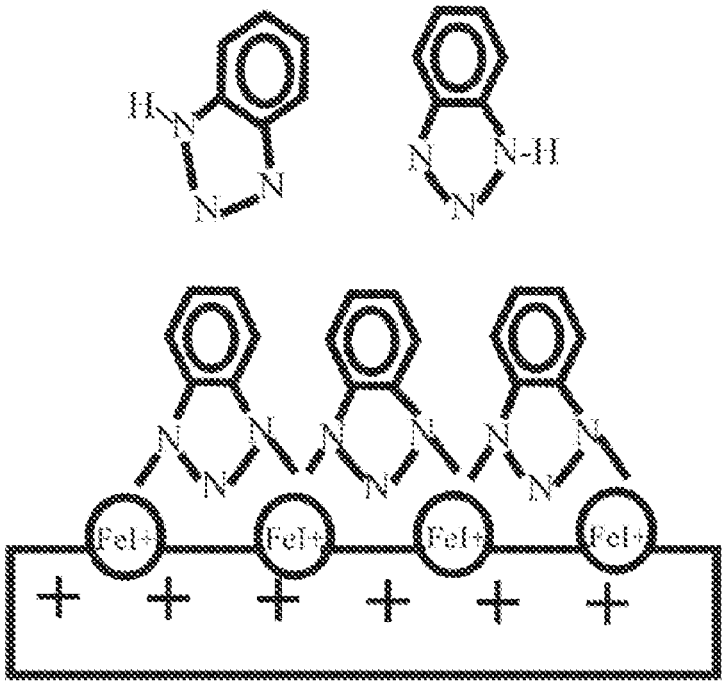
Figure 11A:
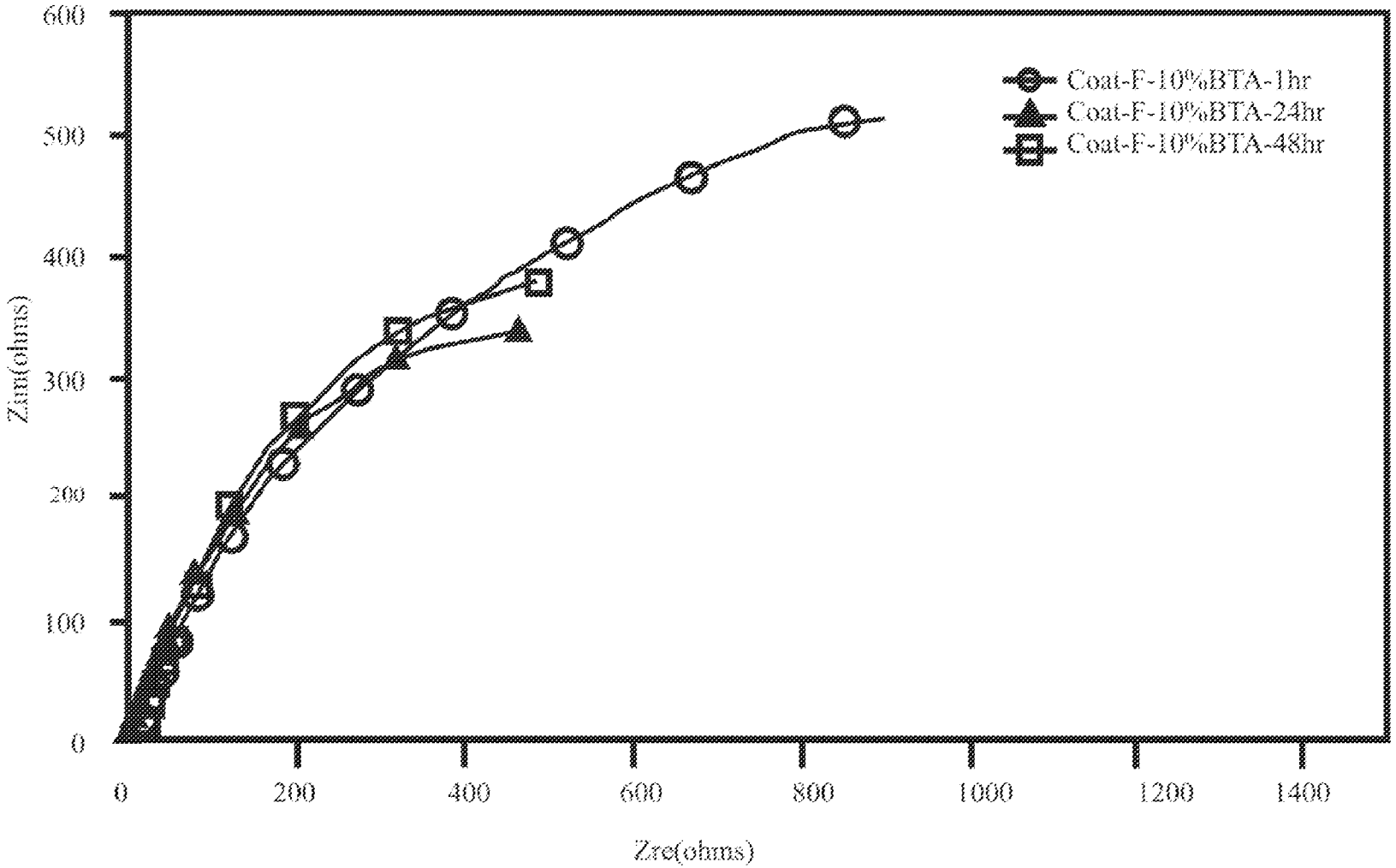
FIG. 11 show Complex plane, Nyquist plots and bode plots of $TiO_2$ sol-gel coatings calcinated on mild steel with and without doping of benzotriazole for different duration of immersion times.
Figure 11B:
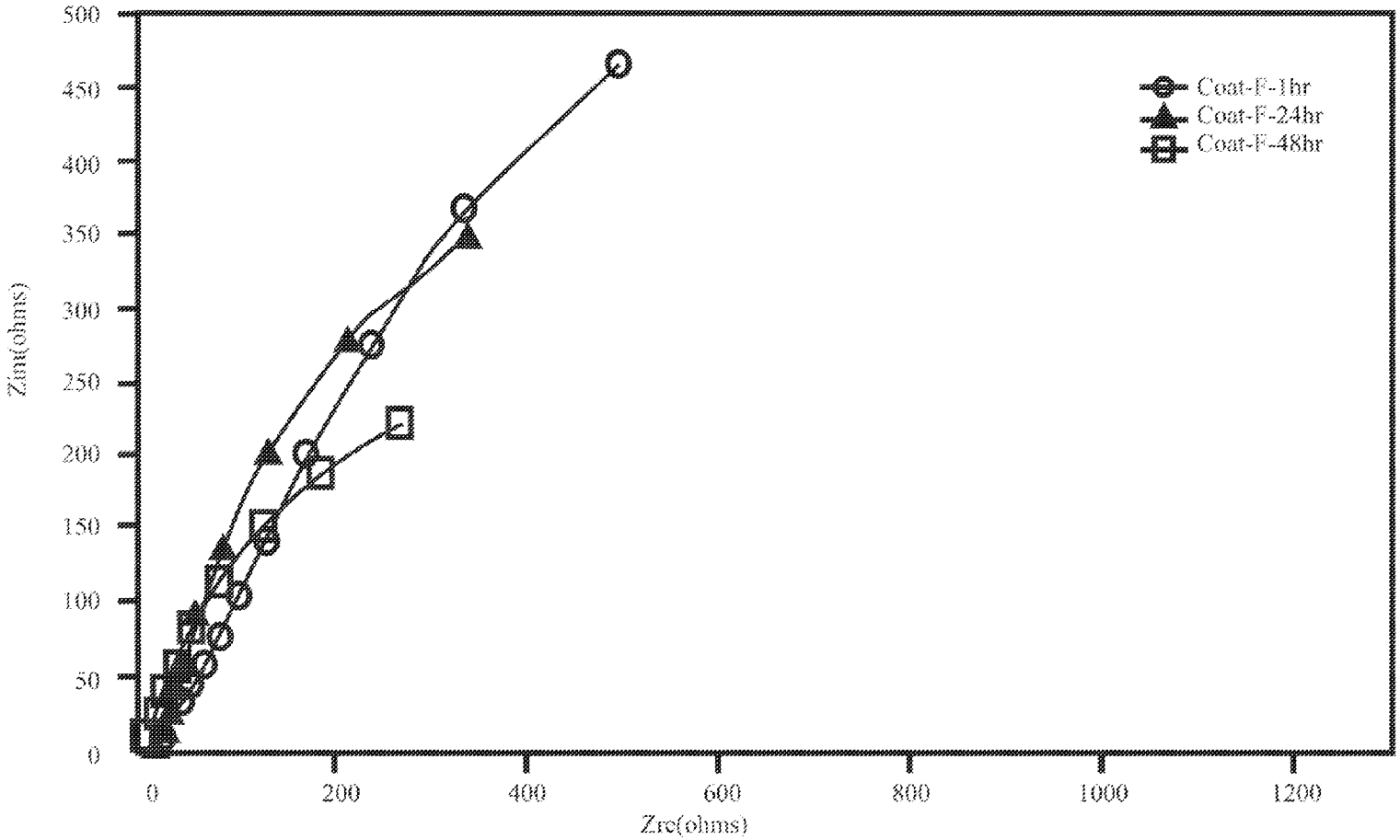
Figure 11C:
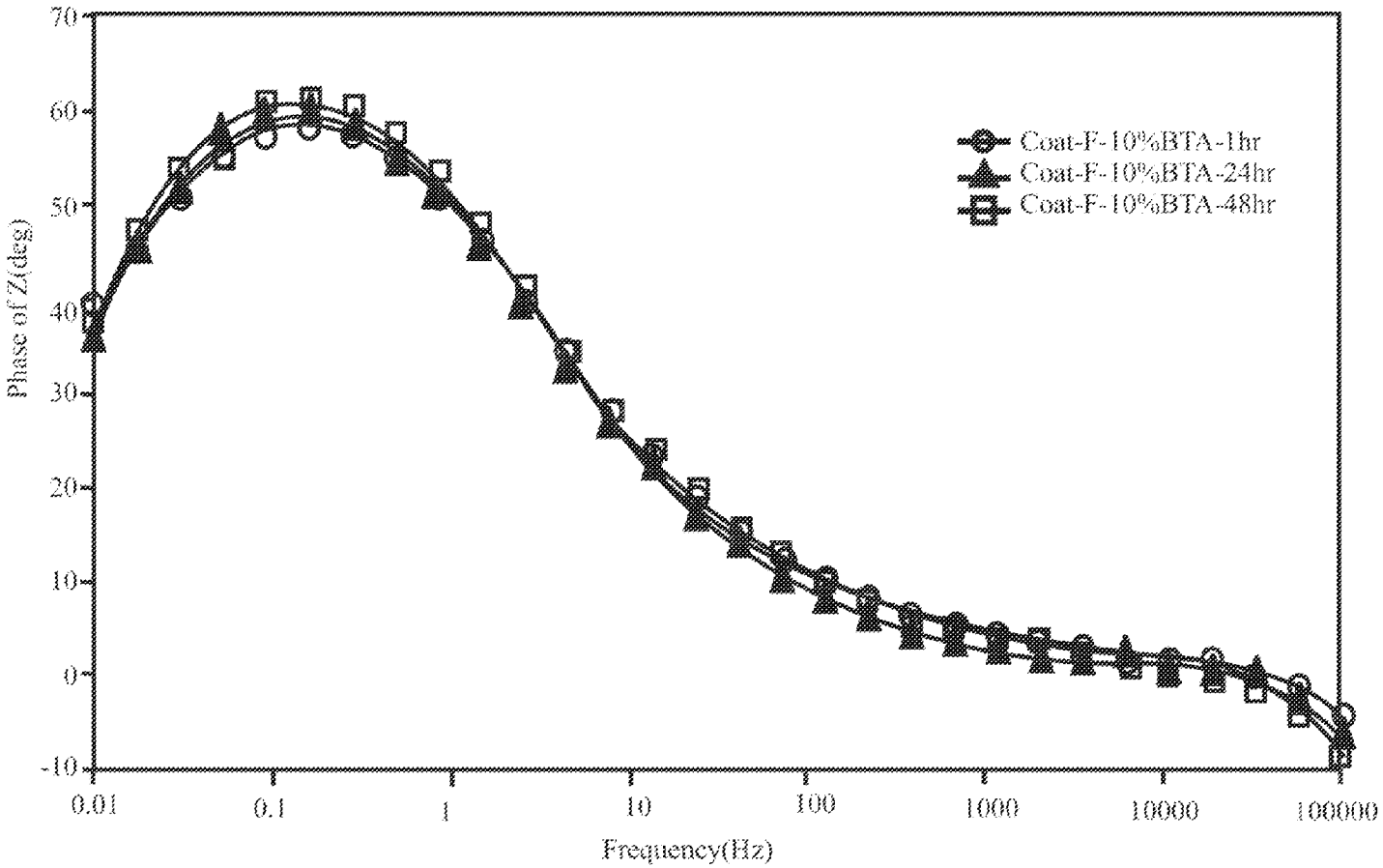
Figure 11D:
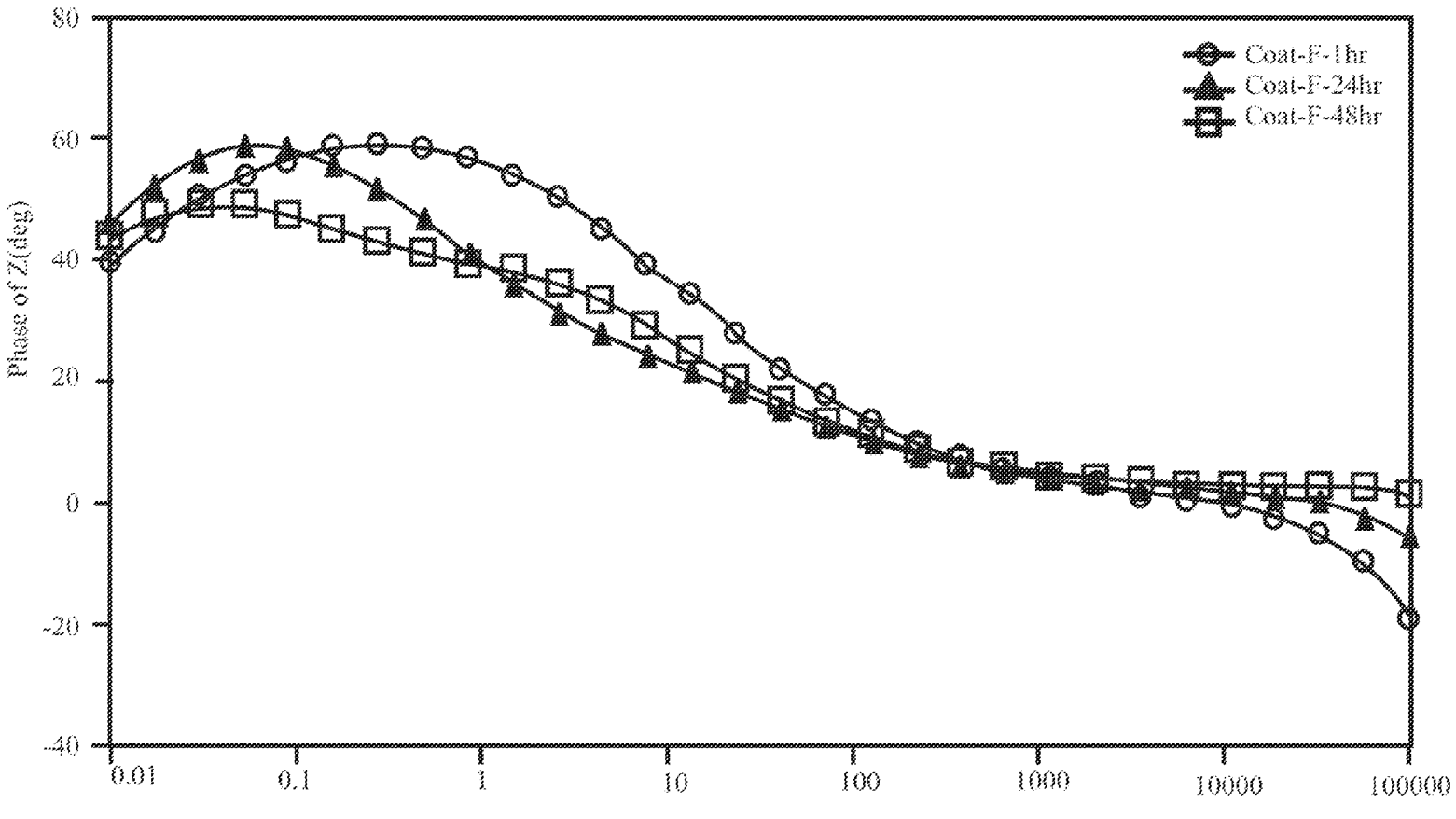
Figure 11E:
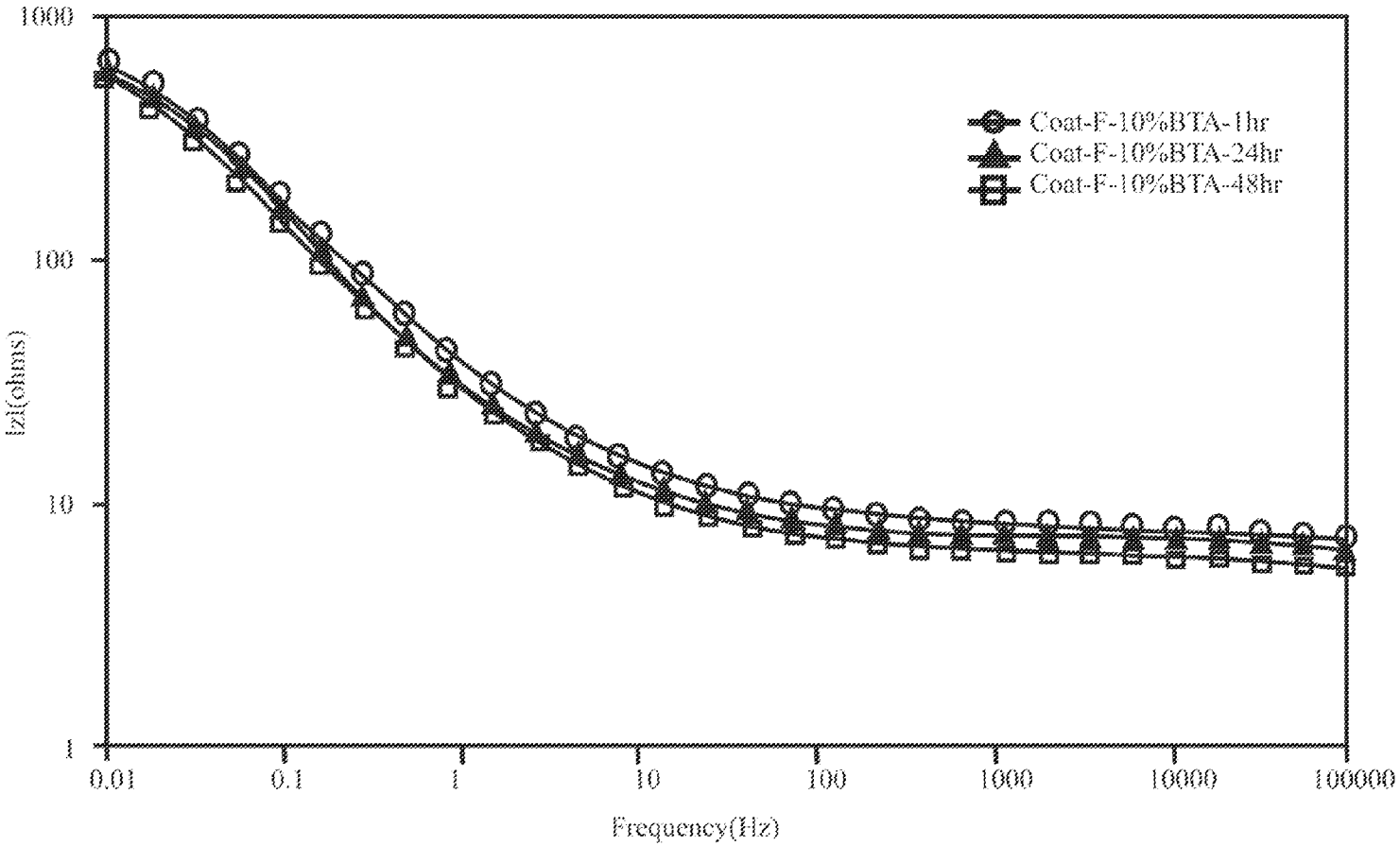
Figure 11F:
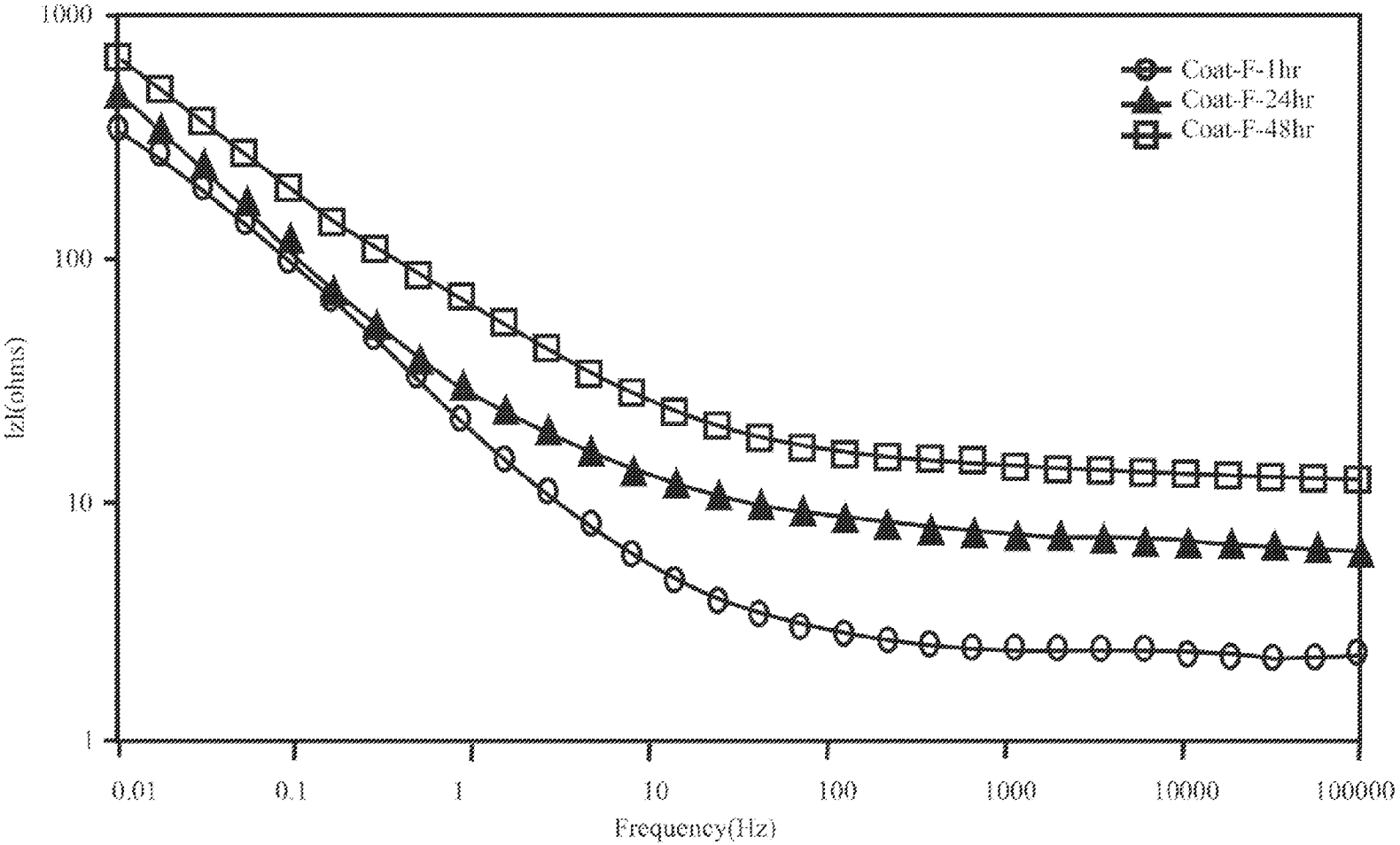

FIG. 10 shows the adsorption configuration of BTAH on an iron electrode with positive charge on the iron electrode. With respect to FIG. 10, a shows the configuration of BTA in the acidic solution and b shows the configuration of BTA in neutral solution. From FIG. 10, it can be configured that in neutral solution BTA molecules are aligned effectively so as to form a layer.

Self-Repairing Effect

The effective anticorrosion properties of chromium compounds are basically related to not only the passive or barrier layer provided by the thickened oxide/hydroxide layer on the metal surface, but also of their self-repairing properties in the case of chemical or mechanical damage. Unfortunately, the strong oxidation properties of chromates make them to consider as a potential carcinogen and environment hostile. The sol-gel coatings exhibit environmental friendly pretreatments for metallic substrates. However, these coatings cannot obtain the effective self-repairing effect when coating is partially destroyed. Therefore, the introduction of an anticorrosion component in the pretreatment can be a possible way to assure active corrosion protection. In this investigation, the benzotriazole was used as anticorrosion component in $TiO_2$ sol-gel coatings.

One way to consider the self-repair properties of the titanium oxide coating is EIS test, where the corrosion inhibitor is presented in coating and is found absent after 1, 24, and 48 hour of immersion. The release of the inhibitor loaded in the coatings is considered by investigating the Complex plane, Nyquist plots and Bode plots of $TiO_2$ sol-gel coatings on mild steel with and without doping of benzotriazole for different duration of immersion times, according to FIG. 11. The complex plane in FIG. 11 and values of parameters of the $TiO_2$ interlayer obtained from fitting of the experimental impedance spectra with equivalent circuits is shown in Table.3.

TABLE 3

Impedance parameters for TiO2 sol-gel coatings on steel CK45 before and after

| Specimen | $R_p$ ($\Omega \cdot cm^2$) | $R_{coat}$ ($\Omega \cdot cm^2$) | $R_{ct}$ ($\Omega \cdot cm^2$) | $C_{dl(\mu F)}$ | n |
|---|---|---|---|---|---|
| coat-f-1 hr | 1178.45 | 1168 | 10.45 | 2.6 | 0.21 |
| Coat-f-24 hr | 1052.64 | 1044 | 8.64 | 4.2 | 0.16 |
| Coat-f-48 hr | 874.49 | 870 | 4.49 | 6.5 | 0.09 |
| Coat-f 10% BTA-1 hr | 1802.31 | 1765 | 37.31 | 1.7 | 0.58 |
| coat-f-10% BTA-24 hr | 1472.64 | 1457 | 15.64 | 3.4 | 0.39 |
| Coat-f-10% BTA-48 hr | 1593.29 | 1577 | 16.29 | 2.7 | 0.45 |

Table 3 shows that the polarization resistance and roughness factor, of the calcinated $TiO_2$ nanoparticle coatings doped with benzotriazole after 48 hour of immersion is higher than 24 hour of immersion, whereas the capacitance of the $TiO_2$ interlayer is lower.

The increase of the impedance, roughness factor and decrease in capacitance can be explained in terms of self-healing originated from the inhibiting effect of the benzotriazole released from the $TiO_2$ nanoparticles. This contrasts with the results obtained when the mild steel is coated with undoped $TiO_2$ nanoparticle calcinated coatings, for which a continuous decrease of the impedance could be observed.

The comparison of these parameters for the samples with different duration time of the immersion test shows that the $TiO_2$ nanoparticle coatings doped with benzotriazole confers the best corrosion protective properties from the point of view of long term protection against corrosion as intermediate layer in coating system.

Figure 12:
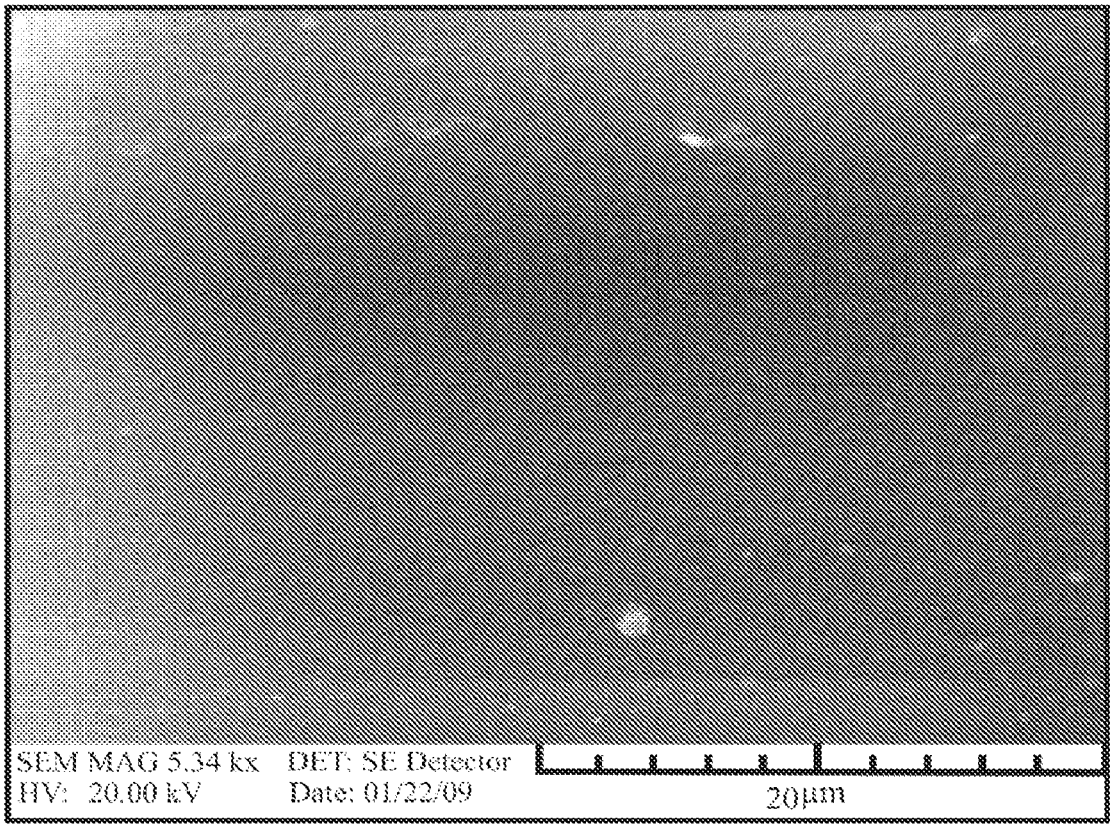
FIG. 12 show SEM micrographs of the deposited hybrid silicate films on TiO2 nanoparticles layer after drying at 120° C.

Characterization and Measurements of $TiO_2$ Nanoparticles Layer-Hybrid Silane Films Morphology FIG. 12 shows SEM micrographs of the deposited hybrid silicate films on $TiO_2$ nanoparticle layer after drying at 120° C. these images shows a homogeneous glass-like and dense structure with a crack free surface at 5000× magnification, while many cracks were seen on the surface of $TiO_2$ layer at 1000× magnification as shown in FIG. 5.

Figure 13A:
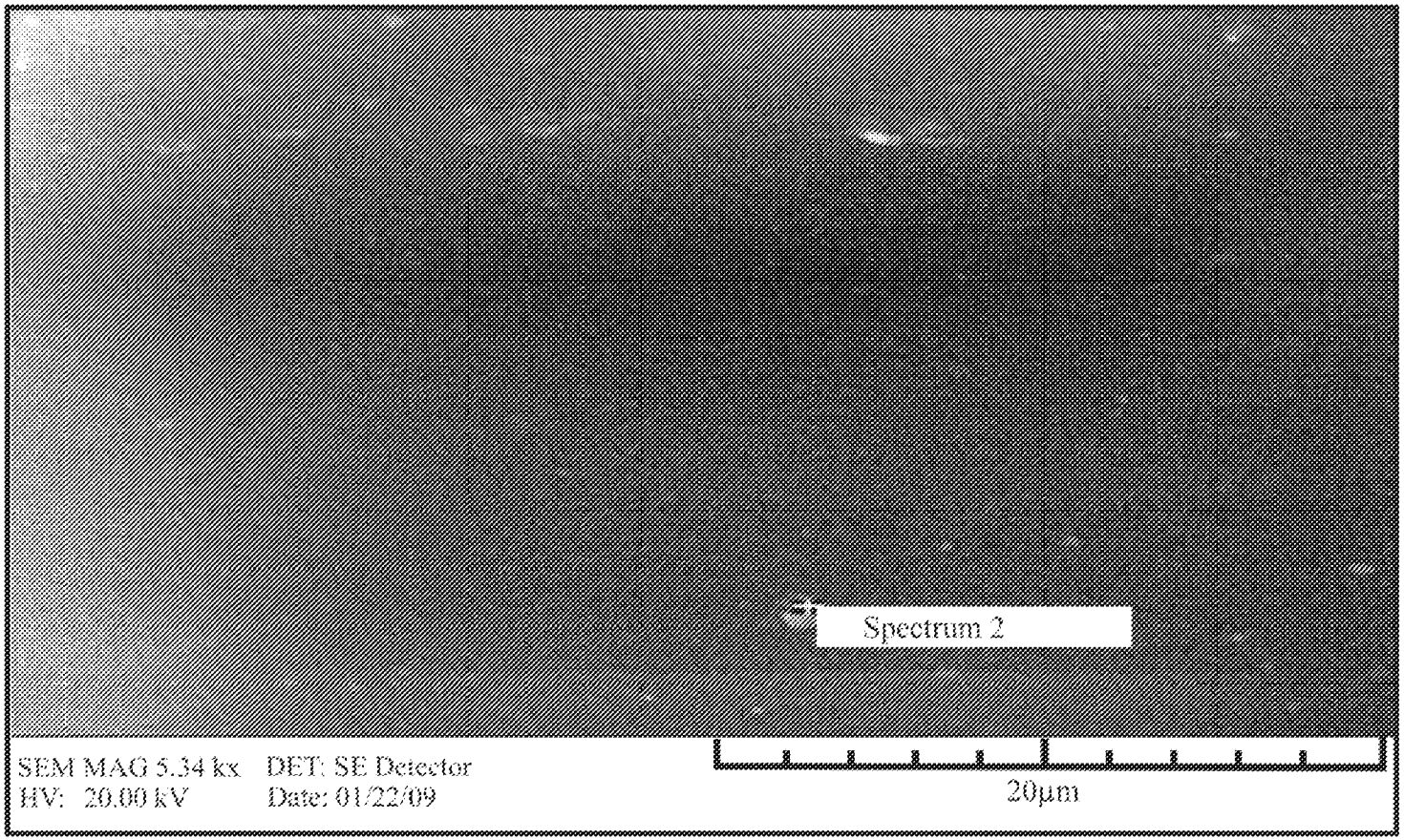
FIG. 13 shows Fragment of EDS spectra of hybrid silicate surface that showing the presence of silicon and oxygen.
Figure 13B:
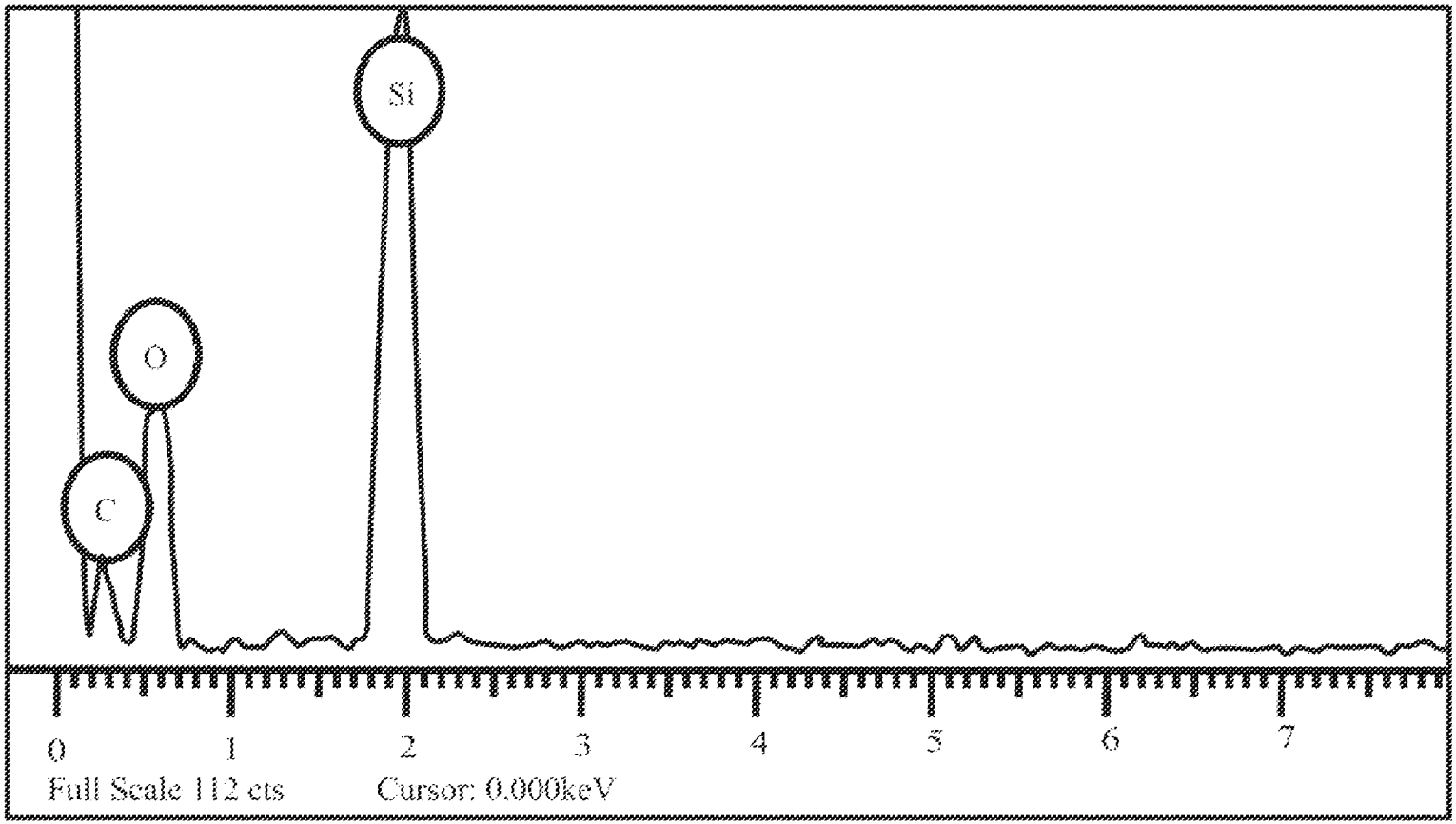

FIG. 13 shows Fragment of EDS spectra of hybrid silicate surface that showing the presence of silicon and oxygen.

Figure 14:
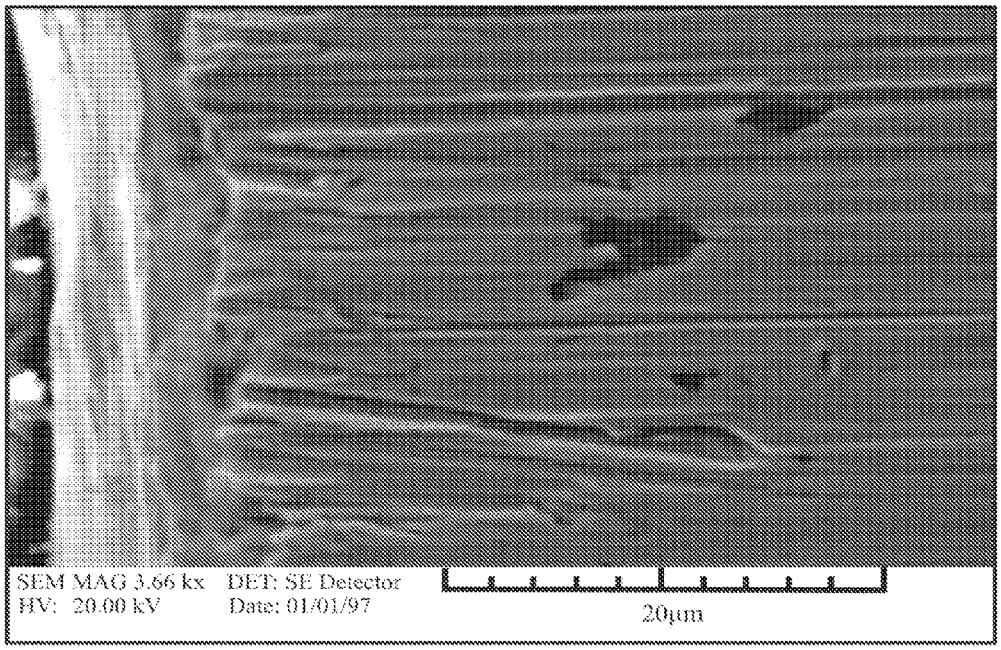
FIG. 14 shows SEM image cross-section of a dual layer sol-gel coating.
Figure 15A:
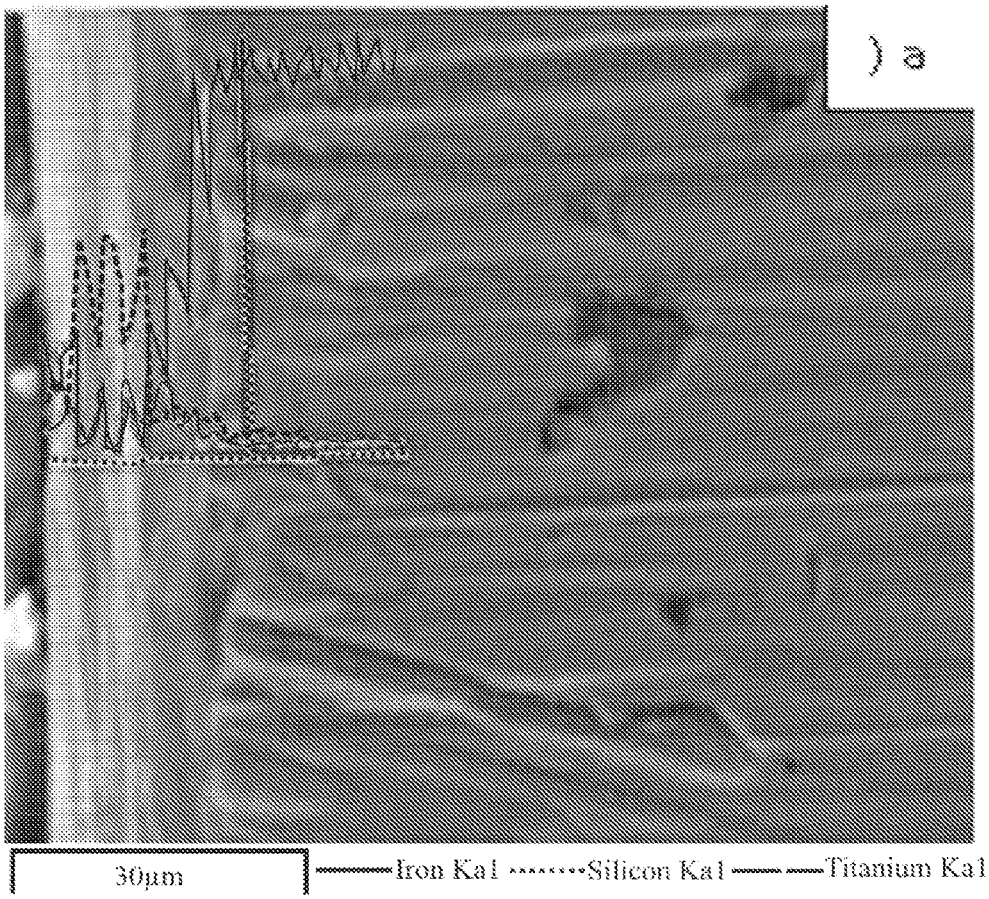
FIG. 15 shows Elemental linear analysis of the cross-section of the dual layer coating.
Figure 15B:
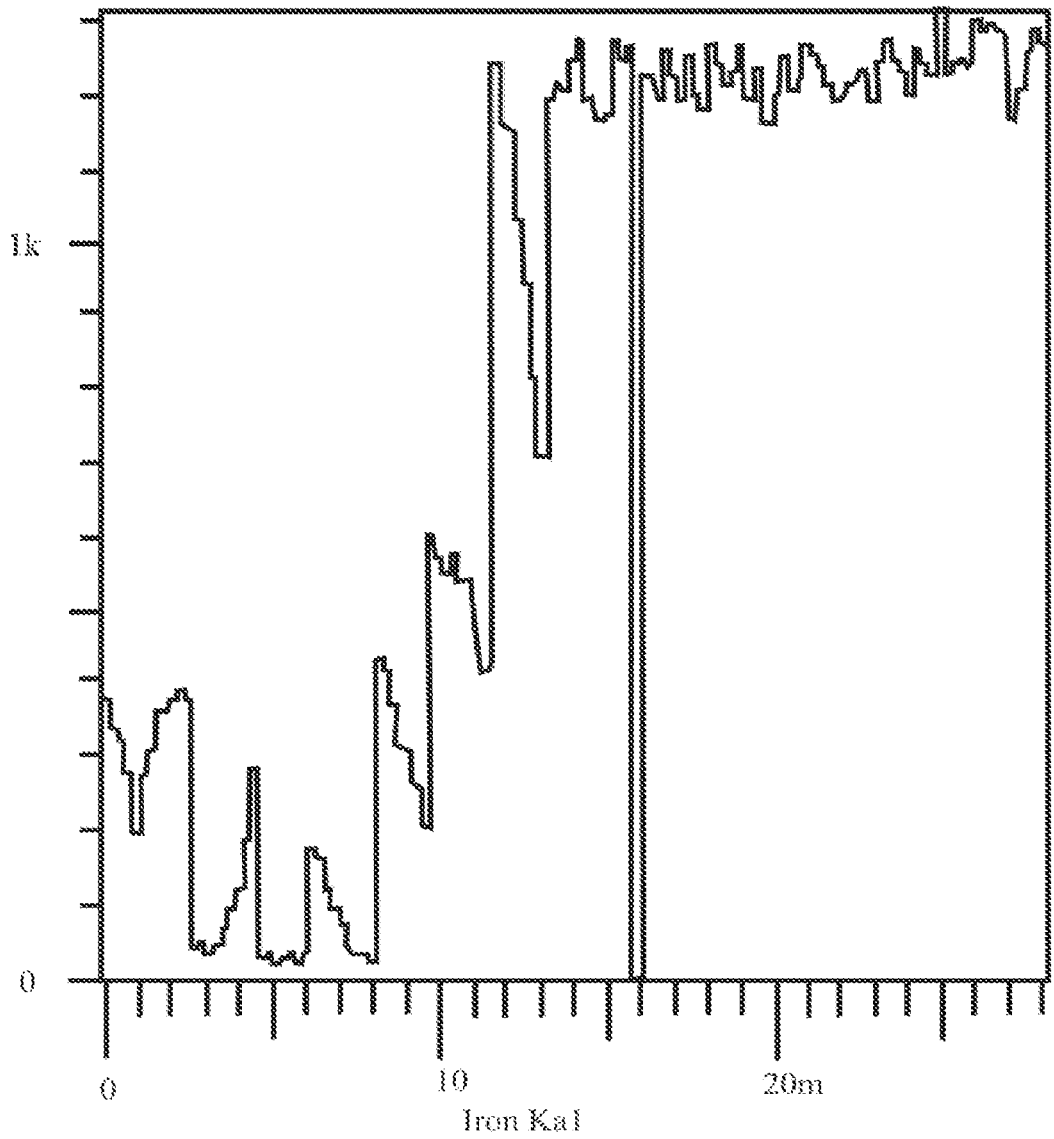
Figure 15C:
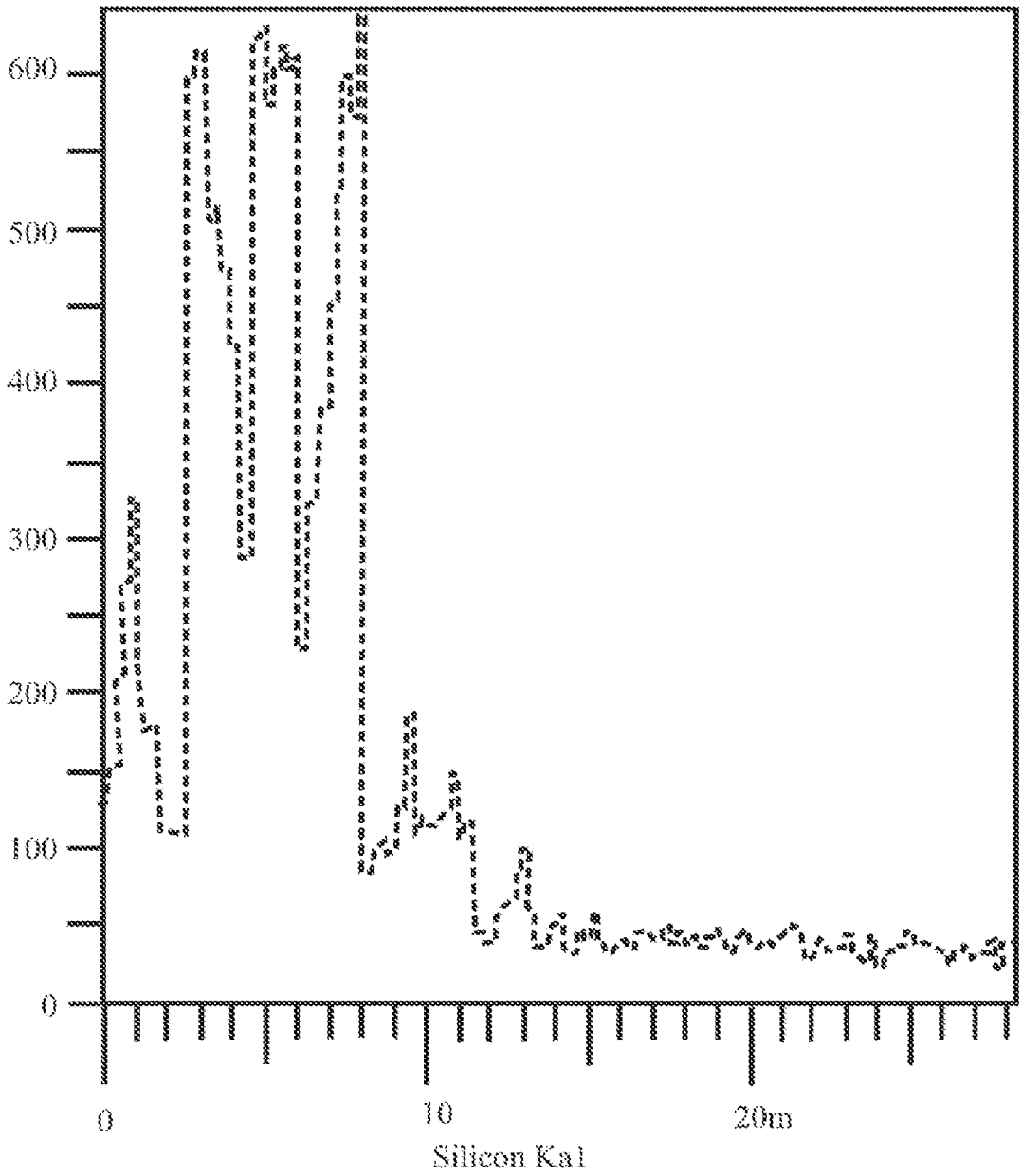
Figure 15D:
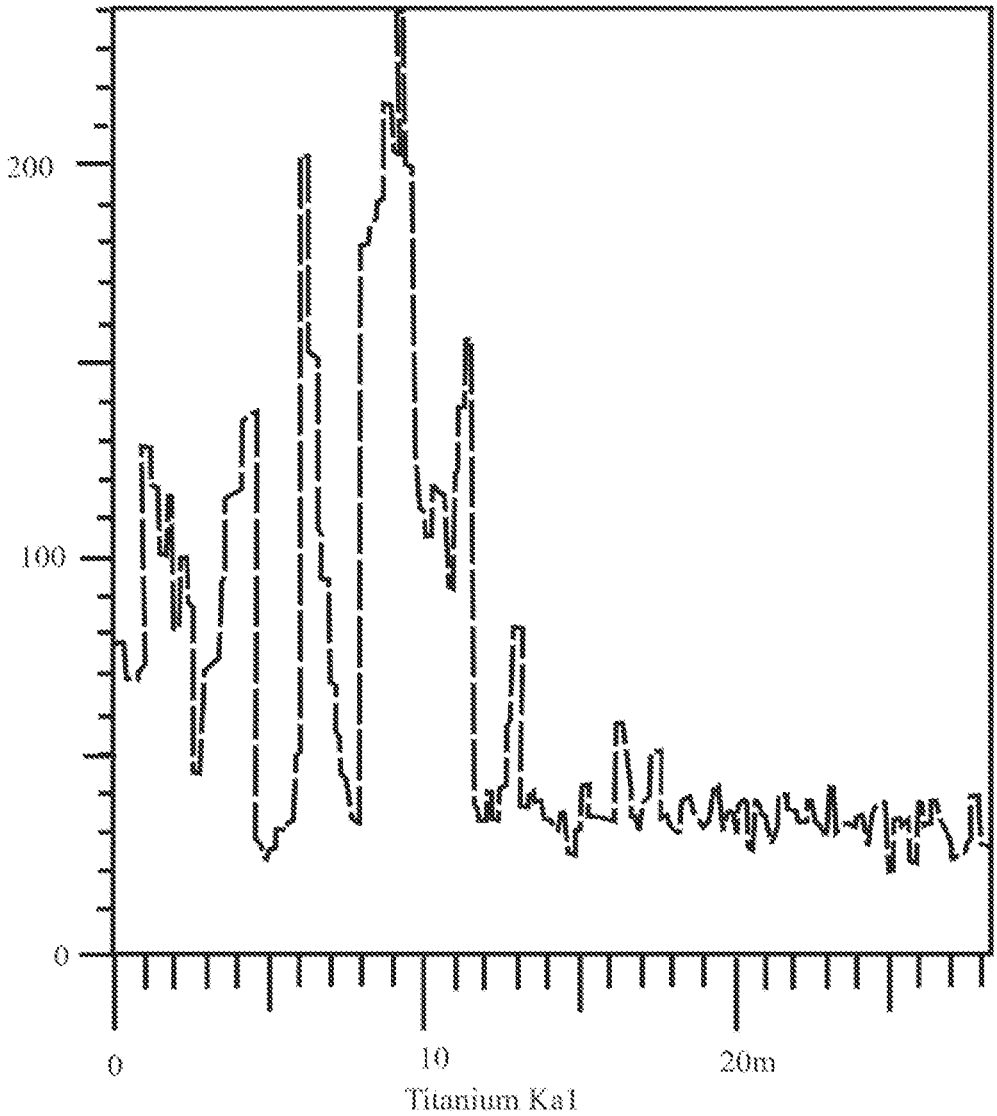

FIG. 14 shows a cross-section of a dual layer coating. It can be seen that synthesized sol-gel coatings are uniform and crack-free. The thickness of the sol-gel coating is estimated by the cross-section analysis that is about 4-5 μm.

FIG. 15 shows the Elemental linear analysis of the cross-section of the dual layer coating, which confirms the presence of Si, Ti, and Fe elements in this coating, from top layer toward mild steel substrate. This confirms the presence of silica and titanium in the outer and inner part of the layer, respectively.

Electrochemical Tests

DC Polarization

DC polarization tests are carried out on metallic substrates coated in various conditions in 3.5% NaCl solution. The coated samples are immersed in the electrolyte for four hours before acquisition of the data, in order to achieve a steady state open circuit potential. On the average, three samples are tested for each condition.

Figure 16:
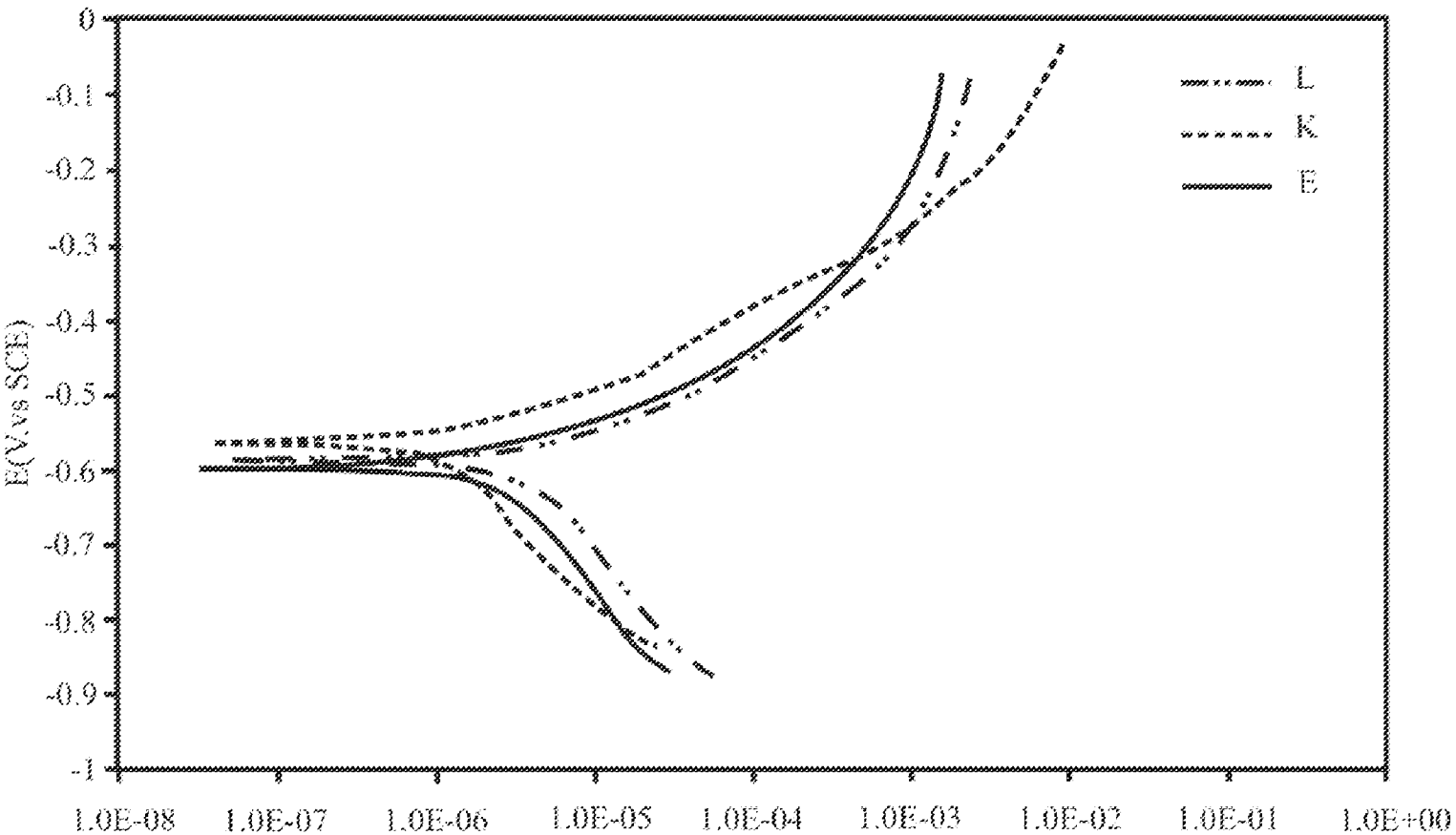
FIG. 16 shows DC polarization curves for mild steel coated with hybrid nanostructure non calcinated with and without benzotriazole inhibitor, (L) undoped $TiO_2$ layer; (K) doped $TiO_2$; (E) loaded benzotriazole in titanium sol.

FIG. 16 shows DC polarization curves for mild steel coated with hybrid nanostructure non calcinated with and without benzotriazole inhibitor, (L) undoped $TiO_2$ layer; (K) doped $TiO_2$; (E) loaded benzotriazole in titanium sol.

Figure 17:
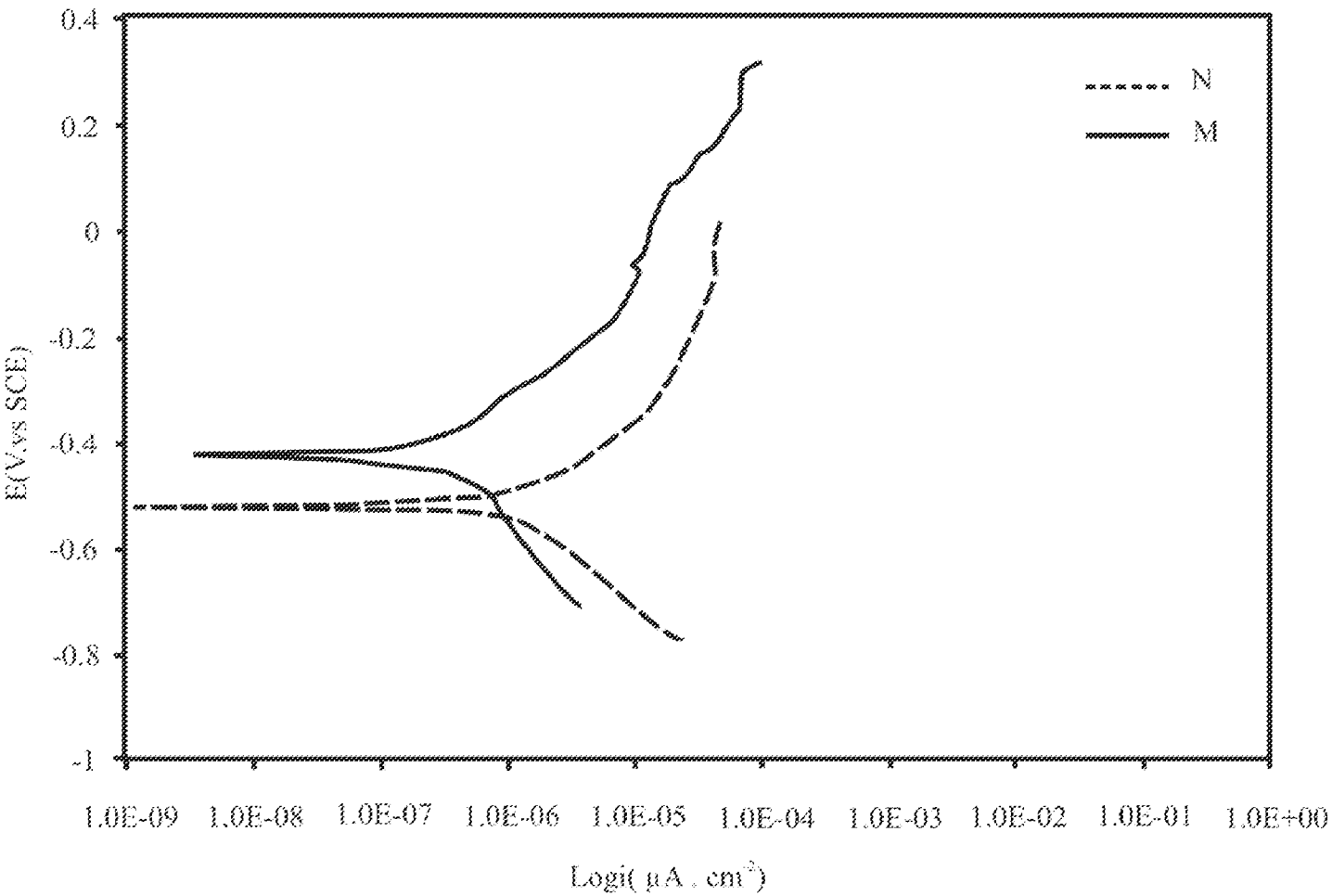
FIG. 17 shows DC polarization curves for mild steel coated with hybrid nanostructure calcinated with (M) and without (N) benzotriazole.

FIG. 17 shows DC polarization curves for mild steel coated with hybrid nanostructure calcinated with (M) and without (N) benzotriazole. Here, M is with benzotriazole and N is without benzotriazole in 3.5% NaCl solution. Potentiodynamic polarization parameters values of hybrid nanostructure coatings calcinated and non calcinated before and after doping with benzotriazole are listed in Table 4.

TABLE 4

Potentiodynamic polarization parameters values of hybrid nanostructure coatings calcinated and non calcinated before and after doping with benzotriazole

| specimen | $E_{corr}$ (mv) | $I_{corr}$ (μA) | $\beta_a$ (mv/decade) | $\beta_c$ (mv/decade) |
|---|---|---|---|---|
| K | −572 | 1.228 | 90.428 | 229.49 |
| L | −606 | 3.809 | 103.857 | 236.257 |
| M | −408 | 0.3174 | 191.629 | 292.94 |
| N | −516 | 1.198 | 187 | 217 |
| E | −593 | 2.091 | 92.45 | 240 |

Adding benzotriazole as organic inhibitor to $TiO_2$ layer shifted the $E_{corr}$ to anodic potentials in both cases, indicating that benzotriazole act as an anodic inhibitor by suppressing the anodic reaction. Polarization curves indicate that anodic current density is reduced in the presence of the inhibitor in comparison with the sol-gel coating without inhibitor. The drop in $I_{corr}$ for the organic inhibitor loaded titania interlayer indicates a geometric blocking effect of active reaction sites. Moreover, Table 4 shows that water is not able to penetrate the network of the coating and reach the active metal reaction sites (anode and cathode).

Another reason for the reduction in the current density may be reflected in the barrier effect of the silane film. It is generally believed that the inhibition efficiency of benzotriazole is due to the formation of such a protective Ti-BTA film with $TiO_2$ layer. Titanium alkoxides are Lewis acids and can interact with compound having a lone pair of electron (Lewis bases). The formation of surface complex film through the lone pair electrons on a nitrogen atom in the triazol ring with Ti provides more compact barrier layer leading to a higher inhibition effect.

E.I.S Measurement

Figure 18A:
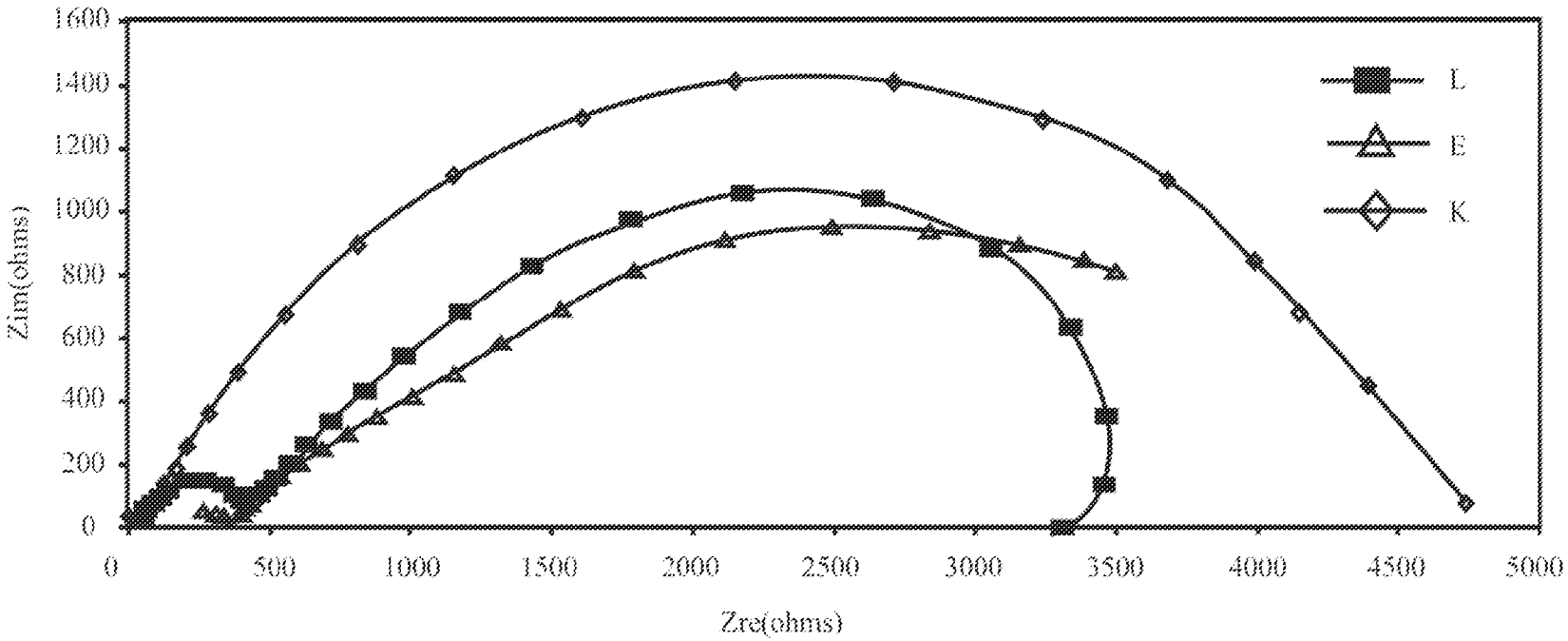
FIG. 18 shows Nyquist and bode plots of mild steel substrates covered with hybrid nanostructure non calcinated with and without benzotriazole inhibitor, (L) undoped $TiO_2$ layer, (K) doped $TiO_2$, (E) loaded benzotriazole in titanium sol.
Figure 18B:
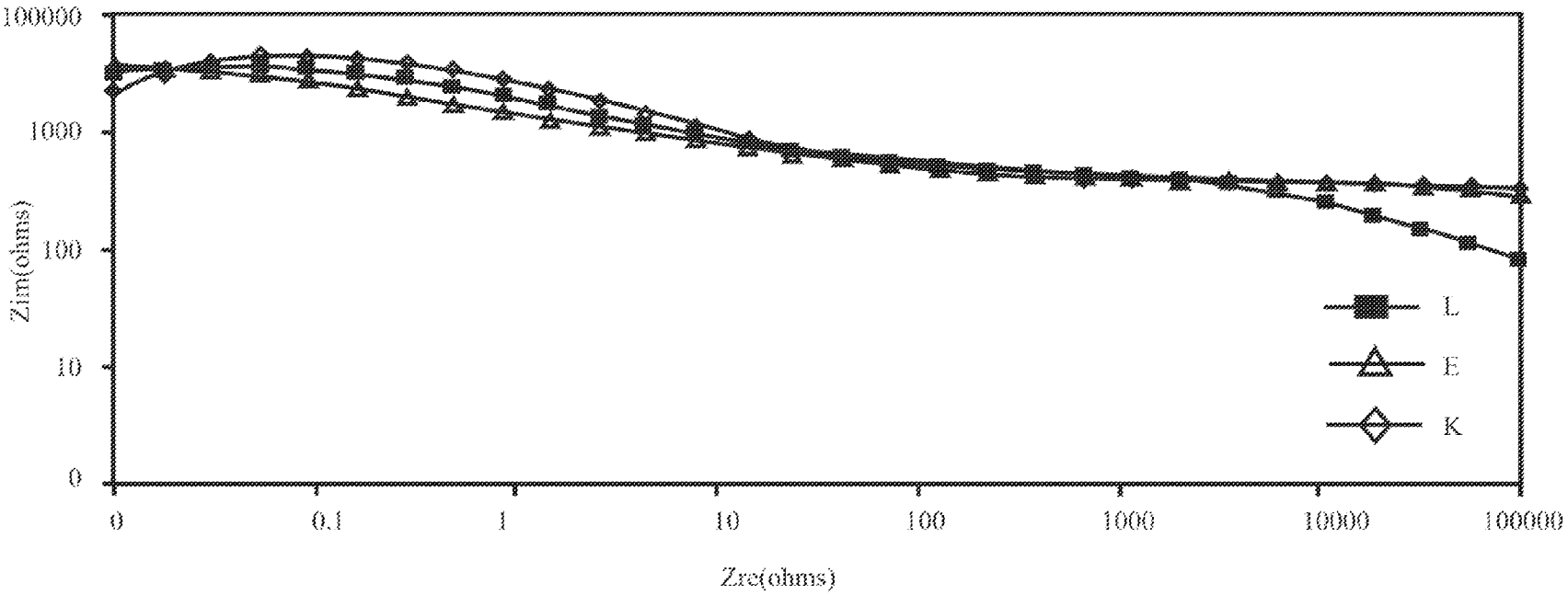
Figure 18C:
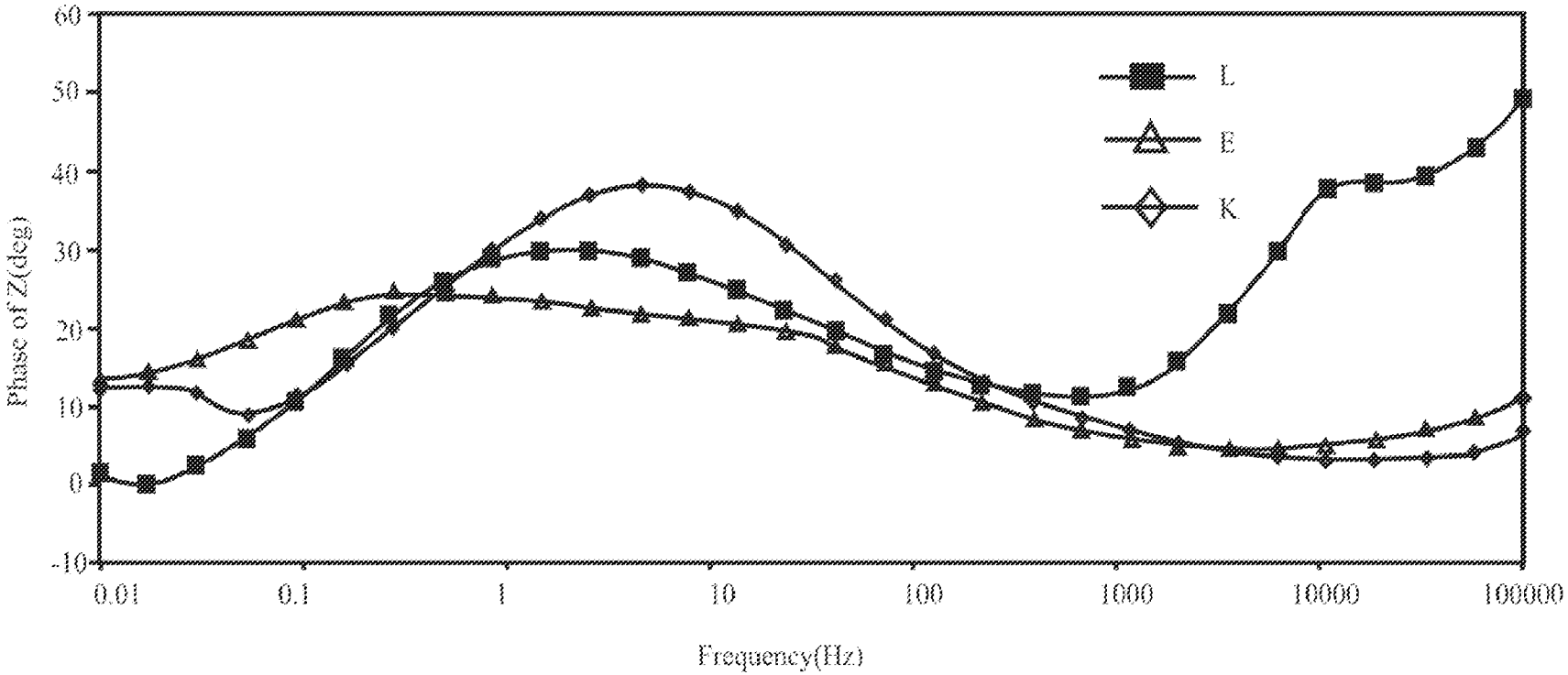

FIG. 18 shows Nyquist and bode plots of mild steel substrates covered with hybrid nanostructure non calcinated with and without benzotriazole inhibitor, (L) undoped $TiO_2$ layer, (K) doped $TiO_2$, (E) loaded benzotriazole in titanium sol.

Figure 19A:
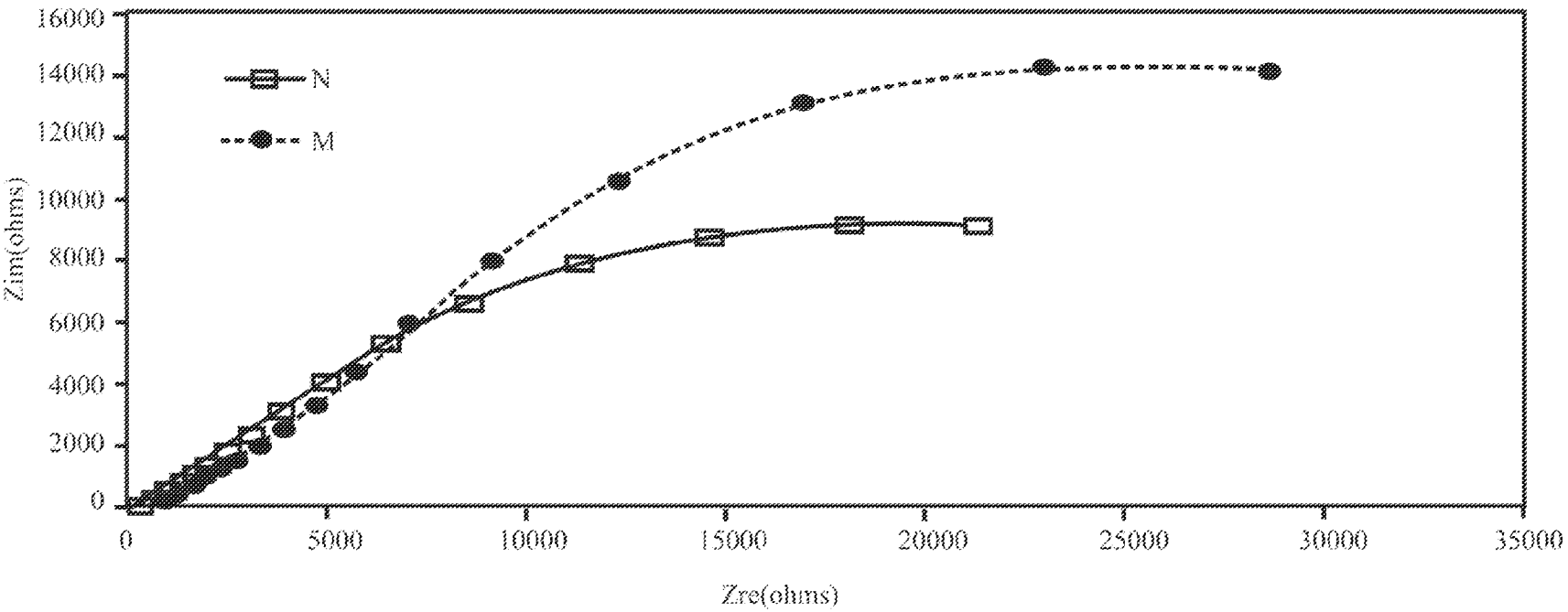
FIG. 19 shows Nyquist and bode plots of mild steel substrates covered with hybrid nanostructure calcinated with (M) and without (N) benzotriazole.
Figure 19B:
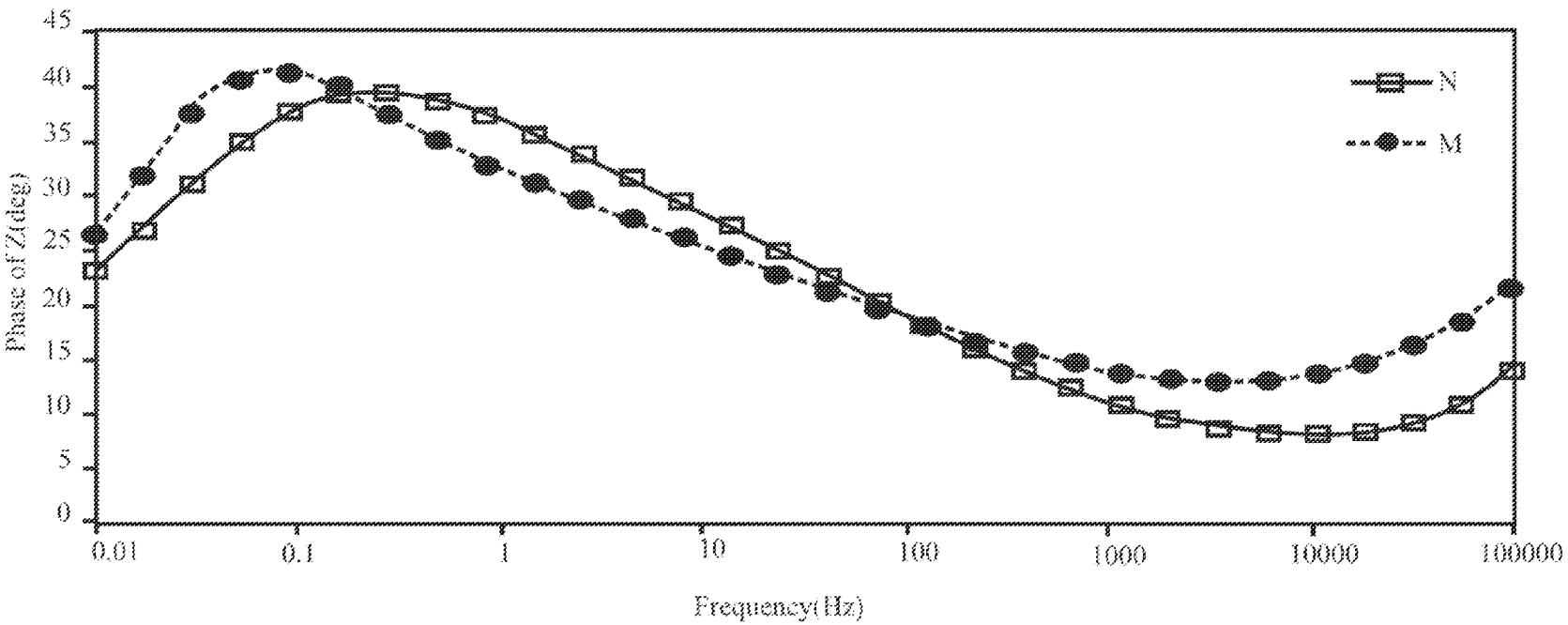
Figure 19C:
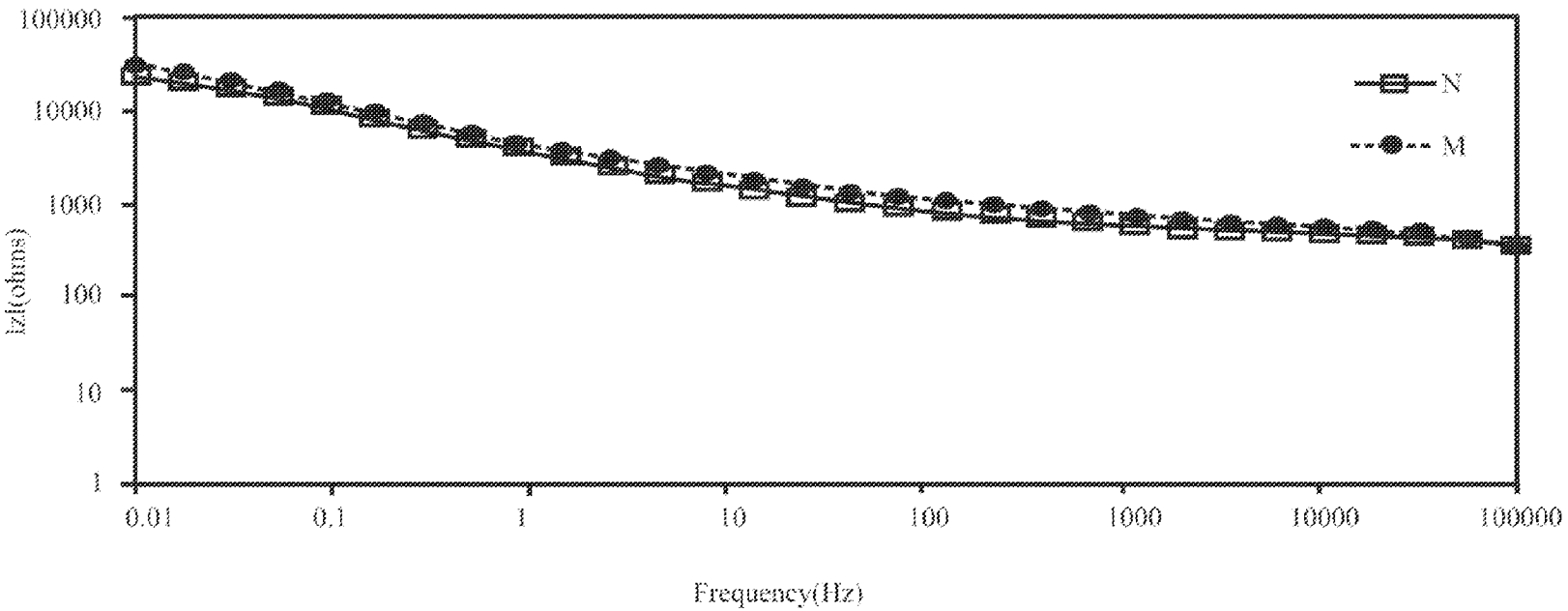

FIG. 19 shows Nyquist and bode plots of mild steel substrates covered with hybrid nanostructure calcinated with (M) and without (N) benzotriazole.

Figure 20B:
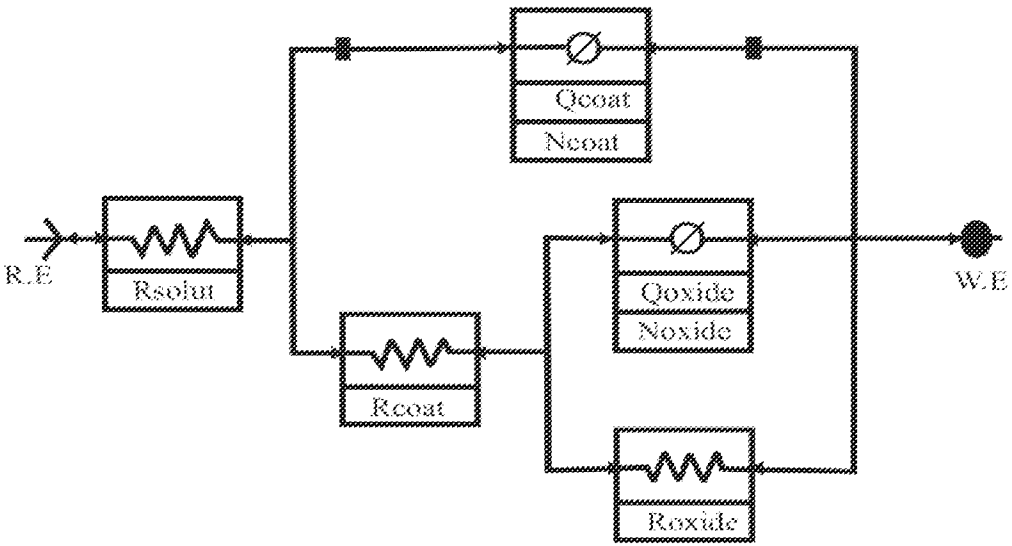
FIG. 20 shows the equivalent circuit to fit the impedance spectra of hybrid sol-gel coatings.
Figure 20A:
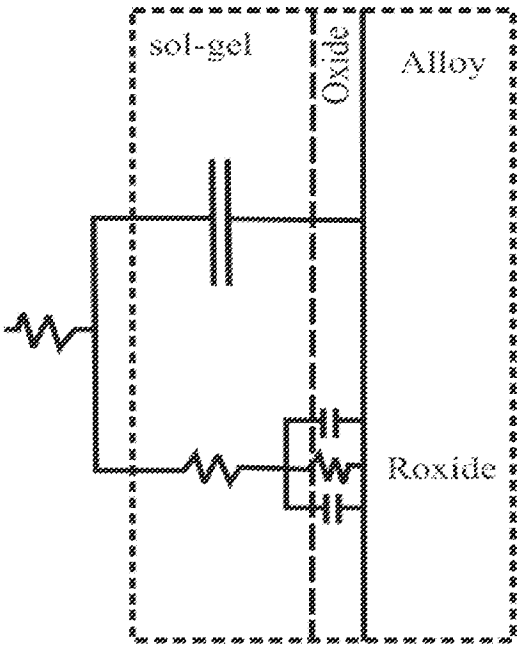

FIG. 20 shows the equivalent circuit to fit the impedance spectra of hybrid sol-gel coatings. Impedance spectra were modeled using the circuit shown in FIG. 20. $R_s$ is the resistance of the solution, $R_c$ and $C_c$ (which consist of $Q_c$ and $n_c$ in the electrical circuit) are the resistance and capacitance of the sol-gel film. The resistance and capacitance of the dielectric sol-gel film depend on the porosity and cracks of the film and the amount of the adsorbed water. The values of the EIS parameters for different system coatings are listed in Table 5.

TABLE 5

Parameters of the hybrid nanostructure coatings calcinated and non calcinated before and after doping with benzotriazole obtained from fitting of experimental impedance spectra with equivalent circuit.

| specimen | $R_s$ ($\Omega \cdot cm^2$) | $R_p$ ($\Omega \cdot cm^2$) | $R_c$ ($\Omega \cdot cm^2$) | $(Q, Y_0)_{c\,(F)}$ | $n_c$ | $R_{ct}$ ($\Omega \cdot cm^2$) | $(Q, Y_0)_{dl(F)}$ | $n_{dl}$ |
|---|---|---|---|---|---|---|---|---|
| K | 287.9 | 5717.5 | 4967 | $1.34 \times 10^{-5}$ | 0.65 | 750.5 | $3.93 \times 10^{-8}$ | 0.83 |
| L | 62.99 | 3601.4 | 3237 | $8.16 \times 10^{-5}$ | 0.53 | 364.4 | $12.4 \times 10^{-7}$ | 0.71 |
| M | 368.5 | 55311 | 54740 | $8.85 \times 10^{-6}$ | 0.93 | 571 | $2.126 \times 10^{-8}$ | 0.97 |
| N | 176.4 | 46167.8 | 45740 | $10.38 \times 10^{-6}$ | 0.8 | 427.8 | $2.96 \times 10^{-8}$ | 0.94 |
| E | 233.4 | 4842.1 | 4739 | $11.7 \times 10^{-5}$ | 0.74 | 103.1 | $3.31 \times 10^{-7}$ | 0.43 |

The results are in good agreement with the data of DC polarization for different coating systems. Polarization resistance is a parameter which can be easily used to compare corrosion performance of a system. Higher polarization resistance demonstrates better protection. The alloy sample coated with $TiO_2$ nanoparticles layer that are calcinated at 400° C. and doped with benzotriazole and then hybrid silicate layer deposited on the $TiO_2$ surface (sample M) shows the highest corrosion resistance with the polarization resistance value of about 55311 $\Omega \cdot cm^2$. Polarization resistance of the hybrid sol-gel film that calcinated but the $TiO_2$ layer undoped with benzotriazole take lower value in comparison with the sample M. Sample L, where $TiO_2$ layer dried at 120° C. and undoped with benzotriazole and the hybrid silicate layer employed on its surface in comparison with sample K, in which hybrid silicate films was deposited on doped $TiO_2$ layer non calcinated showed the lowest polarization resistance. In the sample L, however corrosion resistance is lowest among of these cases, but the polarization resistance was better in comparison with sample where only $TiO_2$ layer with and without doped benzotriazole deposited on the alloy surface that is described elsewhere. The reason for this may be attributed to the density and cross linked structure of the hybrid silicate layer on the surface of $TiO_2$ film. In general the excellent corrosion inhibition of these silanes is due to the strong covalent metallo-siloxane bonds. In the case of sample E, the low corrosion resistance can be explained by the interfering effect of the inhibitor with cross-linking process during sol-gel synthesis.

Constant phase element (CPE) substituted capacitances reflecting deviational behavior of capacitance from ideality. The capacitance values for coating systems and double layer elements can be calculated using the Eq. 4 and Eq. 5:

$$C=Q(W_{max})^{n-1} \quad (4)$$

The impedance of the CPE depends on frequency according to the following equation:

$$1/Z=Q(JW)^n \quad (5)$$

Where $W_{max}$ is the frequency at which the imaginary impedance reaches a maximum for the respective time constant. When the resistance of the sol-gel coatings is the highest, the capacitance of sol-gel film has the lowest numerical values. With regard to the EIS results of various samples, it can be concluded that the coating possessing titania interlayer that calcinated and loaded with benzotriazole containing hybrid silicate film (sample M) confers the highest polarization resistance of the sol-gel coating and the lowest capacitance of coating and double layer. Therefore, samples coated according to the state M showed the highest corrosion resistance.

This may be attributed to the cracked surface of the coated prepared in this state that strengthens the adsorption of the inhibitor. This strengthening can be interpreted by the calcination of $TiO_2$ interlayer as well as applying hybrid silicate film which modifies the structure of the coating. In fact, $TiO_2$ nanoparticles containing film acts as a reservoir for inhibitor and release it to protect the other areas. The hybrid silicate films form strong metallo-organic bonds along with the hydrophobic Si—O—Si bonds, which help to build up the silane film and therefore provide an extraordinary physical barrier to diffuse to the metal surface.

Effect of 216 Hr Immersion

Figure 21A:
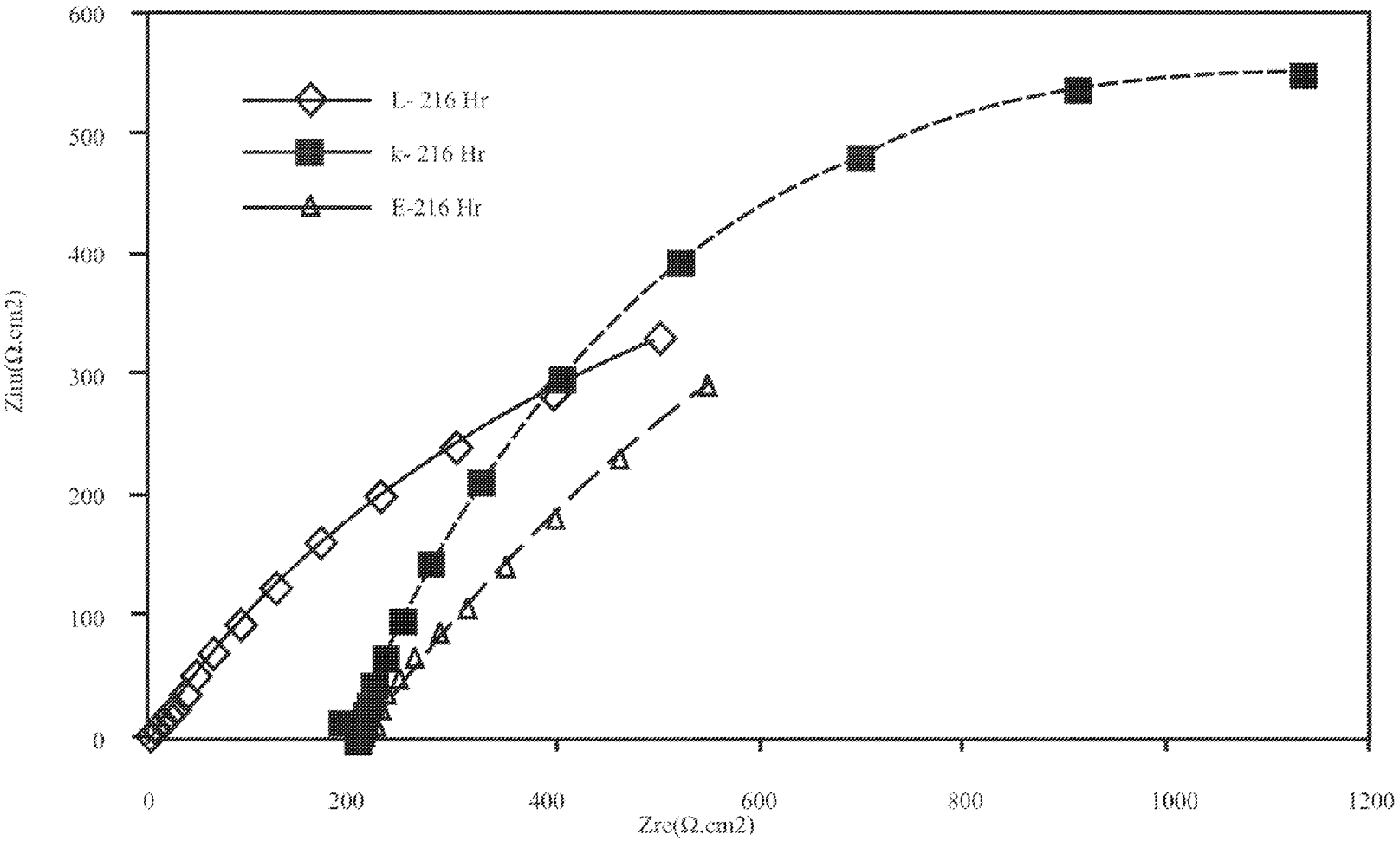
FIG. 21 shows Complex plane, Nyquist plots and Bode plots for non calcinated coatings K, L and E on mild steel with and without doping of benzotriazole after 216 hr of immersion in chloride solution.
Figure 21B:
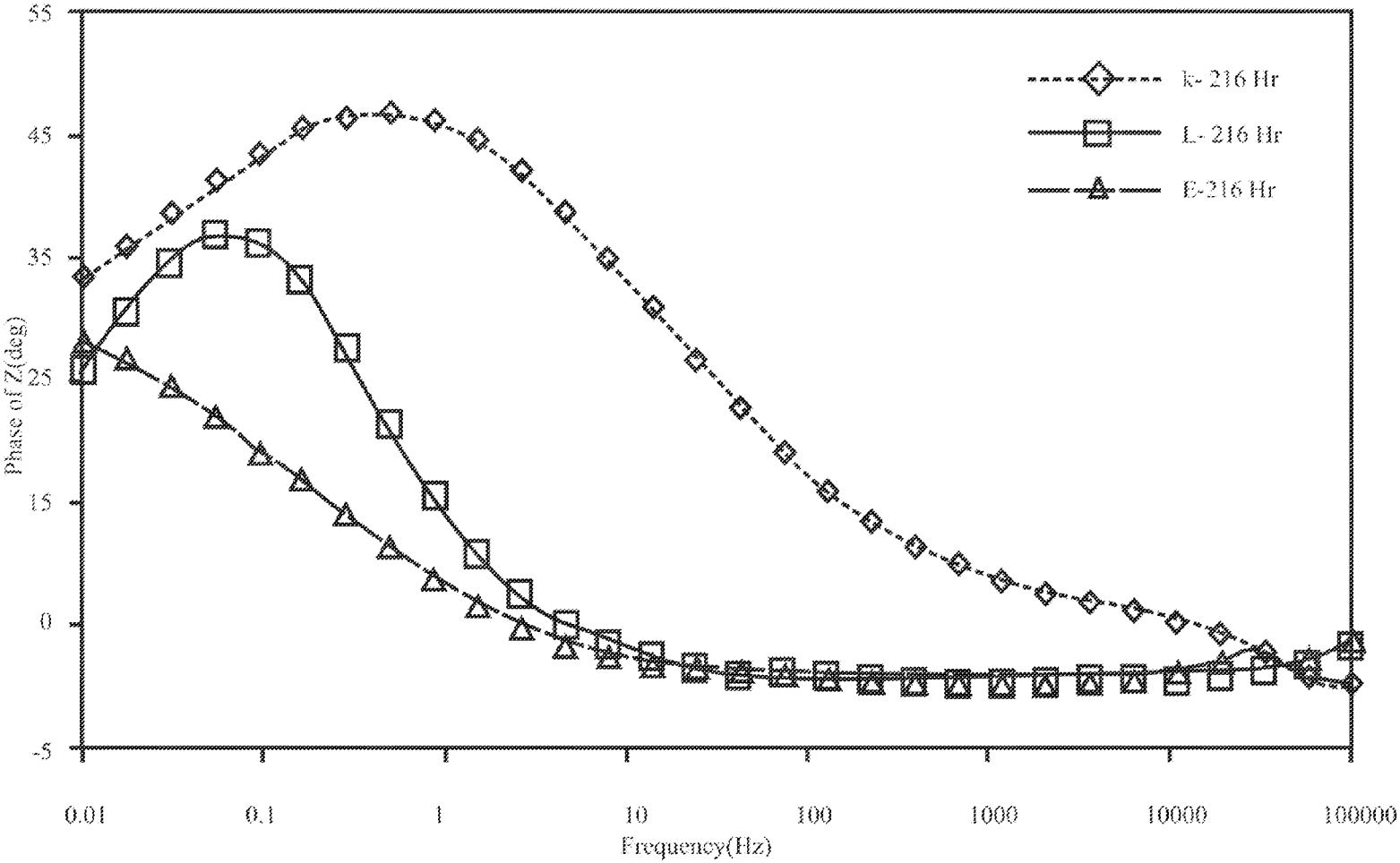

FIG. 21 shows Complex plane, Nyquist plots and Bode plots for non calcinated coatings K, L and E on mild steel with and without doping of benzotriazole after 216 hr of immersion in chloride solution.

Figure 22A:
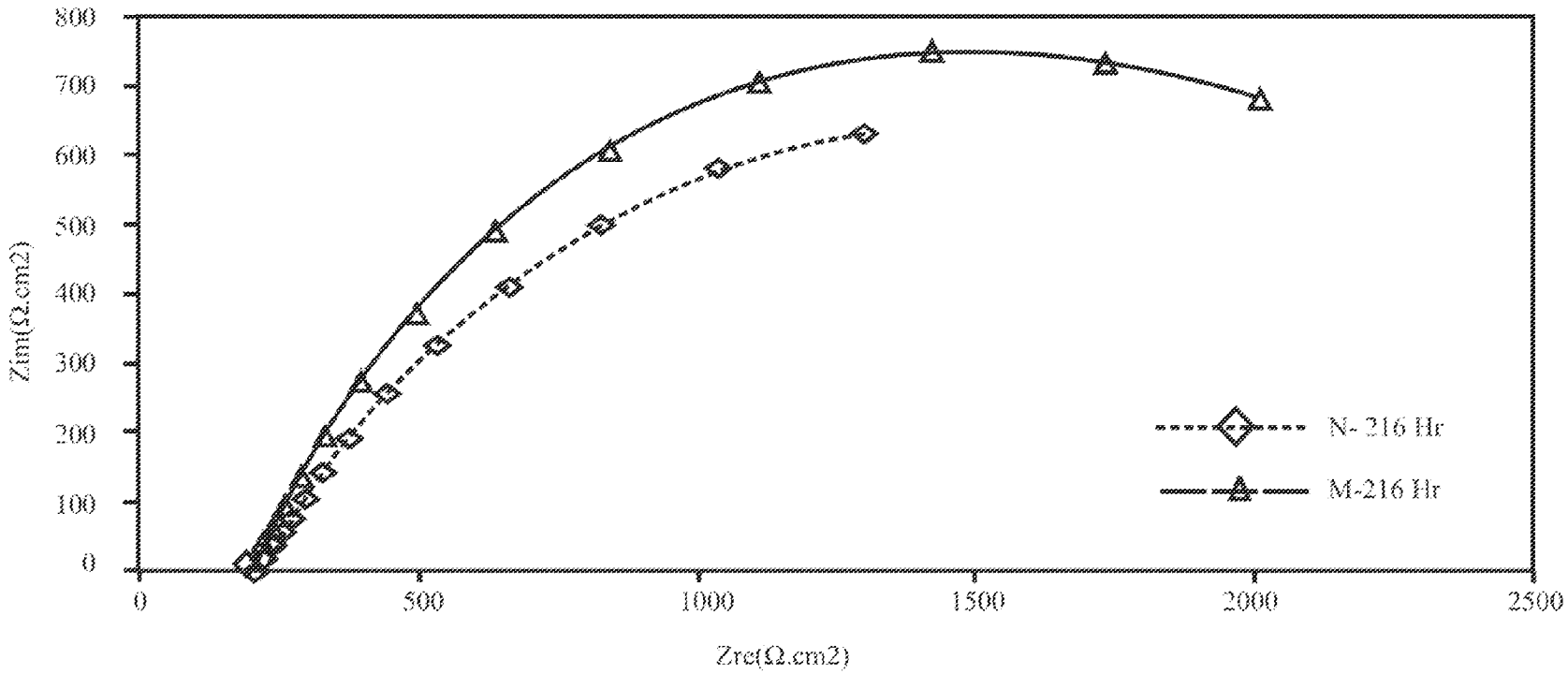
FIG. 22 shows Complex plane, Nyquist plots and Bode plots for calcinated coatings M and N on mild steel with and without doping of benzotriazole after 216 hr of immersion in chloride solution.
Figure 22B:
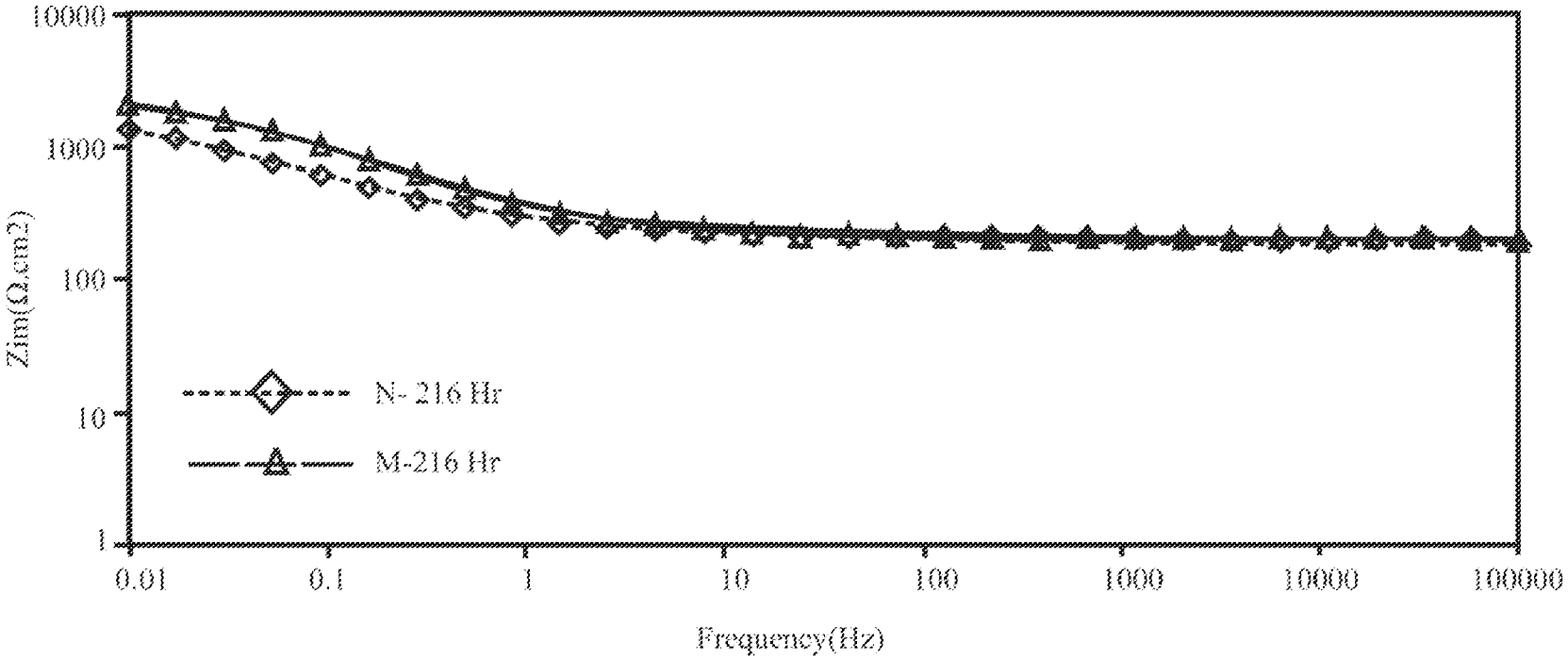
Figure 22C:
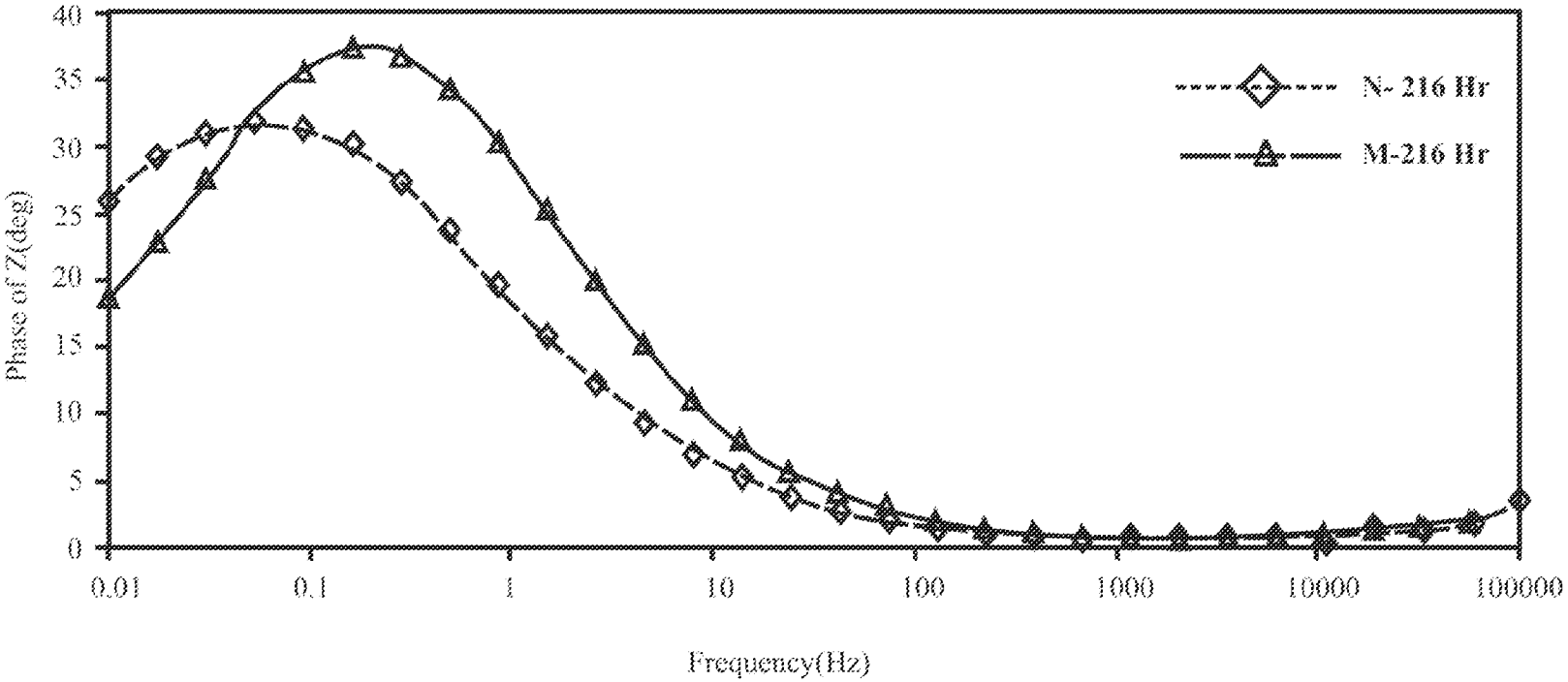

FIG. 22 shows Complex plane, Nyquist plots and Bode plots for calcinated coatings M and N on mild steel with and without doping of benzotriazole after 216 hr of immersion in chloride solution.

Table 6 shows the parameters of the $TiO_2$ nanostructured non calcinated, calcinated with and without doping benzotriazole that reveal K, L, E, M and N after 216 hr of immersion.

TABLE 6

Parameters of the hybrid nanostructure coatings calcinated and non calcinated before and after doping with benzotriazole after 216 hr of immersion in chloride solution obtained from fitting of experimental impedance spectra with equivalent circuit.

| specimen | $R_s$ ($\Omega \cdot cm^2$) | $R_p$ ($\Omega \cdot cm^2$) | $R_c$ ($\Omega \cdot cm^2$) | $(Q, Y_0)_{c(F)}$ | $n_c$ | Rct ($\Omega \cdot cm^2$) | $(Q, Y_0)_{dl(F)}$ | $n_{dl}$ |
|---|---|---|---|---|---|---|---|---|
| K | 184.7 | 1658.39 | 1638 | 0.0033 | 0.71 | 20.39 | $7.7 \times 10^{-8}$ | 0.95 |
| L | 6.35 | 1458.81 | 1445 | 0.0052 | 0.56 | 13.81 | $7.64 \times 10^{-8}$ | 0.64 |
| M | 81.49 | 3957.96 | 3942 | 0.00067 | 0.8 | 15.96 | $5.02 \times 10^{-8}$ | 1 |
| N | 175.6 | 2241.81 | 2185 | 0.0015 | 0.75 | 29.88 | $6.67 \times 10^{-8}$ | 0.81 |
| E | 183.7 | 1587.76 | 1564 | 0.007 | 0.71 | 23.76 | $7.18 \times 10^{-8}$ | 0.79 |

As it can be concluded from FIG. 22 and Table 6, the polarization resistance and corrosion protection have decreased, and the capacitance of the dielectric sol-gel film has increased for the samples after 216 hr of immersion than compared to the samples immersed for 1-5 hr. Generally the capacitance of the dielectric film depends on the amount of water absorbed. An increase in capacitance indicates an increase in the amount of water absorbed. Among the samples, the value of the polarization resistance of the mild steel coated with $TiO_2$ nanostructured calcinated and containing benzotriazole with a hybrid silicate film (i.e. sample M) has shown high impedance after 216 hr of immersion.

The samples immersed for 216 hr in chloride solution, have shown two time constants in the phase angle plot, which can be ascribed to the dual layer film capacitance and double layer capacitance. The hybrid silicate deposited on the $TiO_2$ interlayer, decrease the corrosion resistance of coatings due to penetration of corrosive electrolyte inside the micro and nano cracks produced in hybrid sol-gel film. However, $TiO_2$ nanostructured calcinated and non calcinated with and without doping organic inhibitor after 216 hr of immersion have shown higher resistance. This event can be originated from calcination treatment and presence of strong Si-o-Si bonds and organic group in hybrid silicate film that act as hydrophobic barrier against corrosive solution.

The nanostructure oxide layer doped with corrosion inhibitor seems to be a promising substitute for the environmental-unfriendly chromate pre-treatments. The use of the $TiO_2$ layer with high surface area open up the possibility of loading of such area with corrosion inhibitor. Calcination heat treatment provides more cracks and porosity which strengthen these sites for the uptake and adsorption of corrosion inhibitor. DC polarization and EIS measurements confirmed that calcinated and loaded titanium nanostructure with benzotriazole possesses high corrosion inhibition. Formation of surface complex film through the lone pair electrons on nitrogen atom in the triazol ring with Ti provides more compact barrier layer leading to a higher inhibition effect. Using hybrid silicate film from mixing two silicate precursors, deposited on the $TiO_2$ layer suggested imparting the anticorrosion properties due to fully dense and cross-linking structure of the protective surface.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the appended claims.

Although the embodiments herein are described with various specific embodiments, it will be obvious for a person skilled in the art to practice the invention with modifications. However, all such modifications are deemed to be within the scope of the claims.

It is also to be understood that the following claims are intended to cover all of the generic and specific features of the embodiments described herein and all the statements of the scope of the embodiments which as a matter of language might be said to fall there between.

What is claimed is:

1. A method of preparing a surface pre-treatment coating film for metallic substrates, the method comprising the steps of:

preparing a substrate;

depositing a titanium dioxide ($TiO_2$) layer on the substrate;

drying the $TiO_2$ layer after deposition on said substrate;

calcinating the dried $TiO_2$ layer;

doping the $TiO_2$ layer with a corrosion inhibitor;

drying the $TiO_2$ layer after doping the $TiO_2$ layer with the corrosion inhibitor;

depositing a hybrid silicate layer on the $TiO_2$ layer doped with the corrosion inhibitor; and curing the $TiO_2$ layer doped with the corrosion inhibitor after depositing the hybrid silicate layer.

2. The method according to claim 1, wherein the step of preparing the substrate comprises:

grinding the substrate with emery papers having numbers 200 to 2500 successively;

cleaning the grounded substrate ultrasonically in mixture comprising acetone, ethanol and distilled water for 10 min.

3. The method according to claim 1, wherein the titanium dioxide ($TiO_2$) layer is deposited on the substrate using a sol-gel method.

4. The method according to claim 1, wherein the titanium dioxide ($TiO_2$) layer is deposited on the substrate using a controllable hydrolysis of titanium alkoxide.

5. The method according to claim 1, wherein the step of depositing the titanium dioxide ($TiO_2$) layer on the substrate comprises:

preparing a titanium based sol by using a precursor, a solvent and a catalyst; wherein the precursor is a tetra-n-butyl orthotitanate, the solvent is ethanol, the catalyst is 70% nitric acid and the titanium based sol is a titanium alkoxide;

immersing the substrate in the titanium oxide sol for 100 seconds; and forming a thin film of the titanium dioxide on the substrate by a sol-gel dip coating process at a withdrawal speed of 18 cm/min.

6. The method according to claim 5, wherein the step of depositing the titanium dioxide ($TiO_2$) layer on the substrate comprises:

preparing a titanium based sol by using a precursor, a solvent and a catalyst; wherein the titanium based sol is prepared and synthesized by dissolving a quantity of titanium alkoxide in 0.685 moles of ethanol to obtain a solution, magnetically stirring the solution for 1 hour, hydrolyzing the solution by drop-wise adding a mixture comprising 0.277 moles of de-ionized water, 0.0441 moles of nitric acid 70% and 0.171 moles of ethanol, stirring the hydrolyzed solution for another 1 hour at room temperature and keeping the solution at room temperature for 24 hrs to obtain a transparent yellow solution.

7. The method according to claim 6, wherein the titanium alkoxide is 0.029 moles of tetra-n-butyl-orthotitanate.

8. The method according to claim 1, wherein the $TiO_2$ layer is dried at 120° C. for 1 hour after the deposition of the $TiO_2$ layer on said substrate.

9. The method according to claim 1, wherein the dried $TiO_2$ layer is calcinated up to 400° C. for 1 hour at a rate of 1° C./min in a furnace.

10. The method according to claim 1, wherein the corrosion inhibitor is benzotriazole.

11. The method according to claim 1, wherein the step of doping the $TiO_2$ layer with a corrosion inhibitor comprises dipping the $TiO_2$ layer in a solution of benzotriazole for 1 hour.

12. The method according to claim 11, wherein the concentration of benzotriazole solution is 10% by weight.

13. The method according to claim 1, wherein the $TiO_2$ layer is dried at 80° C. for 30 minutes after doping the $TiO_2$ layer with the corrosion inhibitor.

14. The method according to claim 1, wherein the step of depositing the hybrid silicate layer on the $TiO_2$ layer doped with the corrosion inhibitor comprises:

preparing a hybrid silica based sol;

applying the prepared hybrid silica-based sol on the doped $TiO_2$ layer using a sol-gel dip technique by dipping the substrate formed with the doped $TiO_2$ layer at a dipping speed of 18 cm/min and exposing the substrate for a duration of 100 seconds; and drying the hybrid-silica layer after depositing on the doped $TiO_2$ layer at 120° C. for 1 hour.

15. The method according to claim 14, wherein the process of preparing the hybrid silica-based sol comprises:

preparing an organosiloxane sol by hydrolyzing a 3-glycidoxypropyltrimethoxysilane (GPTMS), a tetraethylorthosilicate (TEOS) and a 2-propanol in preset volume ratios;

hydrolyzing the organosiloxane sol by adding 5 ml of de-ionized water that is dissolved in 0.5 ml acetic acid in drop-wise to the an organosiloxane sol, after 1 hour since preparation;

stirring the hydrolyzed organosiloxane sol under ultrasonic agitation for 1 hour; and ageing the stirred hydrolyzed organosiloxane sol for 24 hrs for condensation.

16. The method according to claim 15, wherein the 3-glycidoxypropyltrimethoxysilane (GPTMS), the tetraethylorthosilicate (TEOS) and the 2-propanol are mixed in the preset volume ratios of 6:5:12.

* * * * *